US006441289B1

(12) United States Patent
Shinsky

(10) Patent No.: US 6,441,289 B1
(45) Date of Patent: Aug. 27, 2002

(54) FIXED-LOCATION METHOD OF MUSICAL PERFORMANCE AND A MUSICAL INSTRUMENT

(76) Inventor: Jeff K. Shinsky, 10126 Spotted Horse Dr., Houston, TX (US) 77064

( * ) Notice: Subject to any disclaimer, the term of this patent is extended or adjusted under 35 U.S.C. 154(b) by 0 days.

(21) Appl. No.: 09/588,094

(22) Filed: Jun. 2, 2000

Related U.S. Application Data

(63) Continuation-in-part of application No. 09/247,378, filed on Feb. 10, 1999, which is a continuation-in-part of application No. 09/119,870, filed on Jul. 21, 1998, which is a continuation-in-part of application No. 08/898,613, filed on Jul. 22, 1997, now Pat. No. 5,783,767, which is a continuation-in-part of application No. 08/531,786, filed on Sep. 21, 1995, now Pat. No. 5,650,584.

(60) Provisional application No. 60/020,457, filed on Aug. 28, 1995.

(51) Int. Cl.[7] ..... A63J 17/00
(52) U.S. Cl. ..... 84/464 R
(58) Field of Search ..... 84/464 R, 478, 84/637, 650

(56) References Cited

U.S. PATENT DOCUMENTS 4,378,720 A * 4/1983 Nakada et al. ..... 84/478 X
4,437,378 A * 3/1984 Ishida et al. ..... 84/478 X
5,502,274 A 3/1996 Hotz

OTHER PUBLICATIONS

"Band–in–a–Box", advertisement, published circa 1994–5.

* cited by examiner

*Primary Examiner*—Jeffrey Donels
(74) *Attorney, Agent, or Firm*—Harrison & Egbert

(57) ABSTRACT

A method and apparatus for performing music on an electronic instrument in which individual chord progression chords can be triggered in real-time, while simultaneously making the individual notes of the chord, and/or possible scale notes and non-scale notes to play along with the chord, available for playing in separate fixed-locations on the instrument. The method of performance involves the designation of a chord progression section on the instrument, then assigning chords or individual chord notes to this chord progression section according to the defined customary scale or customary scale equivalent of a song key. Further, as each chord is played in the chord progression section, the individual notes of the currently triggered chords are simultaneously made available for playing in separate fixed locations on the instrument. Fundamental and alternate notes of each chord may be made available for playing in separate fixed locations for performance purposes. Possible scale notes and/or non-scale notes to play along with the currently triggered chord, may also be simultaneously made available for playing in separate fixed locations on the instrument. All performance data can be stored in memory or on a storage device, and can later be retrieved and performed by a user from one or more fixed locations on the instrument. The performance data may also be performed using a variable number of input controllers. Multiple instruments of the present invention can also be used together to allow interaction among multiple users during performance, with no knowledge of music theory required. Further, the present invention can allow professional performance to be achieved with little or no hand movement being required. Input controllers are configured into a group or groups to provide dramatically reduced hand movement during performance. Input controller groups are then used efficiently at all times to allow a user improved access to a variety of different notes and note groups needed to initiate a professional performance. An untrained user is thus able to create professional music with an absolute minimal amount of physical skill being required, while retaining full creative control over the music to be performed.

41 Claims, 50 Drawing Sheets

FIXED-LOCATION METHOD OF MUSICAL PERFORMANCE AND A MUSICAL INSTRUMENT

This is a continuation in part of application Ser. No. 09/247,378 filed Feb. 10, 1999, which is a continuation in part of application Ser. No. 09/119,870 filed Jul. 21, 1998, which is a continuation in part of application Ser. No. 08/898,613, filed Jul. 22, 1997, U.S. Pat. No. 5,783,767, which is a continuation in part of application Ser. No. 08/531,786, filed Sep. 21, 1995, U.S. Pat. No. 5,650,584, which claims the benefit of Provisional Application No. 60/020,457 filed Aug. 28, 1995.

FIELD OF THE INVENTION

The present invention relates generally to a method of performing music on an electronic instrument. This invention relates more particularly to a method and an instrument for performing in which individual chords and/or chord notes in a chord progression section can be triggered in real-time. Simultaneously, other notes and/or note groups, such as chord notes, scale notes, and non-scale notes are made available for playing in separate fixed locations on the instrument. All performance data can later be retrieved and performed from one or more fixed locations on the instrument, and from a varied number of input controllers. Multiple instruments of the present invention can also be used together to allow interaction among multiple users during performance, with no knowledge of music theory required. Further, the present invention can allow professional performance with little or no hand movement required, by using one or more performance groups of input controllers efficiently at all times.

BACKGROUND OF THE INVENTION

A complete electronic musical system should have a means of performing professional music with little or no training, whether live or along with a previously recorded track, while still allowing the highest levels of creativity and interaction to be achieved during a performance.

Methods of performing music on an electronic instrument are known, and may typically be classified in either of three ways: (1) a method in which automatic chord progressions are generated by depression of a key or keys (for example, Cotton Jr., et al., U.S. Pat. No. 4,449,437), or by generating a suitable chord progression after a melody is given by a user (for example, Minamitaka, U.S. Pat. No. 5,218,153); (2) a method in which a plurality of note tables is used for MIDI note-identifying information, and is selected in response to a user command (for example, Hotz, U.S. Pat. No. 5,099,738); and (3) a method in which performance of music on an electronic instrument can be automated using an indication system (for example, Shaffer et al. , U.S. Pat. No. 5,266,735).

The first method of musical performance involves generating pre-sequenced or preprogrammed accompaniment. This automatic method of musical performance lacks the creativity necessary to perform music with the freedom and expression of a trained musician. This method dictates a preprogrammed accompaniment without user-selectable modifications in real-time, and is therefore unduly limited.

The second method of musical performance does not allow for all of the various note groups and/or features needed to initiate professional performance, with little or no training. The present invention allows any and all needed performance notes and/or note groups to be generated on-the-fly, providing many advantages. Any note or group of notes can be auto-corrected during a performance according to specific note data or note group data, thus preventing incorrect or "undesirable" notes from playing over the various chord and scale changes in the performance. Every possible combination of chord groups, scale note groups, combined scale note groups, non-scale note groups, harmonies/inversions/voicings, note ordering, note group setups, and instrument setups can be generated and made accessible to a user at any time using the present invention. All that is required is the current status messages or other triggers described herein, or various user-selectable input, as described herein. This allows any new musical part to be added to a performance at any time, and these current status messages can also be stored and then transferred between various instruments for virtually unlimited compatibility and flexibility during both composition and performance. The nature of the present invention also allows musically-correct chords, as well as musically-correct individual chord notes, to be performed from the chord section while generating needed data which will be used for further note generation. The present invention achieves the highest levels of flexibility and efficiency in both composition and performance. Further, various indicators described herein which are needed by an untrained user for professional performance, can be easily determined and provided using the present invention. It should be noted that the words "composition" and "performance", as well as various derivatives of these, are at times used interchangeably herein to describe the present invention in order to simplify the description, and at times one of these may include the other.

There are five distinct needs which must be met, before a person with little or no musical training can effectively perform music with total creative control, just as a trained musician would:

(1) A means is needed for assigning a particular section of a musical instrument as a chord progression section in which individual chords and/or chord notes can be triggered in real-time. Further, the instrument should provide a means for dividing this chord progression section into particular song keys, and providing indicators so that a user understands the relative position of the chord in the predetermined song key. Various systems known in the art use a designated chord progression section, but with no allowance for indicating to a user the relative position of a chord regardless of any song key chosen. One of the most basic tools of a performer is the freedom to perform in a selected key, and to perform using specific chord progressions based on the song key. For example, when performing a song in the key of E Major, the musician should be permitted to play a chord progression of 1-4-5-6-2-3, or any other chord progression chosen by the musician. The indicators provided by the present invention can also indicate relative positions in the customary scale and/or customary scale equivalent of a selected song key, thus eliminating the confusion between major song keys, and their relative minor equivalents. Chromatic chords may also be performed at the discretion of a user. Inexperienced performers who use the present invention are made fully aware at all times of what they are actually playing, therefore allowing "non-scale" chromatic chords to be added by choice, not just added unknowingly.

(2) There also remains a need for a musical instrument that provides a user the option to play chords with one or more fingers in the chord progression section as previously described, while the individual notes of the currently triggered chord are simultaneously made available for playing in separate fixed locations on the instrument, and in different octaves. Regardless of the different chords which are being played in the chord progression section, the individual notes of each currently triggered chord can be made available for playing in these same fixed chord location(s) on the instrument in real-time. The fundamental note and the alternate note of the chord can be made available in designated fixed locations for composing purposes, and chord notes can be reconfigured in any way in real-time for virtually unlimited system flexibility during a performance. Providing the fundamental chord note and the alternate chord note in designated fixed locations on the instrument, allows a user to easily compose entire basslines, arpeggios, and specific chord harmonies with no musical training, while maintaining complete creative control.

(3) There also remains a need for a way to trigger chords with one or more fingers in the chord progression section, while scale notes and/or non-scale notes are simultaneously made available for playing in separate fixed locations on the instrument, and in different octaves. There should also be a means of correcting incorrect or "undesirable" notes during a performance, while allowing other notes to play through the chord and scale changes in the performance. A variety of different note groups should also be accessible to a user at any time, thus allowing a higher level of performance to be achieved. The methods of the present invention allow virtually any note group or note group combination to be made available to a user at any time during a performance (4) There also remains a need for a way to trigger chords with one or more fingers in the chord progression section, while the entire chord is simultaneously made available for playing from one or more keys in a separate fixed location, and can be sounded in different octaves when played. A variety of different chord voicings should also be accessible to a user at any time during a performance.

(5) Finally, there needs to be a means for adding to or modifying a composition once a basic chord progression and melody are decided upon and recorded or "stored" by a user. A user with little or no musical training is thus able to add a variety of additional musically correct parts and/or non-scale parts to the composition, to remove portions of the composition that were previously recorded, or to simply modify the composition in accordance with the taste of the musician. The methods of the present invention allow a user access to any note, series of notes, harmonies, note groups, chord voicings, inversions, instrument configurations, etc., thus allowing the highest levels of composition and performance to be achieved.

As previously mentioned, techniques for automating the performance of music on an electronic instrument are well known. They primarily involve the use of indication systems. These indication systems display to a user the notes to play on an instrument in order to achieve the desired performance. These techniques are primarily used as teaching aids of traditional music theory and performance (e.g., Shaffer et al., U.S. Pat. No. 5,266,735). These current methods provide high tech "cheat sheets". A user must follow along to an indication system and play all chords, notes, and scales just as a trained musician would. These methods do nothing to actually reduce the demanding physical skills required to perform the music, while still allowing the user to maintain creative control. Other performance techniques known in the art allow a song to be "stepped through" by pressing one or more input controllers multiple times. These techniques are unduly limited in the fact that very little user interaction is achieved. Still, other techniques do employ indication systems to allow a song to be stepped through (i.e. Casio's "Magic Light Keyboard"). These systems are unduly limited in the fact that they provide no means of reducing the complexity of a performance, or of allowing an untrained user to achieve the high levels of creative control and performance as described herein by the present invention (i.e. advanced tempo control, improvisational capability, multiple skill levels, multi-user performance, etc.). The present invention takes into account all of these needs. The present invention allows the number of input controllers needed to effect a given performance to be varied. Indications are used to accomplish this. The methods of the present invention allow a user to improvise in a given performance with complete creative control, and with no training required. Different skill levels may be used to provide different levels of user interaction. The advanced tempo control methods described herein provide a user with complete creative tempo control over a given performance, as well as allow an intended tempo to be indicated to the user. The fixed location methods of the present invention allow all appropriate notes, note groups, one-finger chords, and harmonies to be made available to a user from fixed locations on the instrument during performance. This allows an untrained user to improvise, as well as reduces the amount of physical skill needed to perform music. A user with little or no musical training can effectively perform music while maintaining the high level of creativity and interaction of a trained musician. Increased system flexibility is also provided due to all of the various notes, note groups, setup configurations, modes, etc. that are accessible to a user at any time.

Multiple instruments of the present invention may also be used together to allow professional performance among multiple users. The present invention allows interactive performance among multiple users, with no need for knowledge of music theory. The highest levels of creativity and flexibility are maintained. Users may perform together using instruments connected directly into one other, connected through the use of an external processor or processors, or by using various combinations of these. Multiple users may each select a specific performance part or parts to perform, in order to cumulatively effect an entire performance simultaneously. The fixed location methods of the present invention allow any previously recorded music to be played from a broad range of musical instruments, and with a virtually unlimited number of note groups, note group combinations, etc. being made accessible to a user at any time, and using only one set of recorded triggers.

It is a further object of the present invention to allow an untrained user to perform music professionally, while requiring little or no hand movement. Johnson, U.S. Pat. No. 5,440,071, teaches an instrument which allows untrained users to perform chord notes with reduced hand movement. However, the instrument disclosed requires excessive input controllers in order to initiate a professional chord performance (i.e. such as that which may be required in a song performance, for example). The instrument also lacks many other key elements needed by an untrained user for professional performance. The present invention takes into account all key elements needed by an untrained user for professional performance. The present invention can provide these key elements using a minimal number of input controllers. Input controllers of the present invention are configured into one or more performance groups for providing dramatically reduced hand movement during performance. The performance groups are then used efficiently at all times to allow a user improved access to a variety of different notes and note groups needed to initiate a professional performance. This reduction of input controllers also allows octave shifting to be accomplished conveniently from one designated location per performance group. Up to 5 or more octaves can be performed with little or no hand movement during both song composition and song performance. The present invention allows an untrained user to create professional music with an absolute minimal amount of physical skill being required, while retaining full creative control over the music to be performed.

SUMMARY OF THE INVENTION

There currently exists no such adequate means of performing music with little or no musical training. It is therefore an object of the present invention to allow individuals to perform music with reduced physical skill requirements and no need for knowledge of music theory, while still maintaining the highest levels of creativity and flexibility that a trained musician would have. The fixed location methods of the present invention solve these problems while still allowing a user to maintain creative control.

These and other features of the present invention will be apparent to those of skill in the art from a review of the following detailed description, along with the accompanying drawings.

DETAILED DESCRIPTION OF A PREFERRED EMBODIMENT

The present invention is primarily software based and the software is in large part a responsibility driven object oriented design. The software is a collection of collaborating software objects, where each object is responsible for a certain function.

Figure 1A:
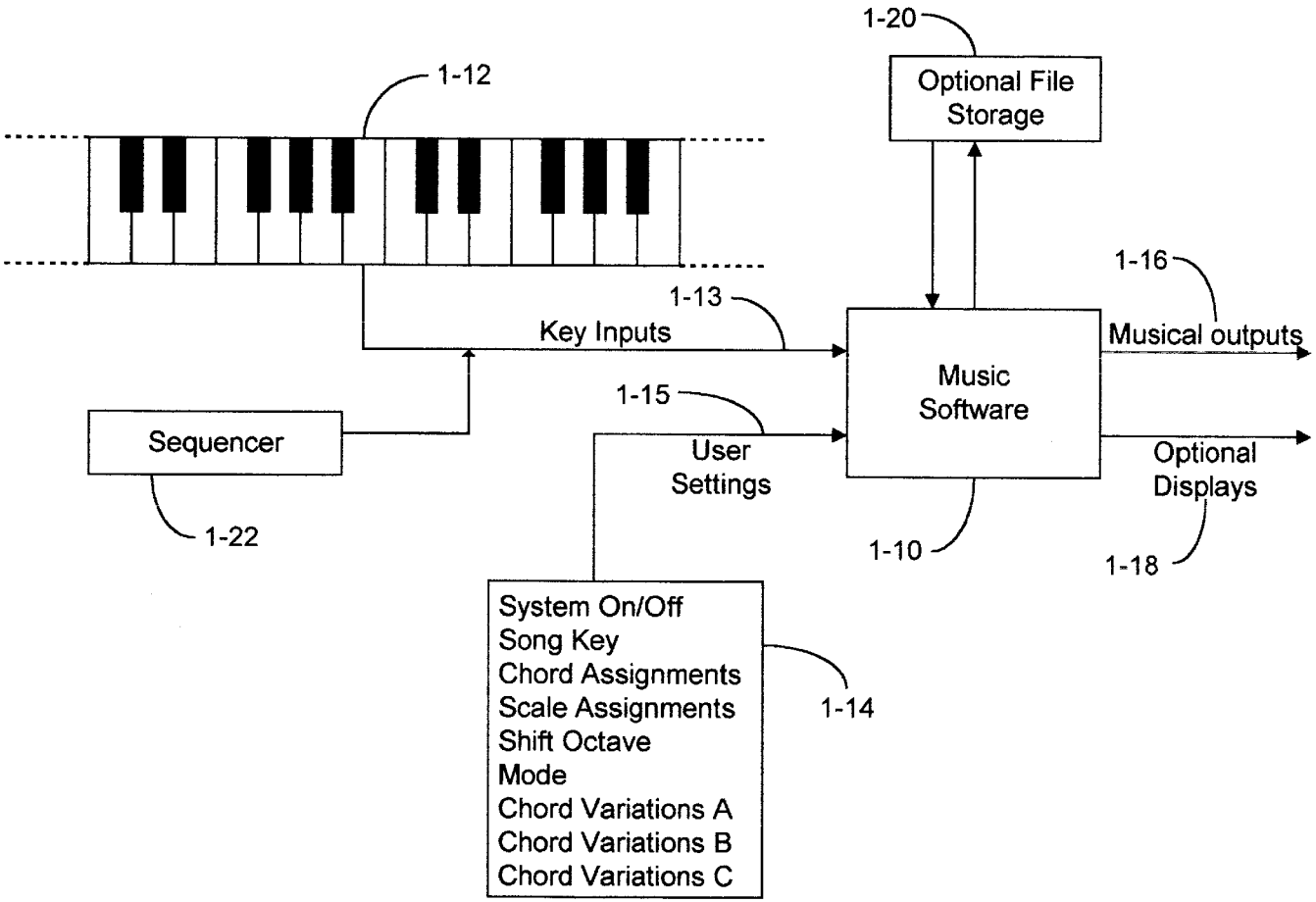
FIG. 1A is a schematic diagram of a performance instrument of the present invention.
Figure 1B:
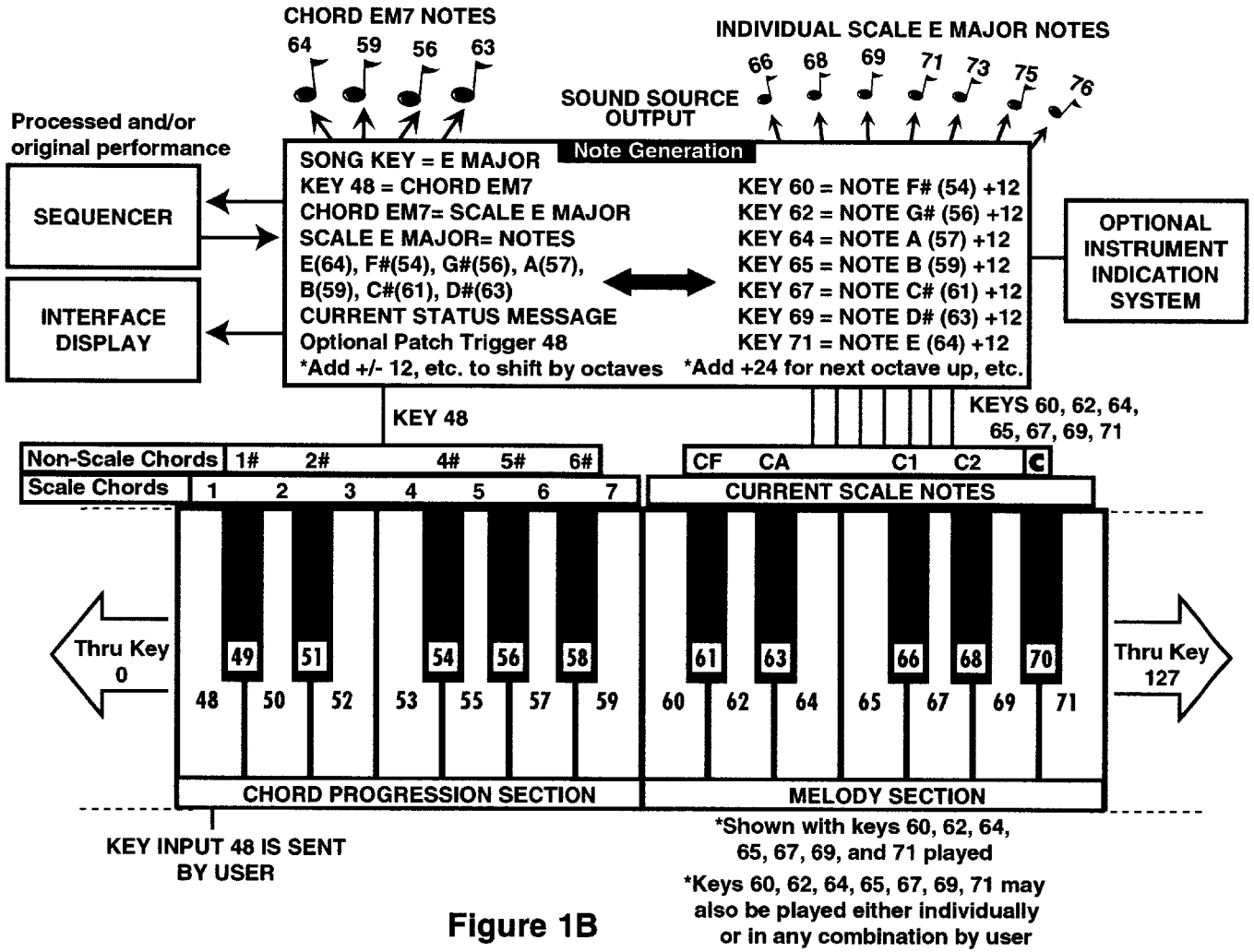
FIG. 1B is a general overview of the chord progression method and the fixed scale location method.
Figure 1C:
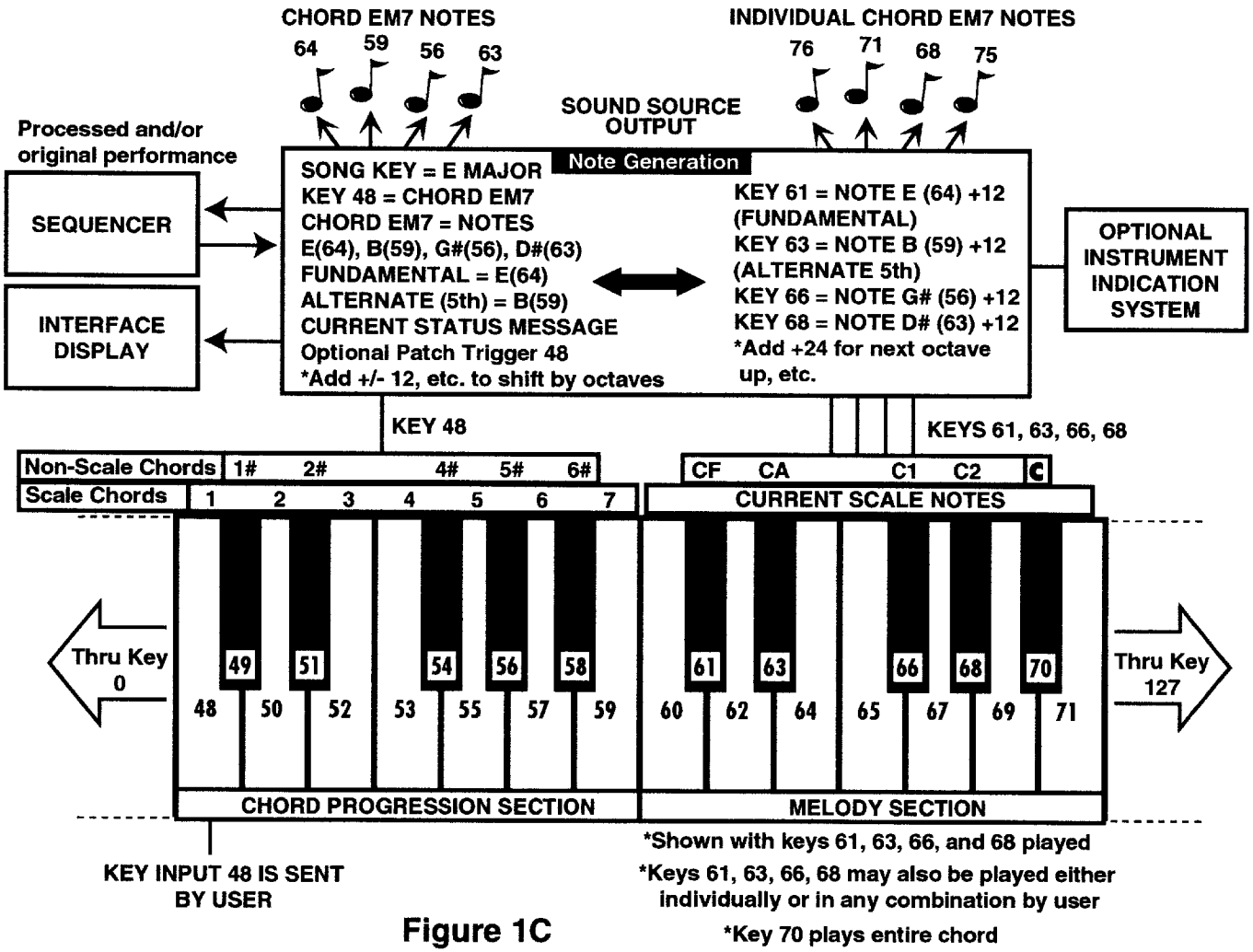
FIG. 1C is a general overview of the chord progression method and the fixed chord location method.
Figure 1D:
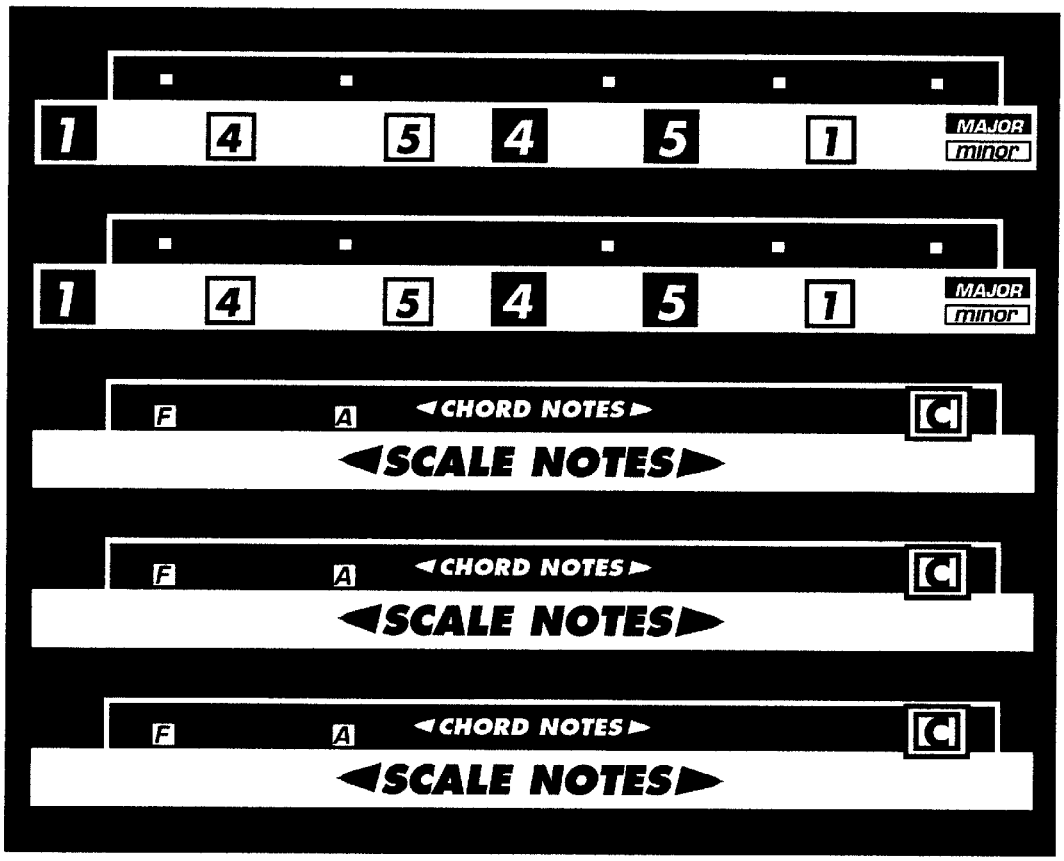
FIG. 1D is one sample of a printed indicator system which can be attached to or placed on the instrument.
Figure 2:
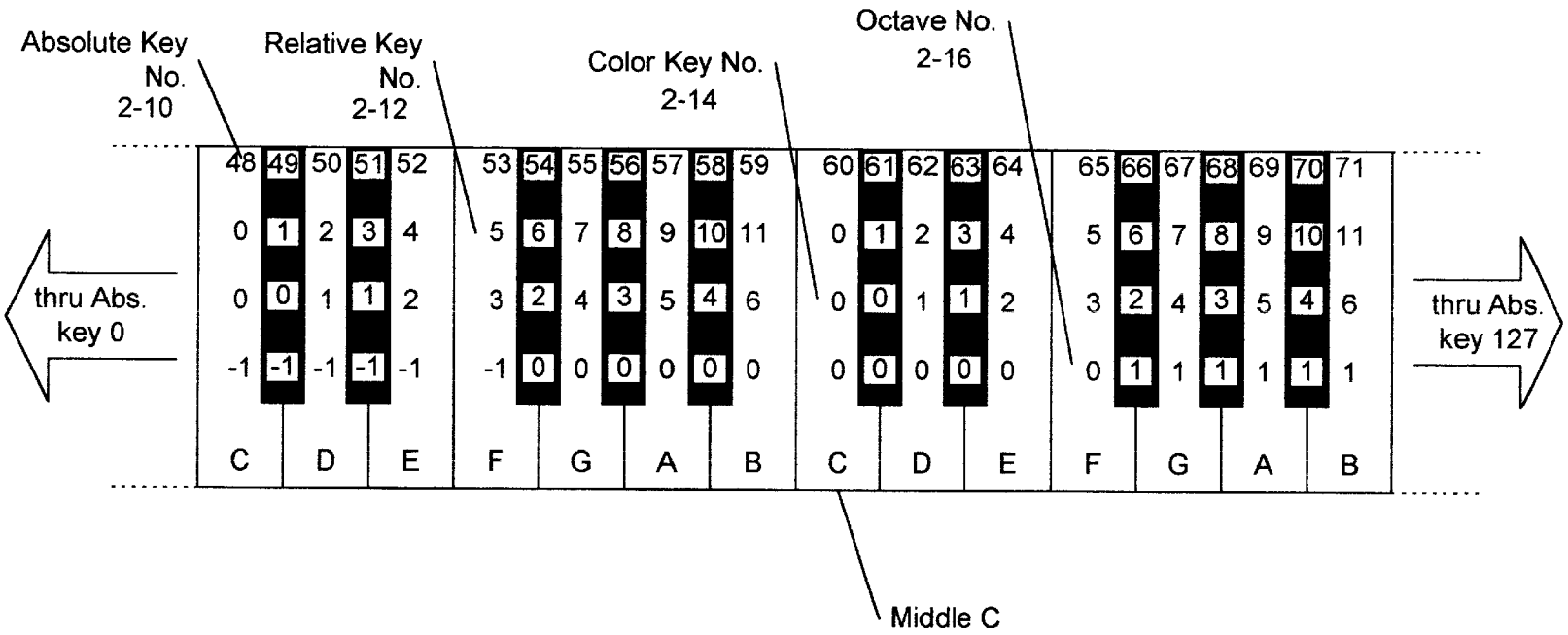
FIG. 2 is a detail drawing of a keyboard of the present invention defining key elements.
Figure 3:
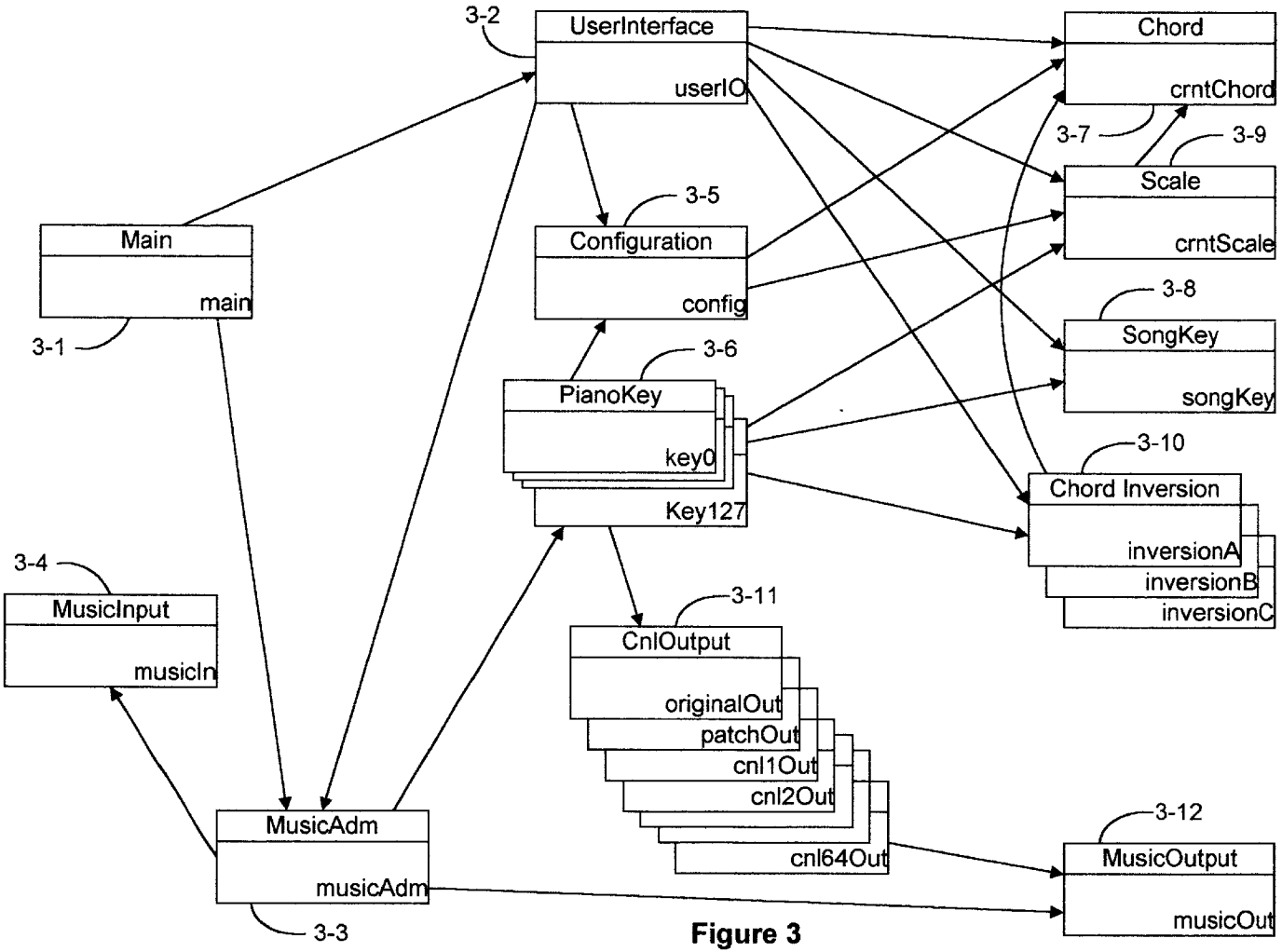
FIG. 3 is an overall logic flow block diagram of the system of the present invention.

For a more complete understanding of a preferred embodiment of the present invention, the following detailed description is divided to (1) show a context diagram of the software domain (FIG. 1A); (2) describe the nature of the musical key inputs to the software (FIG. 2); (3) show a diagram of the major objects (FIG. 3); (3) identify the responsibility of each major object; (4) list and describe the attributes of each major object; (5) list and describe the services or methods of each object, including flow diagrams for those methods that are key contributors to the present invention; and (6) describe the collaboration between each of the main objects.

Referring first to FIG. 1A, a computer 1-10 memory and processing elements in the usual manner. The computer 1-10 preferably has the music software program installed thereon. The music software program comprises an off-the-shelf program, and provides computer assisted musical performance software. This program accepts inputs from a keyboard 1-12 or other user interface element and a user-selectable set of settings 1-14. The keyboard 1-12 develops a set of key inputs 1-13 and the settings 1-14 provides a user settings input group 1-15.

It should be appreciated that the keyboard may comprise a standard style keyboard, or it may include a computer keyboard or other custom-made input device, as desired. The computer 1-10 sends outputs to musical outputs 1-16 for tone generation or other optional displays 1-18. The optional displays 1-18 provide a user with information which includes the present configuration, chords, scales and notes being played (output).

The music software in the computer 1-10 takes key inputs and translates them into musical note outputs. This software and/or program may exist separately from its inputs and outputs such as in a personal computer and/or other processing device. The software and/or program may also be incorporated along with its inputs and outputs as any one of its inputs or outputs, or in combination with any or all of its inputs or outputs. It is also possible to have a combination of these methods. All of these, whether used separately or together in any combination may be used to create an embodiment of the present invention.

The User settings input group 1-14 contains settings and configurations specified by a user that influence the way the software interprets the Key inputs 1-13 and translates these into musical notes at the musical outputs 1-16. The user settings 1-15 may be input through a computer keyboard, push buttons, hand operated switches, foot operated switches, or any combination of such devices. Some or all of these settings may also be input from the Key inputs 1-13. The user settings 1-15 include a System on/off setting, a song key setting, chord assignments, scale assignments, and various modes of operation.

The key inputs 1-13 are the principle musical inputs to the music software. The key inputs 1-13 contain musical chord requests, scale requests, melodic note requests, chord note requests and configuration requests and settings. These inputs are described in more detail in FIG. 2. One preferred source of the key inputs and/or input controllers is a digital electronic (piano) keyboard that is readily available from numerous vendors. This provides a user with the most familiar and conventional way of inputting musical requests to the software. The music software in the computer 1-10, however, may accept inputs 1-13 from other sources such as computer keyboards, or any other input controller device comprising various switching devices, which may or may not be velocity sensitive. A sequencer 1-22 or other device may simultaneously provide pre-recorded input to the computer 1-10, allowing a user to add another "voice" to a composition, and/or for various performance features described herein.

The system may also include an optional non-volatile file storage device 1-20. The storage device 1-20 may be used to store and later retrieve the settings and configurations. This convenience allows a user to quickly and easily configure the system to a variety of different configurations. The storage device 1-20 may comprise a magnetic disk, tape, or other device commonly found on personal computers and other digital electronic devices. These configurations may also be stored in memory, such as for providing real-time setups from an input controller, user interface element, etc.

The musical outputs 1-16 provide the main output of the system. The outputs 1-16 contain the notes, or note-identifying information representative of the notes, that a user intends to be sounded (heard) as well as other information, which may include musical data relating to how notes are sounded (loudness, etc.). In addition, other data such as configuration and key inputs 1-13 are encoded into the output stream to facilitate iteratively playing back and refining the results. The present invention can be used to generate sounds by coupling intended output with a sound source, such as a computer sound card, external sound source, internal sound source, software-based sound source, etc. which are all known in the art. The sound source described herein may be a single sound source, or one or more sound sources acting as a unit for sounding intended notes. An original performance can also be output (unheard) along with the processed performance (heard), and recorded for purposes of re-performance, substitutions, etc. MIDI is an acronym that stands for Musical Instrument Digital Interface, an international standard. Even though the preferred embodiment is described using the specifications of MIDI, any adequate protocol could be used. This can be done by simply carrying out all processing relative to the desired protocol. Therefore, the disclosed invention is not limited to MIDI only.

FIG. 2 shows how the system parses key inputs 1-13. Only two octaves are shown in FIG. 2, but the pattern repeats for all other lower and higher octaves. Each key input 1-13 has a unique absolute key number 2-10, shown on the top row of numbers in FIG. 2. The present invention may use a MIDI keyboard and, in such a case, the absolute key numbers are the same as the MIDI note numbers as described in the MIDI specification. The absolute key number 2-10 (or note number), along with velocity, is input to the computer for manipulation by the software. The software assigns other identifying numbers to each key as shown in rows 2 through 4 in FIG. 2. The software assigns to each key a relative key number 2-12 as shown in row 2. This is the key number relative to a C chromatic scale and ranges from 0–11 for the 12 notes of the scale. For example, every 'F' key on the keyboard is identified with relative number 5. Each key is also assigned a color (black or white) key number 2-14. Each white key is numbered 0–6 (7 keys) and each black key is numbered 0–4 (5 keys). For example, every 'F' key is identified as color (white) key number 3 (the 4th white key) and every 'F#' as color (black) key number 2 (the 3rd black key). The color key number is also relative to the C scale. The 4th row shown on FIG. 2 is the octave number 2-16. This number identifies which octave on the keyboard a given key is in. The octave number 0 is assigned to absolute key numbers 54 through 65. Lower keys are assigned negative octave numbers and higher keys are assigned positive octave numbers. The logic flow description that follows will refer to all 4 key identifying numbers.

FIG. 3 is a block diagram of the structure of the software showing the major objects. Each object has its own memory for storing its variables or attributes. Each object provides a set of services or methods (subroutines) which are used by other objects. A particular service for a given object is invoked by sending a message to that object. This is tantamount to calling a given subroutine within that object. This concept of message sending is described in numerous text books on software engineering and is well known in the art. The lines with arrows in FIG. 3 represent the collaborations between the objects. The lines point from the caller to the receiver.

Each object forms a part of the software; the objects work together to achieve the desired result. Below, each of the objects will be described independent of the other objects. Those services which are key to the present invention will include flow diagrams.

Figure 4:
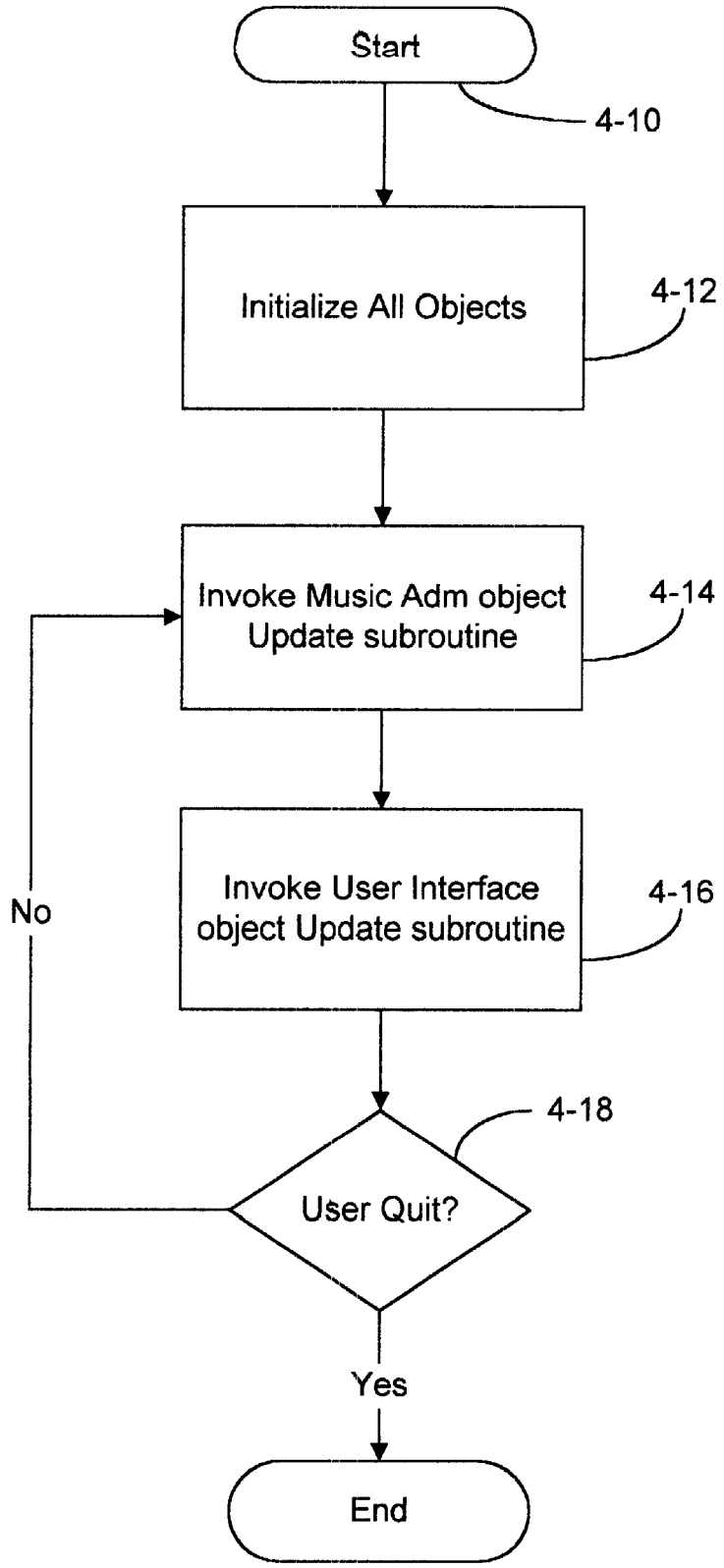
FIG. 4 is a high level logic flow diagram of the system.

The Main block 3-1 is the main or outermost software loop. The Main block 3-1 repeatedly invokes services of other objects. FIG. 4 depicts the logic flow for the Main object 3-1. It starts in step 4-10 and then invokes the initialization service of every object in step 4-12. Steps 4-14 and 4-16 then repeatedly invoke the update services of a Music Administrator object 3-3 and a User Interface object 3-2. The objects 3-3 and 3-2 in turn invoke the services of other objects in response to key (music) inputs 1-13 and user interface inputs. The user interface object 3-2 in step 4-18 determines whether or not a user wants to terminate the program.

Thus, the Main Object 3-1 calls the objects 3-3 and 3-2 to direct the overall action of the system and the lower level action of the dependent objects will now be developed.

Tables 1 and 2

Among other duties, the User Interface object 3-2 calls up a song key object 3-8. The object 3-8 contains the one current song key and provides services for determining the chord fundamental for each key in the chord progression section. The song key is stored in the attribute songKey and is initialized to C (See Table 2 for a list of song keys). The attribute circleStart (Table 1) holds the starting point (fundamental for relative key number 0) in the circle of 5ths or 4ths. The Get Key and Set Key services return and set the songKey attribute, respectively. The service 'SetMode( )' sets the mode attribute. The service SetCircle Start( ) sets the circle Start attribute.

When mode=normal, the 'Get-Chord Fundamental for relative key number Y' determines the chord fundamental note from Table 2. The relative key number Y is added to the current song key. If this sum is greater than 11, then 11 is subtracted from the sum. The sum becomes the index into Table 2 where the chord fundamental note is located and returned.

The chord fundamentals are stored in Table 2 in such a way as to put the scale chords on the white keys (index values of 0, 2, 4, 5, 7, 9, and 11) and the non-scale chords on the black keys (index values 1, 3, 6, 8, and 10). This is also the preferred method for storing the fundamental for the minor song keys. Optionally the fundamental for the minor keys may be stored using the offset shown in the chord indication row of Table 2.

As shown, a single song key actually defines both a customary scale and a customary scale equivalent. This means that a chord assigned to an input controller will represent a specific relative position in either the customary scale or customary scale equivalent of the song key. The song key is defined herein to be one song key regardless of various labels conveyed to a user (i.e. major/minor, minor, major, etc.). Non-traditional song key names may also be used (i.e. red, green, blue, 1, 2, 3, etc.). Regardless of the label used, a selected song key will still define one customary scale and one customary scale equivalent. The song key will be readily apparent during performance due to the fact that the song key has been used over a period of centuries and is well known. It should be noted that all indicators described herein by the present invention may be provided to a user in a variety of ways. Some of these may include through the use of a user interface, LEDs, printing, etching, molding, color-coding, design, decals, description or illustration in literature, provided to or created by a user for placement on the instrument, etc. Those of ordinary skill in the art will recognize that many ways, types, and combinations may be used to provide the indicators of the present invention. Therefore, indicators are not limited to the types described herein. It should also be noted that the methods of the present invention may also be used for other forms of music. Other forms of music may use different customary scales such as Indian scales, Chinese scales, etc. These scales may be used by carrying out all processing described herein relative to the scales. It should be noted that various groups of chords (i.e. 1-4-5 chords) may be indicated as a group. Any adequate relative position indicators may be used for the 1-4-5 chords, such as A-B-C, 1-2-3, etc. Regardless of the various indicators used, it should still be obvious that the relative position indicators are being provided as defined by a corresponding song key (i.e. a-before-b-before-c, 1-before-4-before-5, etc.).

Sending the message 'Get chord fundamental for relative key number Y' to the song key object calls a function or subroutine within the song key object that takes the relative key number as a parameter and returns the chord fundamental. When mode=circle5 or circle4, the relative key number Y is added to circleStart and the fundamental is found in Table 2 in circle of 5th and circle of 4th rows respectively. The service 'GetSongKeyLable( )' returns the key label for use by the user interface.

The service 'GetIndicationForKey(relativeKeyNumber)' is provided as an added feature to the preferred 'fixed location' method which assigns the first chord of the song key to the first key, the 2nd chord of the song key to the 2nd key etc. As an added feature, instead of reassigning the keys, the chords may be indicated on a computer monitor or above the appropriate keys using an alphanumeric display or other indication system. This indicates to a user where the first chord of the song key is, where the 2nd chord is etc. The service 'GetIndicationForKey(relativeKeyNumber)' returns the alpha-numeric indication that would be displayed. The indicators are in Table 2 in the row labeled 'Chord Indications'. The song key object locates the correct indicator by subtracting the song key from the relative key number. If the difference is less than 0, then 12 is added. This number becomes the table index where the chord indication is found. For example, if the song key is E MAJOR, the service GetIndicationForKey(4) returns indication '1' since 4 (relative key)−4 (song key)=0 (table index). GetIndicationForKey(11) returns '5' since 11 (relative key)−4 (song Key)=7 (table index) and GetIndicationForKey(3) returns '7' since 3(relative key)−4 (song key)+12=11 (table index). If the indication system is used, then the user interface object requests the chord indications for each of the 11 keys each time the song key changed. The chord indication and the key labels can be used together to indicate the chord name as well (D, F#, etc.)

TABLE 1

| SongKey Object Attributes and Services |
|---|
| attributes: |
| 1. songKey |
| 2. mode |
| 3. circleStart |
| Services: |
| 1. SetSongKey(newSongKey); |
| 2. GetSongKey( ); songKey |
| 3. GetChordFundamental(relativeKeyNumber): fundamental |
| 4. GetSongKeyLabel( ); textLabel |
| 5. GetIndicationForKey(relativeKeyNumber); indication |
| 6. SetMode(newMode); |
| 7. setCircleStart(newStart) |

TABLE 2

| | Song key and Chord Fundamental | | | | | | | | | | | |
|---|---|---|---|---|---|---|---|---|---|---|---|---|
| Table Index | 0 | 1 | 2 | 3 | 4 | 5 | 6 | 7 | 8 | 9 | 10 | 11 |
| Song Key | C | C# | D | D# | E | F | F# | G | G# | A | A# | B |
| Song Key attribute | 0 | 1 | 2 | 3 | 4 | 5 | 6 | 7 | 8 | 9 | 10 | 11 |
| Chord Fundamental | 60 | 61 | 62 | 63 | 64 | 65 | 54 | 55 | 56 | 57 | 58 | 59 |
| Circle of 5ths | C | G | D | A | E | B | F# | C# | G# | D# | A# | F |
| | (60) | (55) | (62) | (57) | (64) | (59) | (54) | (61) | (56) | (63) | (58) | (65) |
| Circle of 4ths | C | F | Bb | Eb | Ab | Db | Gb | B | E | A | D | G |
| | (60) | (65) | (58) | (63) | (56) | (61) | (54) | (59) | (64) | (57) | (62) | (55) |
| Key Label | C | C# | D | D# | E | F | F# | G | G# | A | A# | B |
| Chord indication | '1' | '1#' | '2' | '2#' | '3' | '4' | '4#' | '5' | '5#' | '6' | '6#' | '7' |
| Relative minor | '3' | '3# | '4' | '4#' | '5' | '6' | '6#' | '7' | '7#' | '1' | '1#' | '2' |

For example, if the current song key is D Major, then the current song key value is 2. If a message is received requesting the chord fundamental note for relative key number 5, then the song key object returns 55, which is the chord fundamental note for the 7th (2+5) entry in Table 2. This means that in the song key of D, an F piano key should play a G chord, but how the returned chord fundamental is used is entirely up to the object receiving the information. The song key object (3-8) does its part by providing the services shown.

Figure 5:
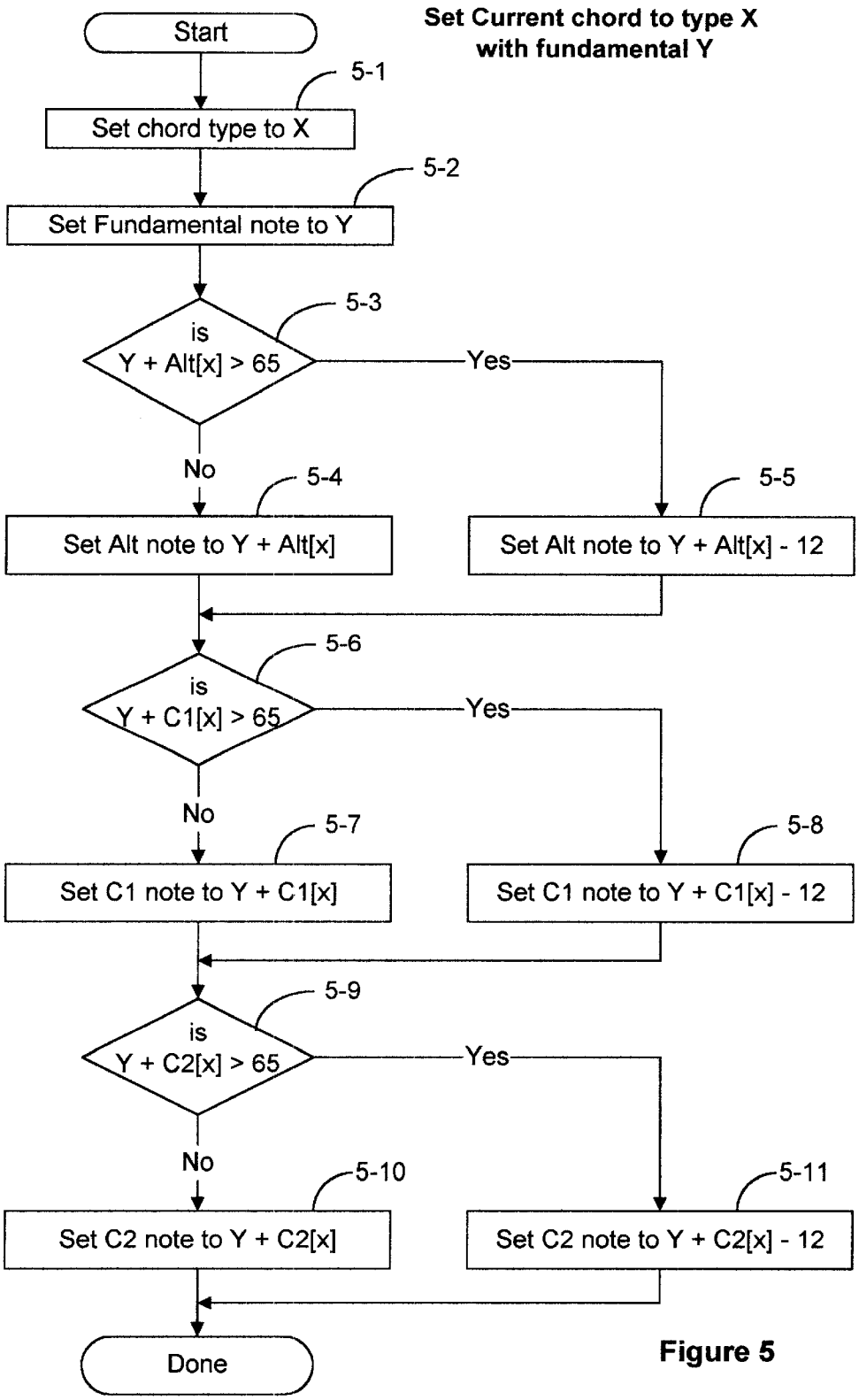
FIG. 5 is a logic flow diagram of chord objects 'Set Chord' service.

FIG. 5 and Tables 3 and 4

There is one current chord object 3-7. Table 3 shows the attributes and services of the chord object which include the current chord type and the four notes of the current chord. The current chord object provides nine services.

The 'GetChord( )' service returns the current chord type (major, minor, etc.) and chord fundamental note. The 'CopyNotes( )' service copies the notes of the chord to a destination specified by the caller. Table 4 shows the possible chord types and the chord formulae used in generating chords. The current chord type is represented by the index in Table 4. For example, if the current chord type is =6, then the current chord type is a suspended 2nd chord.

FIG. 5 shows a flow diagram for the service that generates and sets the current chord. Referring to FIG. 5, this service first sets the chord type to the requested type X in step 5-1. The fundamental note Y is then stored in step 5-2. Generally, all the notes of the current chord will be contained in octave number 0 which includes absolute note numbers 54 through 65 (FIG. 2). Y will always be in this range. The remaining three notes, the Alt note, C1 note, and C2 note of the chord are then generated by adding an offset to the fundamental note. The offset for each of these note is found in Table 4 under the columns labeled Alt, C1 and C2. Four notes are always generated. In the case where a chord has only three notes, the C2 note will be a duplicate of the C1 note.

Referring back to FIG. 5, step 5-3 determines if the sum of the fundamental note and the offset for the Alt note (designated Alt[x]) is less than or equal to 65 (5-3). If so, then the Alt note is set to the sum of the fundamental note plus the offset for the Alt note in step 5-4. If the sum of the fundamental note and the offset for the Alt note is greater than 65, then the Alt note is set to the sum of the fundamental note plus the offset of the Alt note minus 12 in step 5-5. Subtracting 12 yields the same note one octave lower.

Similarly, the Cl and C2 notes are generated in steps 5-6 through 5-11. For example, if this service is called requesting to set the current chord to type D Major (X=0, Y=62), then the current chord type will be equal to 0, the fundamental note will be 62 (D), the Alt note will be 57 (A, 62+7−12), the C1 note will be 54 (F#, 62+4−12)and the C2 note also be 54 (F#, 62+4−12). New chords may also be added simply by extending Table 4, including chords with more than 4 notes. Also, the current chord object can be configured so that the C1 note is always the 3rd note of the chord, etc. or note may be arranged in any order. A mode may be included where the 5th(ALT) is omitted from any chord simply by adding an attribute such as 'drop5th' and adding a service for setting 'drop5th' to be true or false and modifying the SetChordTo( ) service to ignore the ALT in Table 4 when 'drop5th' is true.

The service 'isNoteInChord(noteNumber)' will scan chordNote[ ] for noteNumber. If noteNumber is found it will return True (1). If it is not found, it will return False (0).

The remaining services return a specific chord note (fundamental, alternate, etc.) or the chord label.

TABLE 3

| Chord Object Attributes and Services |
|---|
| Attributes: |
| 1. chordType |
| 2. chordNote [4] |
| Services: |
| 1. SetChordTo(ChordType, Fundamental); |
| 2. GetChordType( ); chordType |
| 3. CopyChordNotes(destination); |
| 4. GetFundamental( ); chordNote[0] |
| 5. GetAlt( ); chordNote[1] |
| 6. GetC1( ); chordNote[2] |
| 7. GetC2( ); chordNote[3] |
| 8. GetChordLabel( ); textLabel |
| 9. isNoteInChord(noteNumber); True/False |

TABLE 4

| Chord Note Generation | | | | | | |
|---|---|---|---|---|---|---|
| Index | Type | Fund | Alt | C1 | C2 | Label |
| 0 | Major | 0 | 7 | 4 | 4 | " " |
| 1 | Major seven | 0 | 7 | 4 | 11 | "M7" |
| 2 | minor | 0 | 7 | 3 | 3 | "m" |
| 3 | minor seven | 0 | 7 | 3 | 10 | "m7" |
| 4 | seven | 0 | 7 | 4 | 10 | "7" |
| 5 | six | 0 | 7 | 4 | 9 | "6" |

TABLE 4-continued

| Chord Note Generation | | | | | | |
|---|---|---|---|---|---|---|
| Index | Type | Fund | Alt | C1 | C2 | Label |
| 6 | suspended 2nd | 0 | 7 | 2 | 2 | "sus2" |
| 7 | suspended 4th | 0 | 7 | 5 | 5 | "sus4" |
| 8 | Major 7 diminished 5th | 0 | 6 | 4 | 11 | "M7(−5)" |
| 9 | minor six | 0 | 7 | 3 | 9 | "m6" |
| 10 | minor 7 diminished 5th | 0 | 6 | 3 | 10 | "m7(−5)" |
| 11 | minor Major 7 | 0 | 7 | 3 | 11 | "m(M7)" |
| 12 | seven diminished 5 | 0 | 6 | 4 | 10 | "7(−5)" |
| 13 | seven augmented 5 | 0 | 8 | 4 | 10 | "7(+5)" |
| 14 | augmented | 0 | 8 | 4 | 4 | "aug" |
| 15 | diminished | 0 | 6 | 3 | 3 | "dim" |
| 16 | diminished 7 | 0 | 6 | 3 | 9 | "dim7" |

Figure 6A:
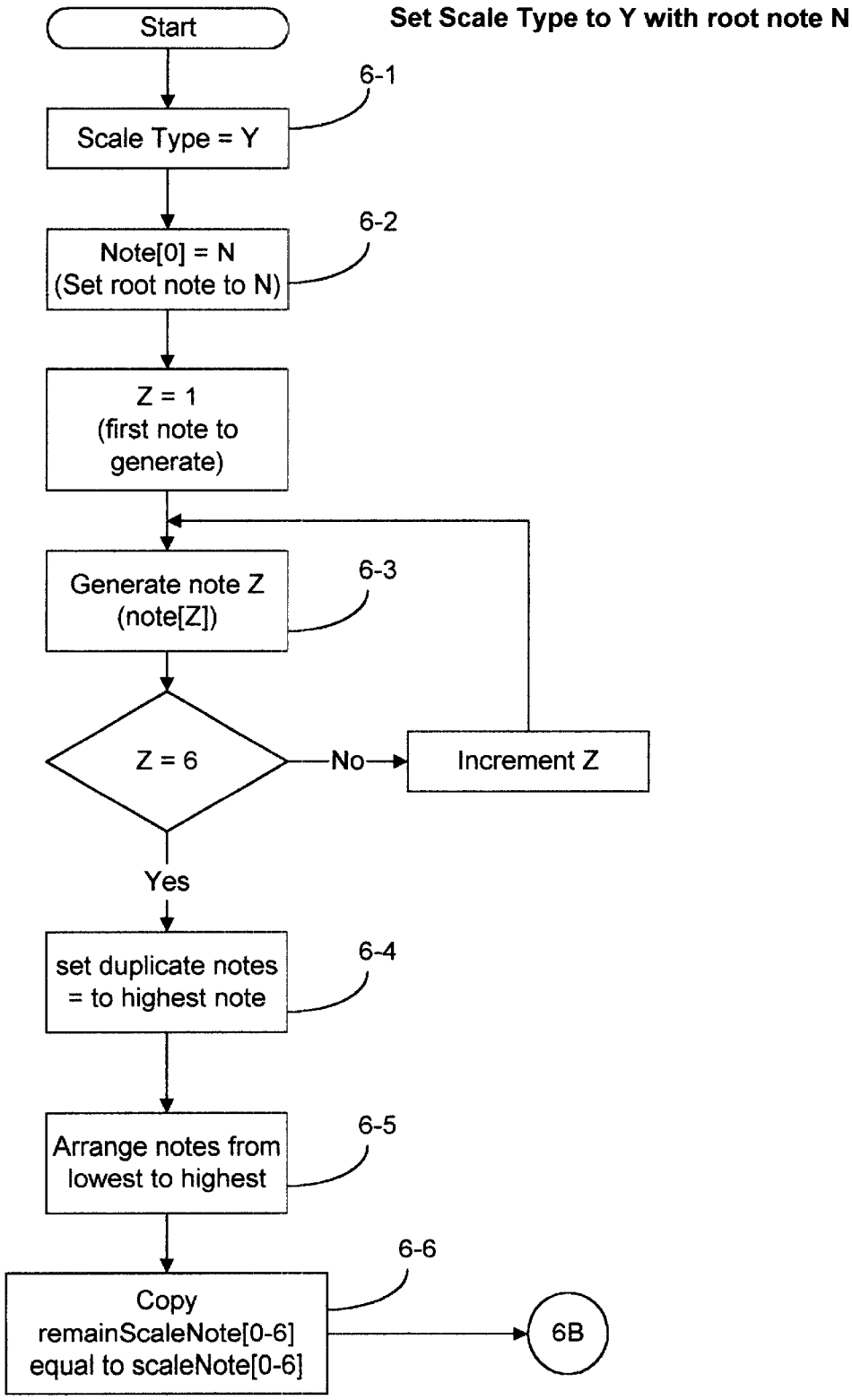
FIGS. 6A and 6B together are a logic flow diagram of scale objects 'Set scale' service.
Figure 6B:
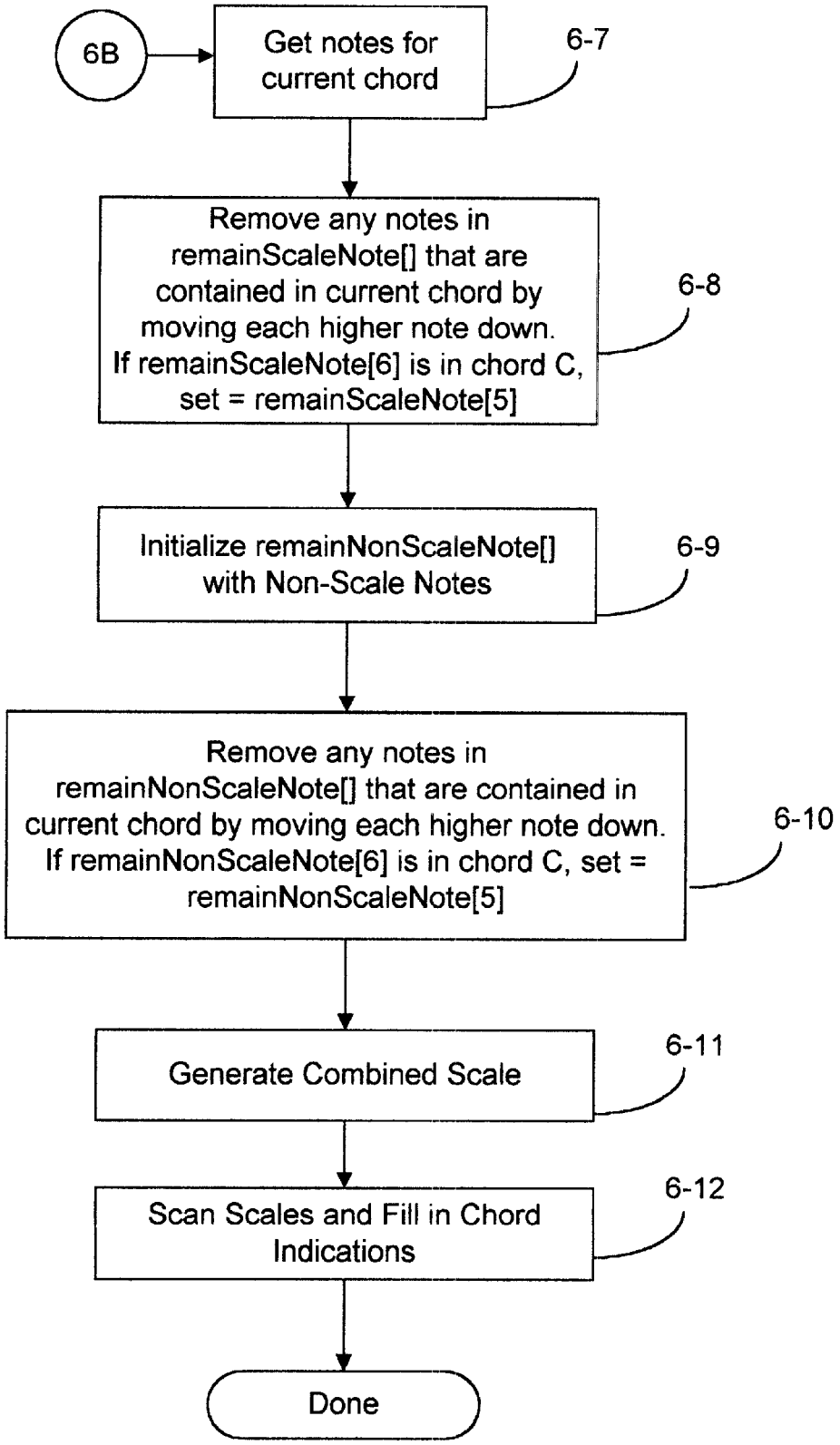

FIGS. 6*a* and 6*b* and Tables 5, 6a, 6b, and 7

As shown in FIG. 3, there is one Current Scale object 3-9. This object is responsible for generating the notes of the current scale. It also generates the notes of the current scale with the notes common to the current chord removed. It also provides the remaining notes that are not contained in the current scale or the current chord.

Referring to Table 5, the attributes of the current scale include the scale type (Major, pentatonic, etc.), the root note and all other notes in three scales. The scaleNote[7] attribute contains the normal notes of the current scale. The remainScaleNote[7] attributes contains the normal notes of the current scale less the notes contained in the current chord. The remainNonScaleNote[7] attribute contains all remaining notes (of the 12 note chromatic scale) that are not in the current scale or the current chord. The combinedScaleNote[11] attribute combines the normal notes of the current scale (scaleNote[ ]) with all notes of the current chord that are not in the current scale (if any).

Each note attribute ( . . . Note[ ]) contains two fields, a note number and a note indication (text label). The note number field is simply the value (MIDI note number) of the note to be sounded. The note indication field is provided in the event that an alpha numeric, LED (light emitting diode) or other indication system is available. It may provide a useful indication on a computer monitor as well. This 'indication' system indicates to a user where certain notes of the scale appear on the keyboard. The indications provided for each note include the note name, (A, B, C#, etc.), and note position in the scale (indicated by the numbers 1 through 7). Also, certain notes have additional indications. The root note is indicated with the letter 'R', the fundamental of the current chord is indicated by the letter 'F', the alternate of the current chord is indicated by the letter 'A', and the C1 and C2 notes of the current chord by the letters 'C1' and 'C2', respectively. All non-scale notes (notes not contained in scaleNote[ ]) have a blank (' ') scale position indication. Unless otherwise stated, references to the note attributes refer to the note number field.

The object provides twelve main services. FIGS. 6*a* and 6*b* show a flow diagram for the service that sets the scale type. This service is invoked by sending the message 'Set scale type to Y with root note N' to the scale object. First, the scale type is saved in step 6-1. Next, the root or first note of the scale, designated note[0], is set to N in step 6-2. The remaining notes of the scale are generated in step 6-3 by adding an offset for each note to the root note. The offsets are shown for each scale type in Table 6a. As with the current chord object, all the scale notes will be in octave 0 (FIG. 2). As each note is generated in step 6-3, if the sum of the root note and the offset is greater than 65, then 12, or one octave, is subtracted, forcing the note to be between 54 and 65. As shown in Table 6a, some scales have duplicate offsets. This is because not all scales have 7 different notes. By subtracting 12 from some notes to keep them in octave 0, it is possible that the duplicated notes will not be the highest note of the resulting scale. Note that the value of 'Z' (step 6-3) becomes the position (in the scale) indication for each note, except that duplicate notes will have duplicate position indications.

Step 6-4 then forces the duplicate notes (if any) to be the highest resulting note of the current scale. It is also possible that the generated notes may not be in order from lowest to highest.

Step 6-5, in generating the current scale, rearranges the notes from lowest to highest. As an example, Table 7 shows the values of each attribute of the current scale after each step 6-1 through 6-5 shown in FIG. 6 when the scale is set to C Major Pentatonic. Next, the remaining scales notes are generated in step 6-6. This is done by first copying the normal scale notes to remainScaleNote[ ] array. Next, the notes of the current chord are fetched from the current chord object in step 6-7.

Then, step 6-8 removes those notes in the scale that are duplicated in the chord. This is done by shifting the scale notes down, replacing the chord note. For example, if remainScaleNote[2] is found in the current chord, then remainScaleNote[2] is set to remainScaleNote[3], remainScaleNote[3] is set to remainScaleNote[4], etc. (remainScaleNote[6] is unchanged). This process is repeated for each note in remainScaleNote[] until all the chord notes have been removed. If remainScaleNote[6] is in the current chord, it will be set equal to remainScaleNote[5]. Thus, the remainScaleNote[ ] array contains the notes of the scale less the notes of the current chord, arranged from highest to lowest (with possible duplicate notes as the higher notes).

Finally, the remaining non-scale notes (remainNonScaleNote[ ]) are generated. This is done in a manner similar to the remaining scale notes. First, remainNonScaleNote[ ] array is filled with all the non-scale notes as determined in step 6-9 from Table 6b in the same manner as the scale notes were determined from Table 6a. The chord notes (if any) are then removed in step 6-10 in the same manner as for remainScaleNotes[ ]. The combineScaleNote[ ] attribute is generated in step 6-11. This is done by taking the scaleNote[ ] attribute and adding any note in the current chord (fundamental, alternate, C1, or C2) that is not already in scaleNote[ ] (if any). The added notes are inserted in a manner that preserves scale order (lowest to highest).

The additional indications (Fundamental, Alternate, C1 and C2) are then filled in step 6-12. The GetScaleType( ) service returns the scale type. The service GetScaleNote(n) returns the nth note of the normal scale. Similarly, services GetRemainScaleNote(n) and GetRemainNonScaleNote(n) return the nth note of the remaining scale notes and the remaining non-scale notes respectively. The services, 'GetScaleNoteIndication' and 'GetCombinedNoteIndication', return the indication field of the scaleNote[ ] and combinedScaleNote[ ] attribute respectively. The service 'GetScaleLabel( ) returns the scale label (such as 'C MAJOR' or 'f minor').

The service 'GetScaleThirdBelow(noteNumber)' returns the scale note that is the third scale note below noteNumber. The scale is scanned from scaleNote[0] through scaleNote [6] until noteNumber is found. If it is not found, then combinedScaleNote[ ] is scanned. If it is still not found, the original note Number is returned (it should always be found as all notes of interest will be either a scale note or a chord note). When found, the note two positions before (where noteNumber was found) is returned as scaleThird. The 2nd position before a given position is determined in a circular fashion, ie., the position before the first position (scaleNote [0] or combinedScaleNote[0] is the last position (scaleNote [6] or combinedScaleNote[10]. Also, positions with a duplicate of the next lower position are not counted. I.e., if scaleNote[6] is a duplicate of scaleNote[5] and scaleNote[5] is not a duplicate of scaleNote[4], then the position before scaleNote[0] is scaleNote[5]. If scaleThird is higher than noteNumber, it is lowered by one octave (=scaleThird−12) before it is returned. The service 'GetBlockNote(nthNote, noteNumber)' returns the nthNote chord note in the combined scale that is less (lower) than noteNumber. If there is no chord note less than noteNumber, 0 is returned.

The services 'isNoteInScale(noteNumber)' and 'isNoteInCombinedScale(noteNumber)' will scan the scale Note[ ] and combinedScaleNote[ ] arrays respectively for noteNumber. If noteNumber is found it will return True (1). If it is not found, it will return False (0).

A configuration object 3-5 collaborates with the scale object 3-9 by calling the SetScaleTo service each time a new chord/scale is required. This object 3-9 collaborates with a current chord object 3-7 to determine the notes in the current chord (CopyNotes service). The PianoKey objects 3-6 collaborate with this object by calling the appropriate GetNote service (normal, remaining scale, or remaining non-scale) to get the note(s) to be sounded. If an indication system is used, the user interface object 3-2 calls the appropriate indication service ('Get . . . NoteIndication( )') and outputs the results to the alphanumeric display, LED display, or computer monitor.

The present invention has eighteen different scale types (index 0–17), as shown in Table 6a. Additional scale types can be added simply by extending Tables 6a and 6b.

The present invention may also derive one or a combination of 2nds, 4ths, 5ths, 6ths, etc. and raise or lower these derived notes by one or more octaves to produce scalic harmonies.

TABLE 5

| Scale Object Attributes and Services |
|---|
| Attributes: |
| 1. scaleType |
| 2. rootNote |
| 3. scaleNote[7] |
| 4. remainScaleNote[7] |
| 5. remainNonScaleNote[7] |
| 6. combinedScaleNote[11] |
| Services: |
| 1. SetScaleTo(scaleType, rootNote); |
| 2. GetScaleType( ); scaleType |
| 3. GetScaleNote(noteNumber); scaleNote[noteNumber] |
| 4. GetRemainScaleNote(noteNumber); remainScaleNote[noteNumber] |
| 5. GetRemainNonscaleNote(noteNumber); remainNonScaleNote[noteNumber] |

TABLE 5-continued

| Scale Object Attributes and Services |
|---|
| 6. GetScaleThirdBelow(noteNumber); scaleThird |
| 7. GetBlockNote(nthNote, noteNumber); combinedScaleNote[derivedValue] |
| 8. GetScaleLabel( ); textLabel |
| 9. GetScaleNoteIndication(noteNumber); indication |
| 10. GetCombinedScaleNoteIndication(noteNumber); indication |
| 11. isNoteInScale(noteNumber); True/False |
| 12. isNoteInCombinedScale(noteNumber); True/False |

TABLE 6a

Normal Scale Note Generation

| Index | Scale type and label | 2nd note offset | 3rd note offset | 4th note offset | 5th note offset | 6th note offset | 7th note offset |
|---|---|---|---|---|---|---|---|
| 0 | minor | 2 | 3 | 5 | 7 | 8 | 10 |
| 1 | MAJOR | 2 | 4 | 5 | 7 | 9 | 11 |
| 2 | MAJ. PENT. | 2 | 4 | 7 | 9 | 9 | 9 |
| 3 | min. pent. | 3 | 5 | 7 | 10 | 10 | 10 |
| 4 | LYDIAN | 2 | 4 | 6 | 7 | 9 | 11 |
| 5 | DORIAN | 2 | 3 | 5 | 7 | 9 | 10 |
| 6 | AEOLIAN | 2 | 3 | 5 | 7 | 8 | 10 |
| 7 | MIXOLYDIAN | 2 | 4 | 5 | 7 | 9 | 10 |
| 8 | MAJ. PENT +4 | 2 | 4 | 5 | 7 | 9 | 9 |
| 9 | LOCRIAN | 1 | 3 | 5 | 6 | 8 | 10 |
| 10 | mel. minor | 2 | 3 | 5 | 7 | 9 | 11 |
| 11 | WHOLE TONE | 2 | 4 | 6 | 8 | 10 | 10 |
| 12 | DIM. WHOLE | 1 | 3 | 4 | 6 | 8 | 10 |
| 13 | HALF/WHOLE | 1 | 3 | 4 | 7 | 9 | 10 |
| 14 | WHOLE/HALF | 2 | 3 | 5 | 8 | 9 | 11 |
| 15 | BLUES | 3 | 5 | 6 | 7 | 10 | 10 |
| 16 | harm. minor | 2 | 3 | 5 | 7 | 8 | 11 |
| 17 | PHRYGIAN | 1 | 3 | 5 | 7 | 8 | 10 |

TABLE 6b

Non-Scale Note Generation

| Index | Scale type and label | 1st note offset | 2nd note offset | 3rd note offset | 4th note offset | 5th note offset | 6th note offset | 7th note offset |
|---|---|---|---|---|---|---|---|---|
| 0 | minor | 1 | 4 | 6 | 9 | 11 | 11 | 11 |
| 1 | MAJOR | 1 | 3 | 6 | 8 | 10 | 10 | 10 |
| 2 | MAJ. PENT. | 1 | 3 | 5 | 6 | 8 | 10 | 11 |
| 3 | min. pent. | 1 | 2 | 4 | 6 | 8 | 9 | 11 |
| 4 | LYDIAN | 1 | 3 | 5 | 8 | 10 | 10 | 10 |
| 5 | DORIAN | 1 | 4 | 6 | 8 | 11 | 11 | 11 |
| 6 | AEOLIAN | 1 | 4 | 6 | 9 | 11 | 11 | 11 |
| 7 | MIX-OLYDIAN | 1 | 3 | 6 | 8 | 11 | 11 | 11 |
| 8 | MAJ. PENT +4 | 1 | 3 | 6 | 8 | 10 | 11 | 11 |
| 9 | LOCRIAN | 2 | 4 | 7 | 9 | 11 | 11 | 11 |
| 10 | mel. minor | 1 | 4 | 6 | 8 | 10 | 10 | 10 |
| 11 | WHOLE TONE | 1 | 3 | 5 | 7 | 9 | 11 | 11 |
| 12 | DIM. WHOLE | 5 | 5 | 7 | 9 | 11 | 11 | 11 |
| 13 | HALF/WHOLE | 2 | 5 | 6 | 8 | 11 | 11 | 11 |
| 14 | WHOLE/HALF | 1 | 4 | 6 | 7 | 10 | 10 | 10 |
| 15 | BLUES | 1 | 2 | 4 | 8 | 9 | 11 | 11 |
| 16 | harm. minor | 1 | 4 | 6 | 9 | 10 | 10 | 10 |
| 17 | PHRYGIAN | 2 | 4 | 6 | 9 | 11 | 11 | 11 |

TABLE 7

Example Scale Note Generation
Example: Set current scale to type 2 (Major Pentatonic) with root note 60° C.

| After (see FIG. 6) | Scale Type | note [0] root | note [1] | note [2] | note [3] | note [4] | note [5] | note [6] |
|---|---|---|---|---|---|---|---|---|
| 6-1 | 2 | — | — | — | — | — | — | — |
| 6-2 | 2 | 60 (C) | — | — | — | — | — | — |
| 6-3 (Z = 1) | 2 | 60 (C) | 62 (D) | — | — | — | — | — |
| 6-3 (Z = 2) | 2 | 60 (C) | 62 (D) | 64 (E) | — | — | — | — |
| 6-3 (Z = 3) | 2 | 60 (C) | 62 (D) | 64 (E) | 55 (G) | — | — | — |
| 6-3 (Z = 4) | 2 | 60 (C) | 62 (D) | 64 (E) | 55 (G) | 57 (A) | — | — |
| 6-3 (Z = 5) | 2 | 60 (C) | 62 (D) | 64 (E) | 55 (G) | 57 (A) | 57 (A) | — |
| 6-3 (Z = 6) | 2 | 60 (C) | 62 (D) | 64 (E) | 55 (G) | 57 (A) | 57 (A) | 57 (A) |
| 6-4 | 2 | 60 (C) | 62 (D) | 64 (E) | 55 (G) | 57 (A) | 64 (E) | 64 (E) |
| 6-5 | 2 | 55 (G) | 57 (A) | 60 (C) | 62 (D) | 64 (E) | 64 (E) | 64 (E) |

Figure 7A:
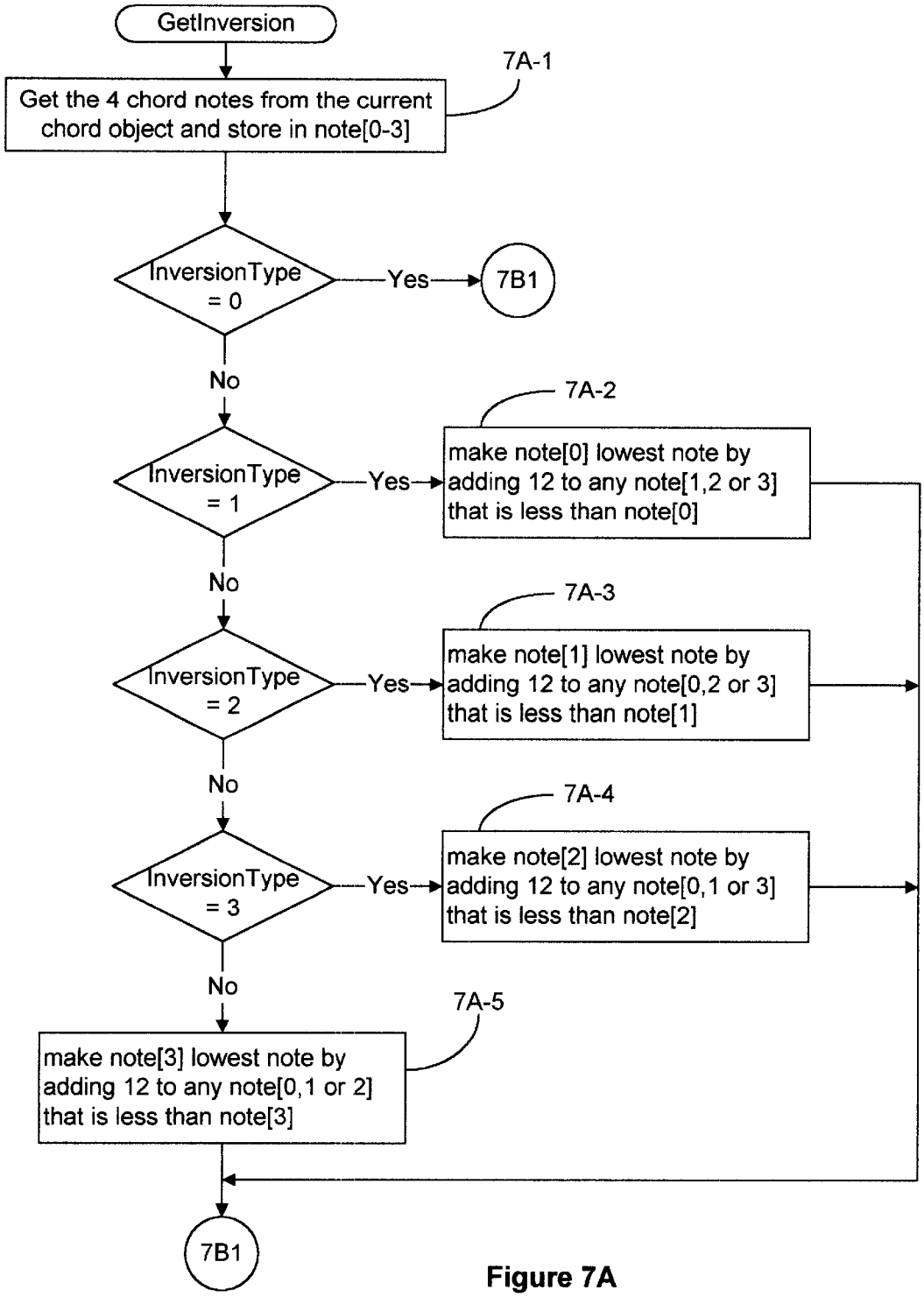
FIGS. 7A, 7B, 7C, and 7D together are a logic flow diagram of chord inversion objects.
Figure 7B:
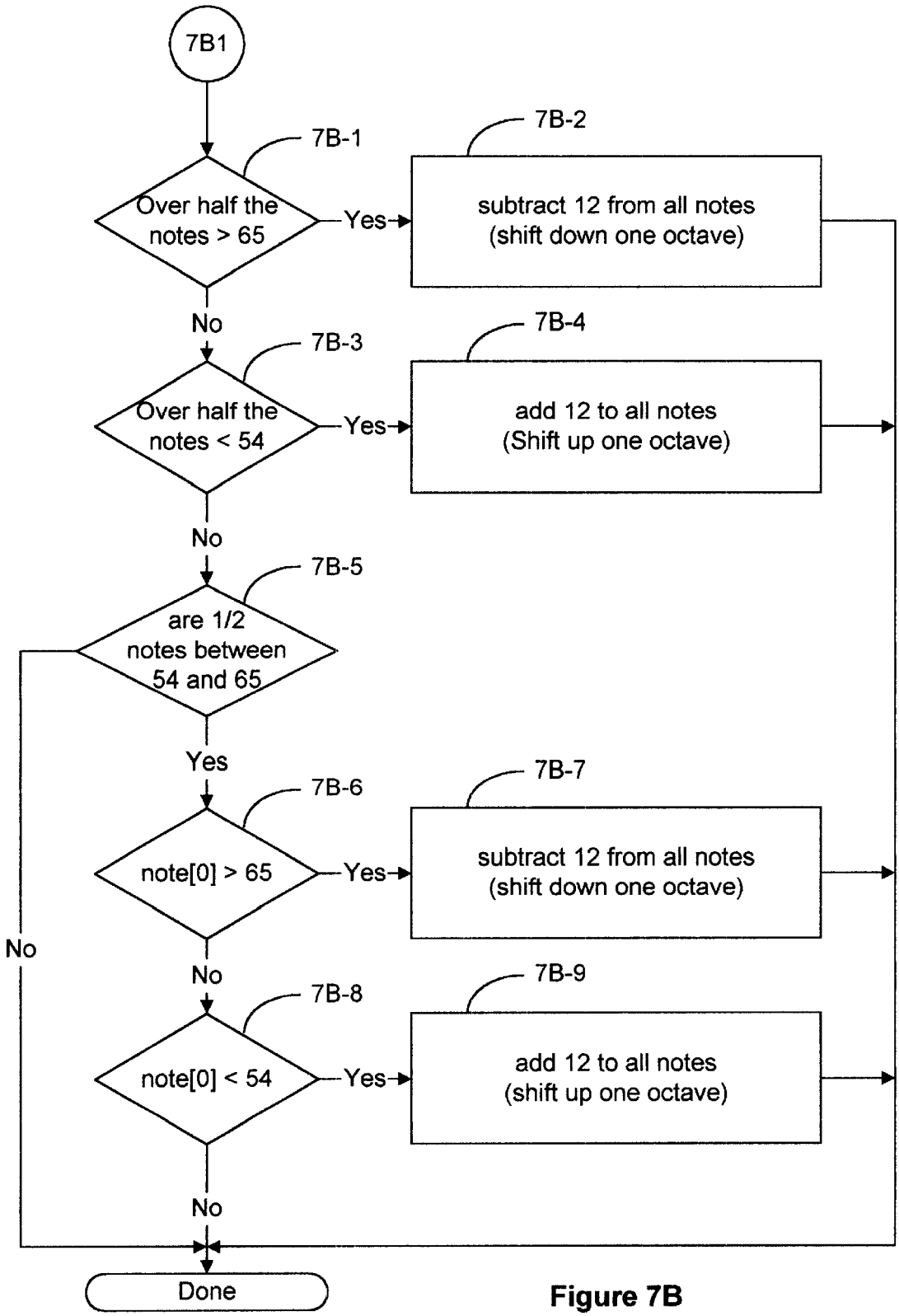
Figure 7C:
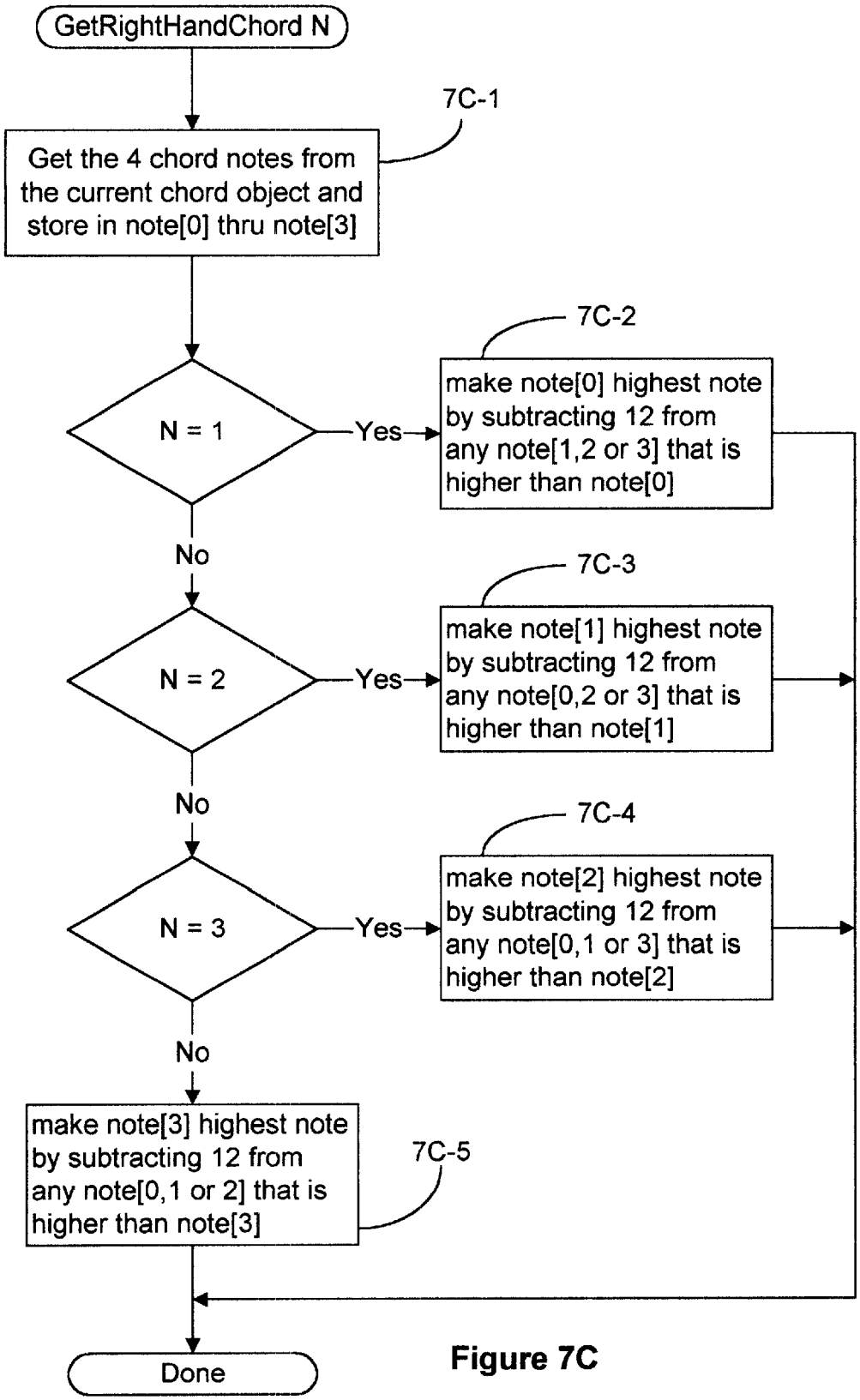

FIGS. 7a, 7b and 7c and Table 8

The present invention further includes three or more Chord Inversion objects 3-10. InversionA is for use by the Chord Progression type of PianoKey objects 3-6. InversionB is for the black melody type piano keys that play single notes 3-6 and inversionC is for the black melody type piano key that plays the whole chord 3-6. These objects simultaneously provide different inversions of the current chord object 3-7. These objects have the "intelligence" to invert chords. Table 8 shows the services and attributes that these objects provide. The single attribute inversionType, holds the inversion to perform and may be 0, 1, 2, 3, or 4.

TABLE 8

Chord Inversion Object Attributes and Services

Attributes:

1. inversionType

Services:

1. SetInversion(newInversionType);
2. GetInversion(note[ ]);
3. GetRightHandChord(note[ ]), Number);
4. GetRightHandChordWithHighNote(note[ ], HighNote);
5. GetFundamental( ); Fundamental
6. GetAlternate( ); Alternate
7. GetC1( ); C1
8. GetC2( ); C2

The SetInversion( ) service sets the attribute inversionType. It is usually called by the user interface 3-2 in response to keyboard input by a user or by a user pressing a foot switch that changes the current inversion.

For services 2, 3, and 4 of Table 8, note[ ], the destination for the chord, is passed as a parameter to the service by the caller.

FIGS. 7A, and 7B show a flow diagram for the GetInversion( ) service. The GetInversion( ) service first (7A-1) gets all four notes of the current chord from the current chord object (3-7) and stores these in the destination (note[0] through note [3]). At this point, the chord is in inversion 0 where it is known that the fundamental of the chord is in note [0], the alternate is in note [1], the C1 note is in note [2] and C2 is in note [3] and that all of these notes are within one octave (referred to as 'popular voicing)'. If inversionType is 1, then 7A-2 of FIG. 7A will set the fundamental to be the lowest note of the chord. This is done by adding one octave (12) to every other note of the chord that is lower than the fundamental (note[0]). If inversionType is 2, then 7A-3 of FIG. 7A will set the alternate to be the lowest note of the chord. This is done by adding one octave (12) to every other note of the chord that is lower than the alternate (note[1]). If inversionType is 3, then 7A-4 of FIG. 7A will set the C1 note to be the lowest note of the chord. This is done by adding one octave (12) to every other note of the chord that is lower than the C1 note (note[2]). If inversionType is none of the above (then it must be 4) then 7A-5 of FIG. 7A will set the C2 note to be the lowest note of the chord. This is done by adding one octave (12) to every other note of the chord that is lower than the C2 note (note[3]). After the inversion is set then processing continues with FIG. 7B. 7B1 of FIG. 7B checks if over half of the different notes of the chord have a value that is greater than 65. If so, then 7B-2 drops the entire chord one octave by subtracting 12 from every note. If not, 7B-3 checks if over half of the different notes of the chord are less than 54. If so, then 7B-4 raises the entire chord by one octave by adding 12 to every note. If more than half the notes are not outside the range 54–65, then 7B-5 checks to see if exactly half the notes are outside this range. If so, then 7B-6 checks if the fundamental note (note[0]) is greater than 65. If it is, then 7B-7 lowers the entire chord by one octave by subtracting 12 from every note. If the chord fundamental is not greater than 65, then 7B-8 checks to see if it (note[0]) is less than 54. If it is , then 7B-9 raises the entire chord one octave by adding 12 to every note. If preferred, inversions can also be shifted so as to always keep the fundamental note in the 54–65 range.

FIG. 7C shows a flow diagram for the service GetRightHand Chord( ). The right hand chord to get is passed as a parameter (N in FIG. 7C). 7C-1 first gets the current chord from the current chord object. If the right hand chord desired is 1 (N=1), meaning that the fundamental should be the highest note, then 7C-2 subtracts 12 (one octave) from any other note that is higher than the fundamental (note[0]). If the right hand chord desired is 2, meaning that the alternate should be the highest note, then 7C-3 subtracts 12 (one octave) from any other note that is higher than the alternate (note[1]). If the right hand chord desired is 3, meaning that the C1 note should be the highest note, then 7C-4 subtracts 12 (one octave) from any other note that is higher than the C1 note (note[2]). If the right hand chord desired is not 1, 2 or 3, then it is assumed to be 4, meaning that the C2 note should be the highest note and then 7C-5 subtracts 12 (one octave) from any other note that is higher than the C2 note (note [3]).

Figure 7D:
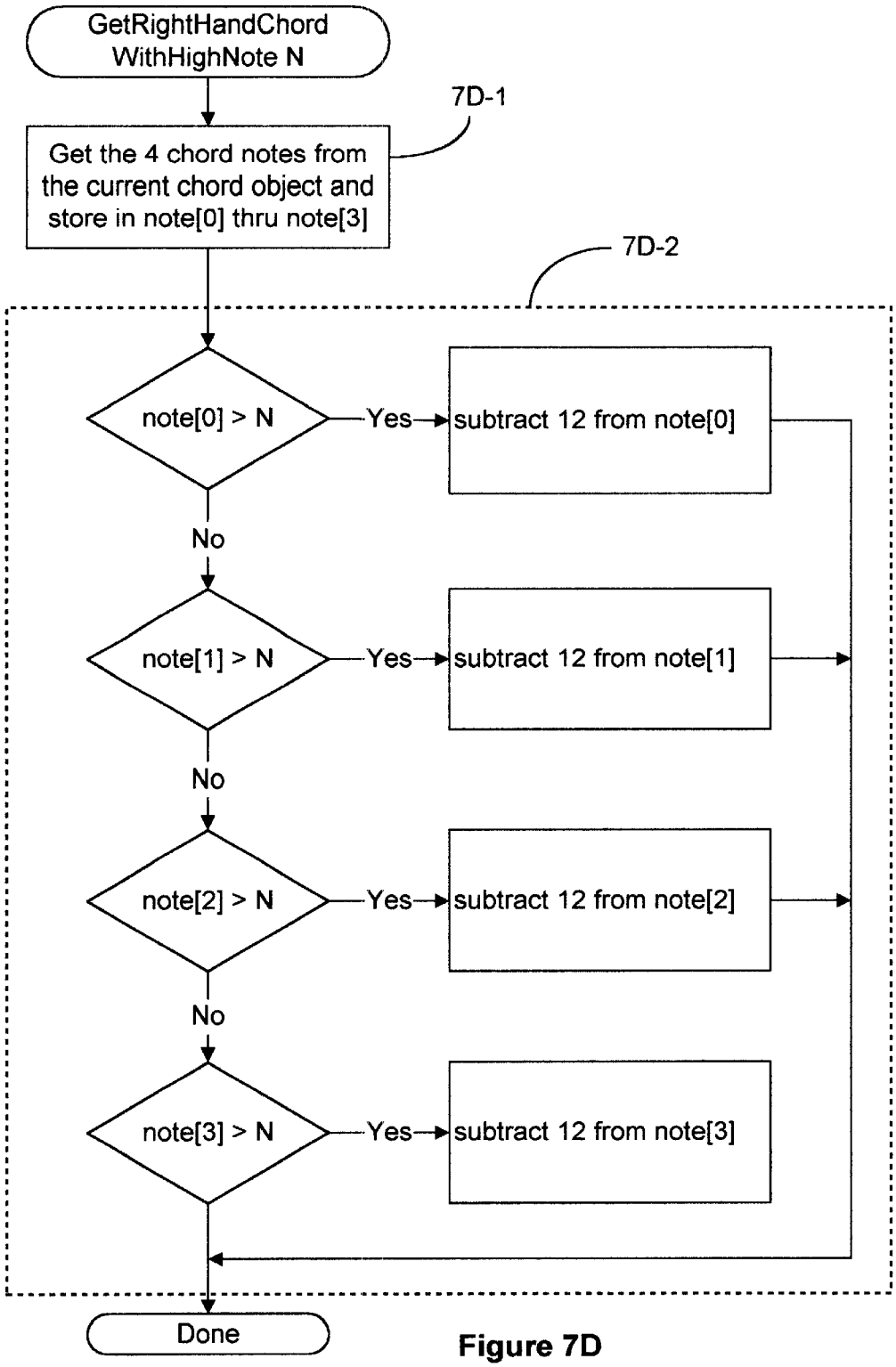

FIG. 7D shows a flow diagram for the service GetRightHandChordWithHighNote( ). This service is called by the white melody keys when the scale note they are to play is a chord note the mode calls for a right hand chord.

It is desirable to play the scale note as the highest note, regardless of whether it is the fundamental, alternate, etc. This service returns the right hand chord with the specified note as the highest. First, the 4 notes of the chord are fetched from the current chord object (7D-1). The flow diagram of FIG. 7D indicated by 7D-2 checks each note of the chord and lowers it one octave (by subtracting 12) if it is higher than the specified note. This will result in a chord that is the current chord with the desired note as the highest.

Services 5, 6, 7 and 8 of table 8 each return a single note as specified by the service name (fundamental, alternate, etc.). These services first perform the same sequence as in FIG. 7A (7A-1 through 7A-5). This puts the current chord in the inversion specified by the attribute inversionType. These services then return a single note and they differ only in the note they return. GetFundamental( ) returns the fundamental (note [0]). GetAlternate( ) returns the alternate (note [1]). Get C1( ) returns the C1 note (note[2]) and GetC2 returns the C2 note (note [3]).

Table 10

A Main Configuration Memory 3-5 contains one or more sets or banks of chord assignments and scale assignments for each chord progression key. It responds to messages from the user interface 3-2 telling it to assign a chord or scale to a particular key. The Memory 3-5 responds to messages from the piano key objects 3-6 requesting the current chord or scale assignment for a particular key, or to switch to a different assignment set or bank. The response to these messages may result in the configuration memory 3-5 sending messages to other objects, thereby changing the present configuration. The configuration object provides memory storage of settings that may be saved and recalled from a named disk file, etc. These settings may also be stored in memory, such as for providing real-time setups in response to user-selectable input. The number of storage banks or settings is arbitrary. A user may have several different configurations saved. It is provided as a convenience to a user. The present invention preferably uses the following configuration:

There are two song keys stored in songKey[2]. There are two chord banks, one for each song key called chordTypeBank1[60] and chordTypeBank2[60]. These may be expanded to include more of each if preferred. Each chord bank hold sixty chords, one for each chord progression key. There are two scale banks, one for each song key, called scaleBank1[60][2] and scaleBank2[60][2]. Each scale bank holds 2 scales (root and type) for each of the sixty chord progression keys. The currentChordFundamental attribute holds the current chord fundamental. The attribute currentChordKeyNum holds the number of the current chord progression key and selects one of sixty chords in the selected chord bank or scales in the selected scale bank. The attribute songKeyBank identifies which one of the two song keys is selected (songKey[songKeyBank]), which chord bank is selected (chordTypeBank1[60] or chordTypeBank2[60]) and which scale bank is selected (scaleBank1[60][2] or scaleBank2[60][2]). The attribute scaleBank[60] identifies which one of the two scales is selected in the selected scale bank (scaleBank 1 or 2[currentChordKeyNum] [scaleBank [currentChordKey Num]]).

The following discussion assumes that songKeyBank is set to 0. The service 'SetSongKeyBank(newSongKeyBank)' sets the current song key bank (songKeyBank=newSongKeyBank). 'SetScaleBank(newScaleBank)' service sets the scale bank for the current chord (scaleBank [currentChordKeyNum]=newScaleBank). 'AssignSongKey (newSongKey)' service sets the current song key (songKey [songKeyBank]=newSongKey).

The service 'AssignChord(newChordType, keyNum)' assigns a new chord (chordTypeBank1[keyNum]=newChordType). The service 'AssignScale(newScaleType, newScaleRoot, keyNum)' assigns a new scale (scaleBank1[keyNum][scaleBank[currentChordKeyNum]]=newScaleType and newScaleRoot).

The service SetCurrentChord(keyNum, chordFundamental)

1. sets currentChordFundamental=chordFundamental;
2. sets currentChordKeyNum=keyNum; and
3. sets the current chord to chordBank1[currentChordKeyNum] and fundamental currentChordFundamental The service SetCurrentScale(keyNum) sets the current scale to the type and root stored at scaleBank1[currentChordKeyNum] [scaleBank [currentChordKeyNum]].

The service 'Save(destinationFileName)' saves the configuration (all attributes) to a disk file. The service 'Recall (sourceFileNaine)' reads all attributes from a disk file.

The chord progression key objects 3-6 (described later) use the SetCurrentChord( ) and SetCurrentScale( ) services to set the current chord and scale as the keys are pressed. The control key objects use the SetSongKeyBank( ) and SetScaleBank( ) services to switch key and scale banks respectively as a user plays. The user interface 3-2 uses the other services to change (assign), save and recall the configuration. The present invention also contemplates assigning a song key to each key by extending the size of songKey[2] to sixty (songKey[60]) and modifying the SetCurrentChord( ) service to set the song key every time it is called. This allows chord progression keys on one octave to play in one song key and the chord progression keys in another octave to play in another song key. The song keys which correspond to the various octaves or sets of inputs can be selected or set by a user either one at a time, or simultaneously in groups.

TABLE 10

| Configuration Objects Attributes and Services |
|---|
| Attributes: |
| 1. songKeyBank |
| 2. scaleBank[60] |
| 3. currentChordKeyNum |
| 4. currentChordFundamental |
| 5. songKey[2] |
| 6. chordTypeBank1[60] |
| 7. chordTypeBank2[60] |
| 8. scaleBank1[60][2] |
| 9. scaleBank2[60][2] |
| Services: |
| 1. SetSongKeyBank(newSongKeyBank); |
| 2. SetScaleBank(newScaleBank); |
| 3. AssignSongKey(newSongKey); |
| 4. AssignChord(newChordType, keyNum); |
| 5. AssignScale(newScaleType, newScaleRoot, keyNum); |
| 6. SetCurrentChord(keyNum, chordFundamental); |
| 7. SetCurrentScale(keyNum); |
| 8. Save(destinationFileName); |
| 9. Recall(sourceFileName); |

Figure 8:
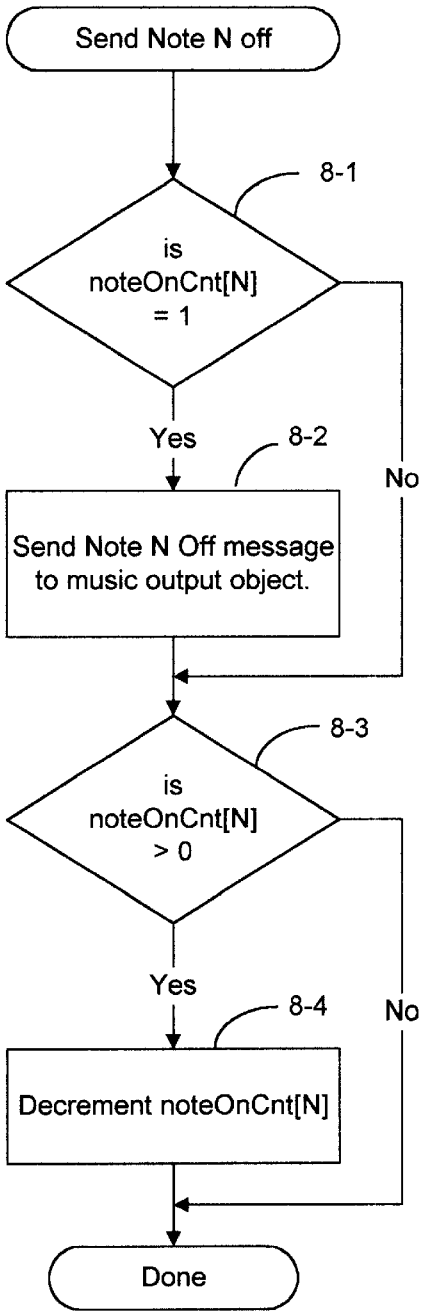
FIG. 8 is a logic flow diagram of channel output objects 'Send note off' service.

FIGS. 8 and 9 and Table 11

Each Output Channel object 3-11 (FIG. 3) keeps track of which notes are on or off for an output channel and resolves turning notes on or off when more than one key may be setting the same note(s) on or off. Table 11 shows the Output Channel objects attributes and services. The attributes include (1) the channel number and (2) a count of the number of times each note has been sent on. At start up, all notes are assumed to be off. Service (1) sets the output channel number. This is usually done just once as part of the initialization. In the description that follows, n refers to the note number to be sent on or off.

Figure 9A:
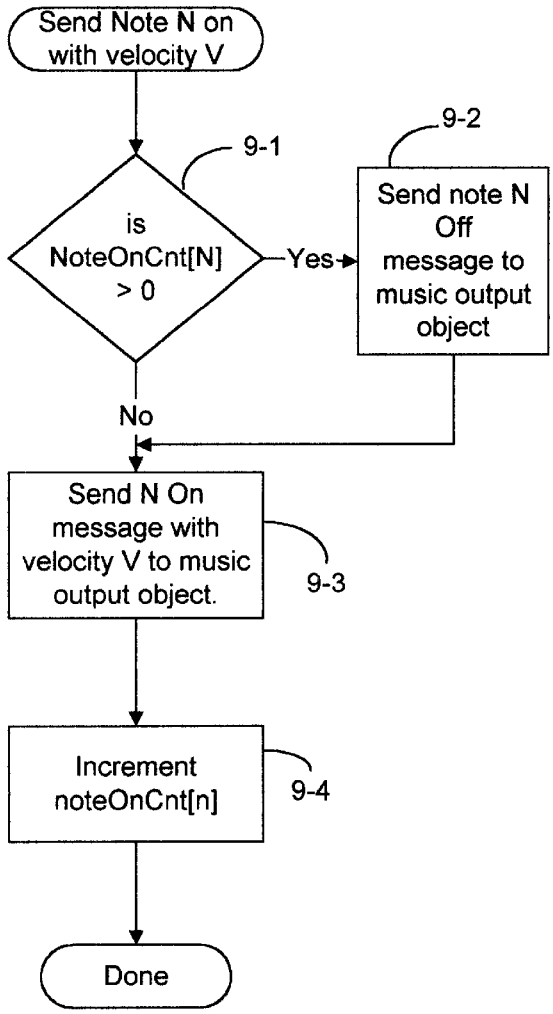
FIG. 9A is a logic flow diagram of channel output objects 'Send note on' service.

FIG. 9*a* shows a flow diagram for service 2, which sends a note on message to the music output object 3-12. The note to be sent (turned on) is first checked if it is already on in step 9-1, indicated by noteOnCnt[n]>0. If on, then the note will first be sent (turned) off in step 9-2 followed immediately by sending it on in step 9-3. The last action increments the count of the number of times the note has been sent on in step 9-4.

Figure 9B:
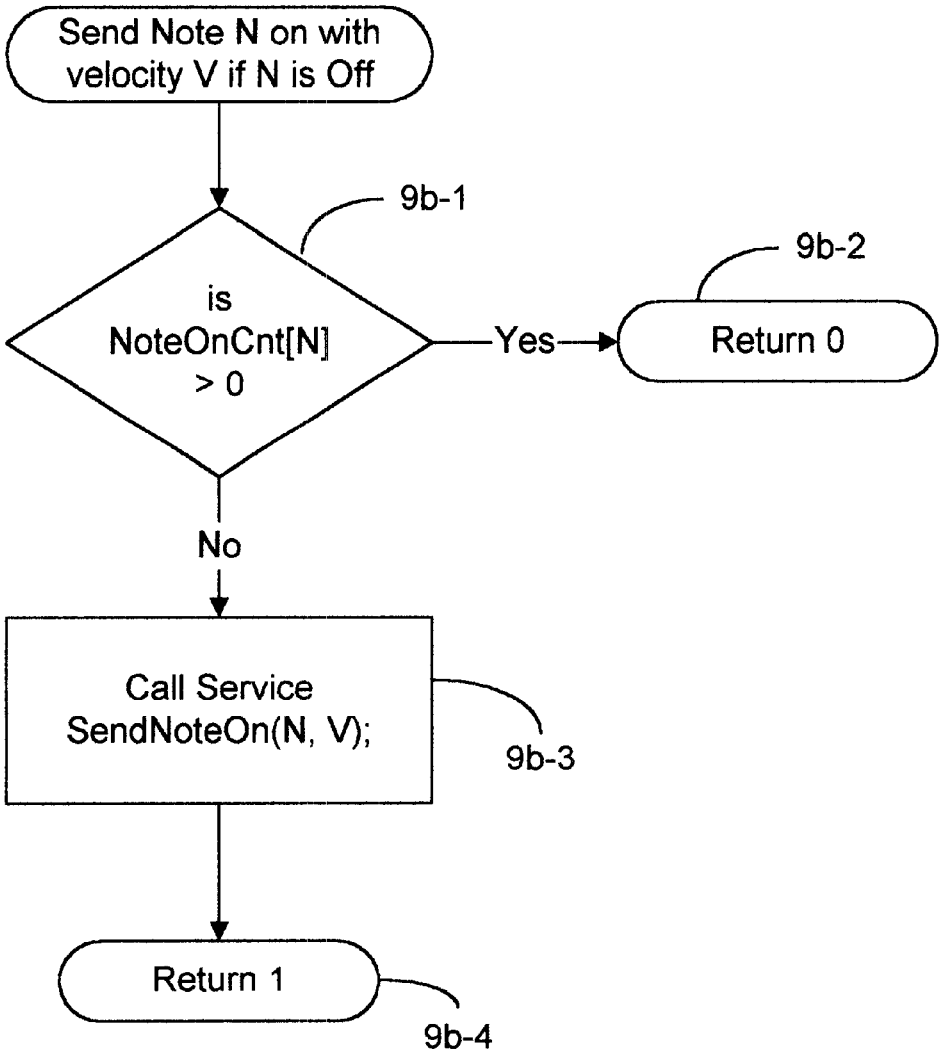
FIG. 9B is a logic flow diagram of channel output objects 'Send note on if off' service.

FIG. 9*b* shows a flow diagram for service 3 which sends a note on message only if that note is off. This service is provided for the situation where keys want to send a note on if it is off but do not want to re-send the note if already on. This service first checks if the note is on in step 9*b*-1 and if it is, returns 0 in step 9*b*-2 indicating the note was not sent. If the note is not on, then the Send note on service is called in step 9*b*-3 and a 1 is returned by step 9*b*-4, indicating that the note was sent on and that the calling object must therefore eventually call the Send Note Off service.

FIG. 8 shows the flow diagram for the sendNoteOff service. This service first checks if the noteOnCnt[n] is equal to one in step 8-1. If it is, then the only remaining object to send the note on is the one sending it off, then a note off message is sent by step 8-2 to the music output object 3-12. Next, if the noteOnCnt[n] is greater than 0, it is decremented.

All objects which call the SendNoteOn service are required (by contract so to speak) to eventually call the SendNoteOff service. Thus, if two or more objects call the SendNoteOn service for the same note before any of them call the SendNoteOff service for that note, then the note will be sent on (sounded) or re-sent on (re-sounded) every time the SendNoteOn service is called, but will not be sent off until the SendNoteOff service is called by the last remaining object that called the SendNoteOn service.

The remaining service in Table 11 is SendProgramChange. The present invention sends notes on/off and program changes, etc., using the MIDI interface. The nature of the message content preferably conforms to the MIDI specification, although other interfaces may just as easily be employed. The Output Channel object 3-11 isolates the rest of the software from the 'message content' of turning notes on or off, or other control messages such as program change. The Output Channel object 3-11 takes care of converting the high level functionality of playing (sending) notes, etc. to the lower level bytes required to achieve the desired result.

TABLE 11

| Output Channel Objects Attributes and Services |
|---|
| Attributes: |
| 1. channelNumber |
| 2. noteOnCnt[128] |
| Services: |
| 1. SetChannelNumber(channelNumber); |
| 2. SendNoteOn(noteNumber, velocity); |
| 3. SendNoteOnIfOff(noteNumber, velocity); noteSentFlag |
| 4. SendNoteOff(noteNumber); |
| 5. SendProgramChange(PgmChangeNum); |

Figure 10A:
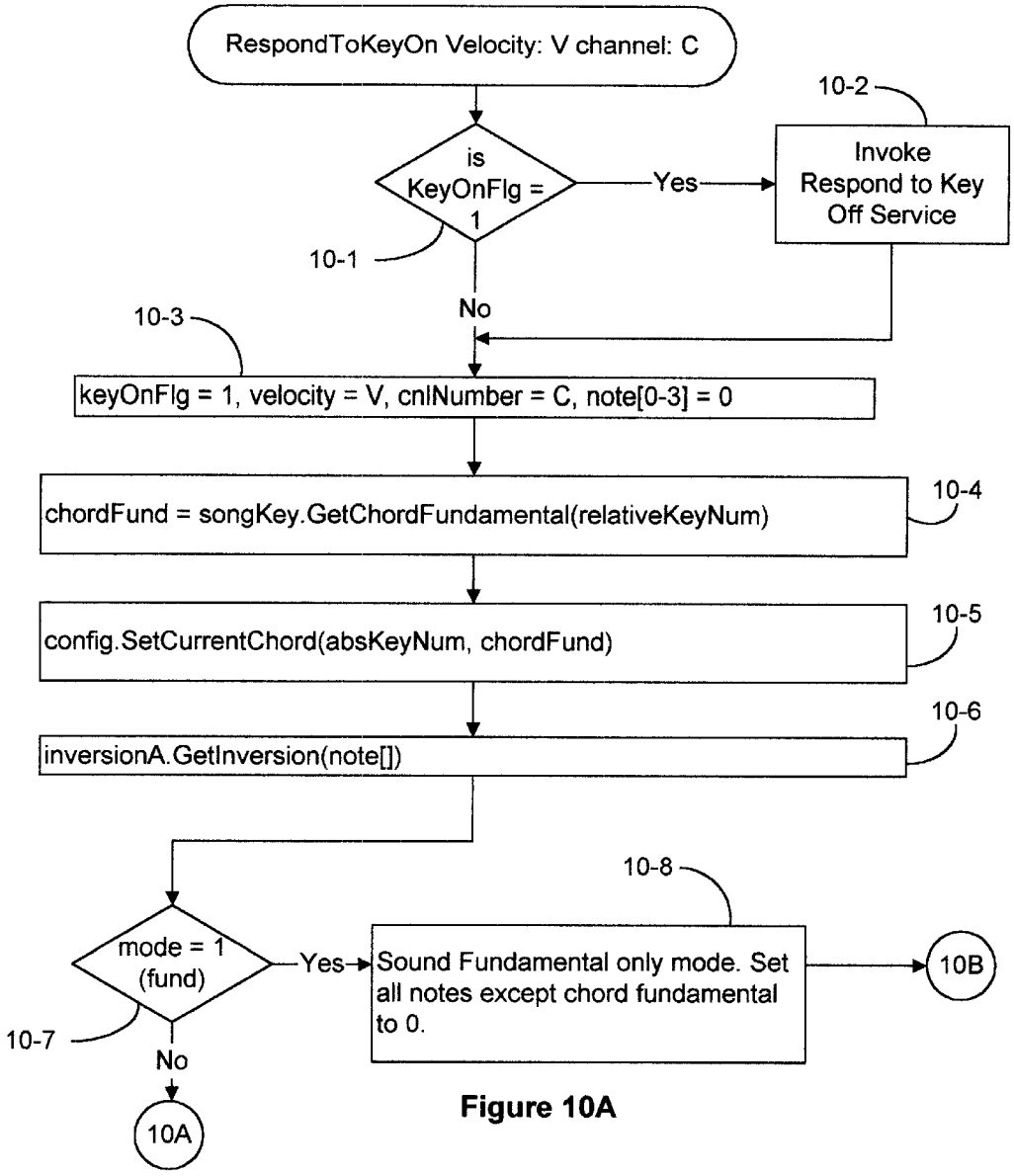
FIGS. 10A and 10B together are a logic flow diagram of PianoKey::Chord Progression Key objects 'Respond to key on' service.
Figure 10B:
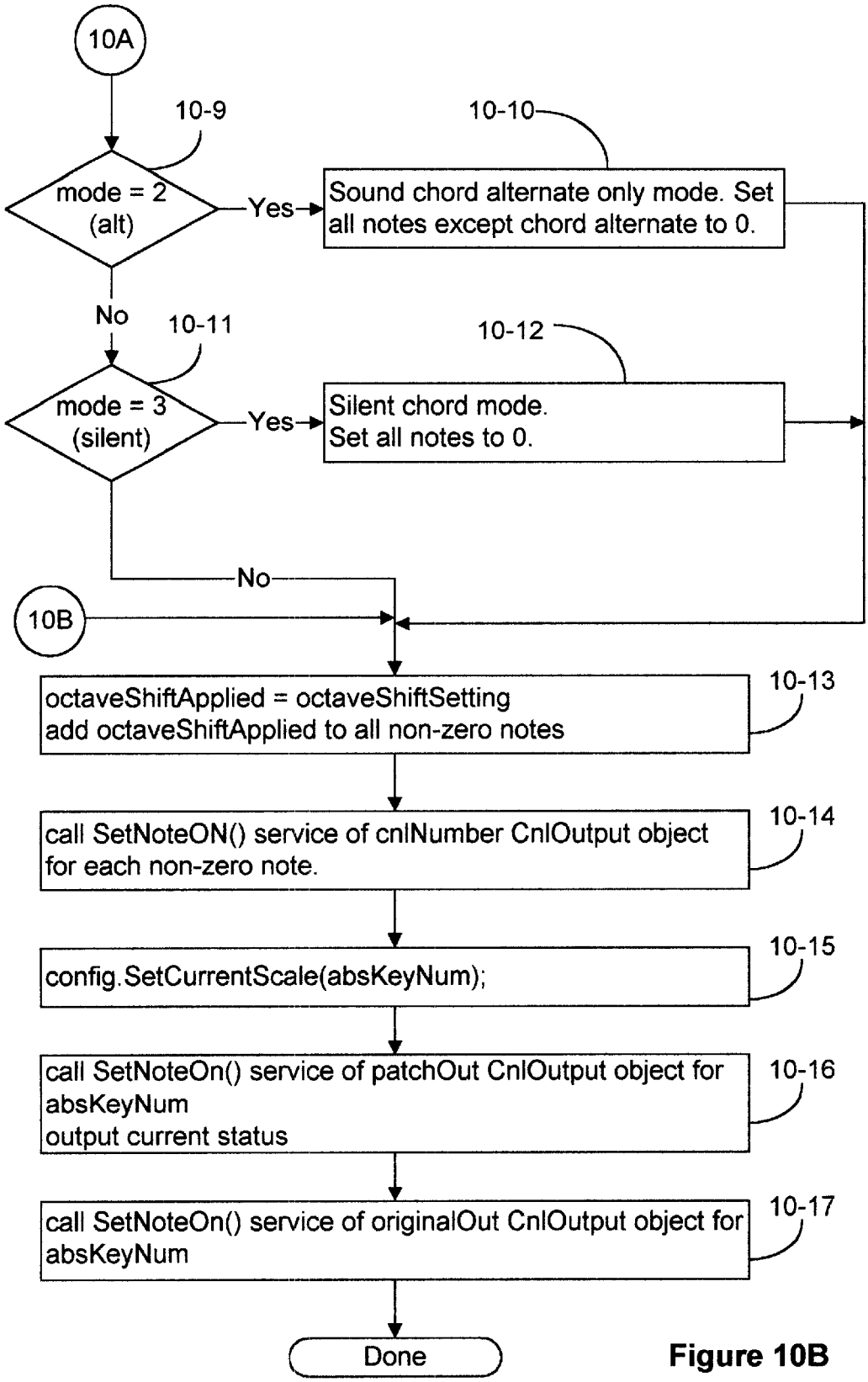
Figure 11:
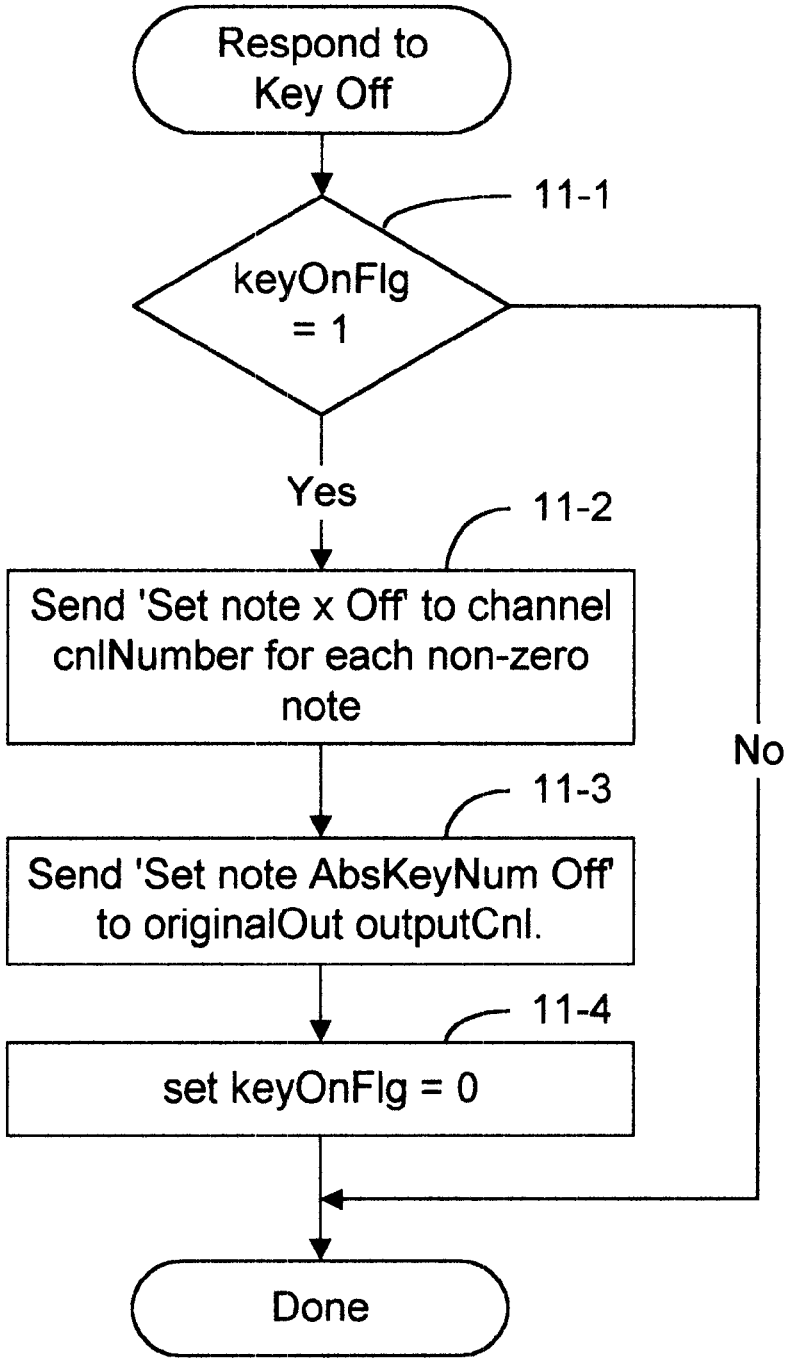
FIG. 11 is a logic flow diagram of PianoKey::Chord Progression Key objects 'Respond to key off' service.

FIGS. 10*a*, 10*b* and 11 and Table 12

There are four kinds of PianoKey objects 3-6: (1) ChordProgressionKey, (2) WhiteMelodyKey, (3) BlackMelodyKey, and (4) ControlKey. These objects are responsible for responding to and handling the playing of musical (piano) key inputs. These types specialize in handling the main types of key inputs which include the chord progression keys, the white melody keys, and control keys (certain black chord progression keys). There are two sets of 128 PianoKey objects for each input channel. One set, referred to as chordKeys is for those keys designated (by user preference) as chord progression keys and the other set, referred to as melodyKeys are for those keys not designated as chord keys. The melodyKeys with relative key numbers (FIG. 2) of 0, 2, 4, 5, 7, 9 and 11 will always be the WhiteMelodyKey type while melodyKeys with relative key numbers of 1, 3, 6, 8 and 10 will always be the BlackMelodyKey type.

The first three types of keys usually result in one or more notes being played and sent out to one or more output channels. The control keys are special keys that usually result in configuration or mode changes as will be described later. The PianoKey objects receive piano key inputs from the music administrator object 3-3 and configuration input from the user interface object 3-2. They collaborate with the song key object 3-8, the current chord object 3-7, the current scale object 3-9, the chord inversion objects 3-10 and the configuration object 3-5, in preparing their response, which is sent to one or more of the many instances of the CnlOutput objects 3-11.

The output of the ControlKey objects may be sent to many other objects, setting their configuration or mode.

The ChordProgressionKey type of PianoKey 3-6 is responsible for handling the piano key inputs that are designated as chord progression keys (the instantiation is the designation of key type, making designation easy and flexible).

Table 12 shows the ChordProgressionKeys attributes and services. The attribute mode, a class attribute that is common to all instances of the ChordProgressionKey objects, stores the present mode of operation. With minor modification, a separate attribute mode may be used to store the present mode of operation of each individual key input, allowing all of the individual notes of a chord to be played independently and simultaneously when establishing a chord progression. The mode may be normal (0), Fundamental only (1), Alternate only (2) or silent chord (3), or expanded further. The class attribute correctionMode controls how the service CorrectKey behaves and may be set to either Normal=0 or SoloChord=1, SoloScale=2, or SoloCombined=3. The class attribute octaveShiftSetting is set to the number of octaves to shift the output. Positive values shift up, negative shift down. The absKeyNum is used for outputting patch triggers to patchOut instance of output object. The relativeKeyNurn is used to determine the chord to play. The cnlNumber attribute stores the destination channel for the next key off response. The keyOnFlag indicates if the object has responded to a key on since the last key off. The velocity attribute holds the velocity with which the key was pressed. The chordNote[4] attributes holds the (up to) four notes of the chord last output. The attribute octaveShiftApplied is set to octaveShiftSetting when notes are turned on for use when correcting notes (this allows the octaveShiftSetting to change while a note is on).

TABLE 12

| PianoKey::ChordProgressionKey Attributes and Services |
|---|
| Class Attributes: |
| 1. mode |
| 2. correctionMode |
| 3. octaveShiftSetting |
| Instance Attributes: |
| 1. absoluteKeyNumber |
| 2. relativeKeyNumber |
| 3. cnlNumber |
| 4. keyOnFlag |
| 5. velocity |
| 6. chordNote[4] |
| 7. octaveShiftApplied |
| Services: |
| 1. RespondToKeyOn(sourceChannel, velocity); |
| 2. RespondToKeyOff(sourceChannel); |
| 3. RespondToProgramChange(sourceChannel); |
| 4. SetMode(newMode); |
| 5. CorrectKey( ); |
| 6. SetCorrectionMode(newCorrectionMode); |
| 7. SetOctaveShift(numberOctaves); |

FIGS. 10*a* and 10*b* depict a flow diagram for the service 'RespondToKeyon( )', which is called in response to a chord progression key being pressed. If the KeyOnFIg is 1 in step 10-1, indicating that the key is already pressed, then the service 'RespondToKeyOff( )' is called by step 10-2. Then, some of the attributes are initialized in step 10-3.

Then, the chord fundamental for the relative key number is fetched from the song key object in step 10-4. The main configuration memory 3-5 is then requested to set the current chord object 3-7 based on the presently assigned chord for the absKeyNum attribute in step 10-5. The notes of the current chord are then fetched in step 10-6 from the chord inversion object A 3-10 (which gets the notes from the current chord object 3-7.

If mode attribute=1 (10-7) then all notes of the chord except the fundamental are discarded (set to 0) in step 10-8. If the mode attribute=2 in step 10-9, then all notes of the chord except the alternate are discarded by step 10-10. If the mode attribute=3 in step 10-11, then all notes are discarded in step 10-12. The Octave shift setting (octaveShiftSetting) is stored in octaveShiftApplied and then added to each note to turn on in step 10-13. All notes that are non zero are then output to channel cnlNumber in step 10-14. The main configuration object 3-5 is then requested to set the current scale object 3-9 per current assignment for absoluteKey-Number attribute 10-15. A patch trigger=to the absKeyNum is sent to patchOut channel in step 10-16. In addition, the current status is also sent out on patchOut channel (see table 17 for description of current status). When these patch triggers/current status are recorded and played back into the music software, it will result in the RespondToProgramChange( ) service being called for each patch trigger received. By sending out the current key, chord and scale for each key pressed, it will assure that the music software will be properly configured when another voice is added to the previously recorded material. The absKeyNum attribute is output to originalOut channel (10-17).

FIG. 11 shows a flow diagram for the service 'RespondToKeyOff( )'. This service is called in response to a chord progression key being released. If the key has already been released in step 11-1, indicated by keyOnFlg=0, then the service does nothing. Otherwise, it sends note off messages to channel cnlNumber for each non-zero note, if any, in step 11-2. It then sends a note off message to originalOut channel for AbsKeyNum in step 11-3. Finally it sets the keyOnFlg to 0 in step 11-4.

The service 'RespondToProgramChange( )' is called in response to a program change (patch trigger) being received. The service responds in exactly the same way as the 'RespondToKeyOn( )' service except that no notes are output to any object. It initializes the current chord object and the current scale object. The 'SetMode( )' service sets the mode attribute. The 'setCorrectionMode( )' service sets the correctionMode attribute.

The service CorrectKey( ) is called in response to a change in the song key, current chord or scale while the key is on (keyOnFlg=1). This enables the key to correct the notes it has sent out for the new chord or scale. There are two different correction modes (see description for correction-Mode attribute above). In the normal correction mode (correctionMode=0), this service behaves exactly as RespondToKeynOn( ) with one exception. If a new note to be turned on is already on, it will remain on. It therefore does not execute the same identical initialization sequence (FIG. 10*a*) in this mode. It first determines the notes to play (as per RespondToKeyoOn( ) service) and then turns off only those notes that are not already on and then turns on any new notes. The solo correction mode (correctionMode=1) takes this a step further. It turns off only those notes that are not in the new current chord (correctionMode=1), scale (correctionMode=2) or combined chord and scale (correctionMode=3). If a note that is already on exists anywhere in the current chord, scale or combined chord and scale it will remain on. The current chord objects service isNoteinChord( ) and the current scale objects services isNoteInScale and isNoteInCombinedScale( ) are used to determine if each note already on should be left on or turned off. The output channel for the original key is determined as for the white melody key as described below).

FIGS. 12*a* through 12*k* and Table 13

The WhiteMelodyKey object is responsible for handling all white melody key events. This involves, depending on mode, getting notes from the current scale object and/or chord inversion object and sending these notes out.

The class attributes for this object include mode, which may be set to one of Normal=0, RightHandChords=1, Scale3rds=2, RHCand3rds=3, RemainScale=4 or RemainNonScale=5. The class attributes numBlkNotes hold the number of block notes to play if mode is set to 4 or 5. The attribute correctionMode controls how the service Cor-rectKey behaves and may be set to either Normal=0 or SoloChord=1, SoloScale=2, or SoloCombined=3. The class attribute octaveShiftSetting is set to the number of octaves to shift the output. Positive values shift up, negative shift down. Instance variables include absoluteKeyNumber and colorKeyNumber and octave (see FIG. 2). The attribute cnlNumber holds the output channel number the notes were sent out to keyOnFlag indicates whether the Key is pressed or not. Velocity holds the velocity of the received 'Note On' and note[4] holds the notes that were sounded (if any). The attribute octaveShiftApplied is set per octaveShiftSetting and octave attributes when notes are turned on for use when correcting notes.

TABLE 13

| PianoKey::WhiteMelodyKey Attributes and Services |
|---|
| Class Attributes: |
| 1. mode |
| 2. numBlkNotes |
| 3. CorrectionMode |
| 4. octaveShiftSetting |
| Instance Attributes: |
| 1. absoluteKeyNumher |
| 2. colorKeyNumber |
| 3. octave |
| 4. cnlNumher |
| 5. keyOnFlag |
| 6. velocity |
| 7. note[4] |
| 8. octaveShiftApplied |
| Services: |
| 1. ResondToKeyOn(sourceChannel, velocity); |
| 2. RespondToKeyOff(sourceChannel); |
| 3. CorrectKey( ); |
| 4. SetMode(newMode); |
| 5. SetCorrectionMode(newCorrectionMode); |
| 6. SetNumBlkNotes(newNumBlkNotes); |
| 7. SetOctaveShift(numberOctaves); |

FIGS. 12*a* through 12*j* provide a flow diagram of the service 'RespondToKeyOn( )'. This service is called in response to a white melody key being pressed. It is responsible for generating the note(s) to be sounded. It is entered with the velocity of the key press and the channel the key was received on.

The RespondToKeyOn( ) service starts by initializing itself in step 12*a*-1. This initialization will be described in more detail below. It then branches to a specific sequence that is dependent on the mode, as shown in flow diagram 12*a*-2. These specific sequences actually generate the notes and will be described in more detail below. It finishes by outputting the generated notes in step 12*a*-3.

Figure 12A:
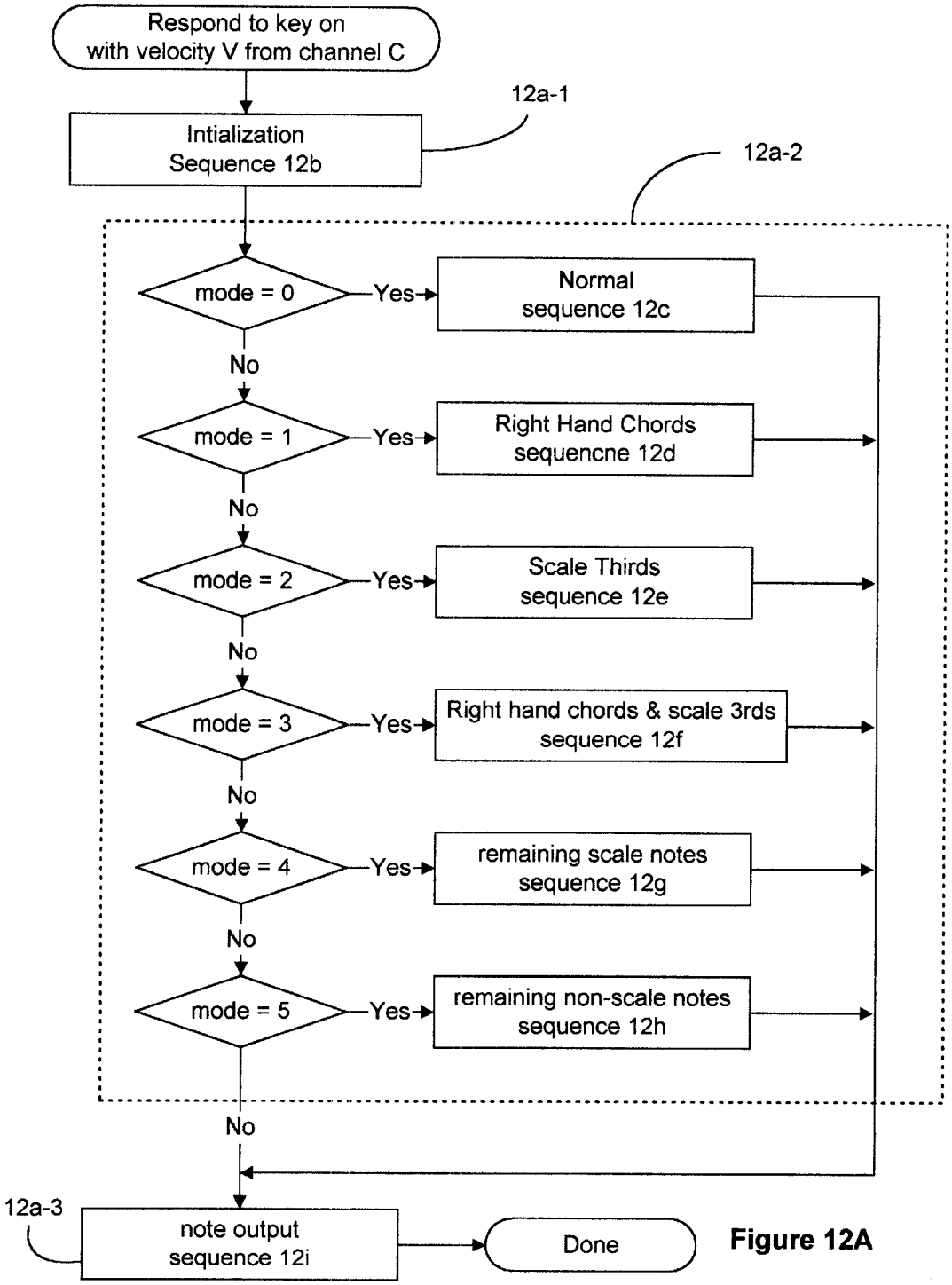
FIGS. 12A, through 12J together are a logic flow diagram of PianoKey::Melody Key objects 'Respond to key on' service.
Figure 12B:
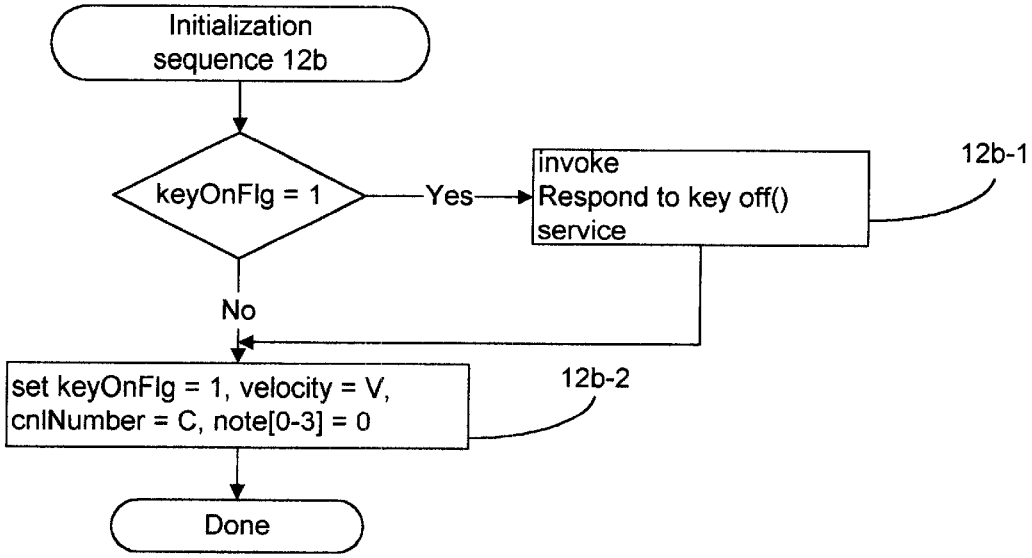
FIG. 12K is a logic flow diagram of PianoKey::Melody Key objects 'Respond to key off' service.

The initialization sequence, shown in FIG. 12*b*, first checks if the key is already pressed. If it is (keyOnFlg=1), the service 'RespondToKeyOff( )' service will be called in step 12*b*-1. Then, keyOnFlg is set to 1, indicating the key is pressed, the velocity and cnlNumber attributes are set and the notes are cleared by being set to 0 in step 12*b*-2.

Figure 12I:
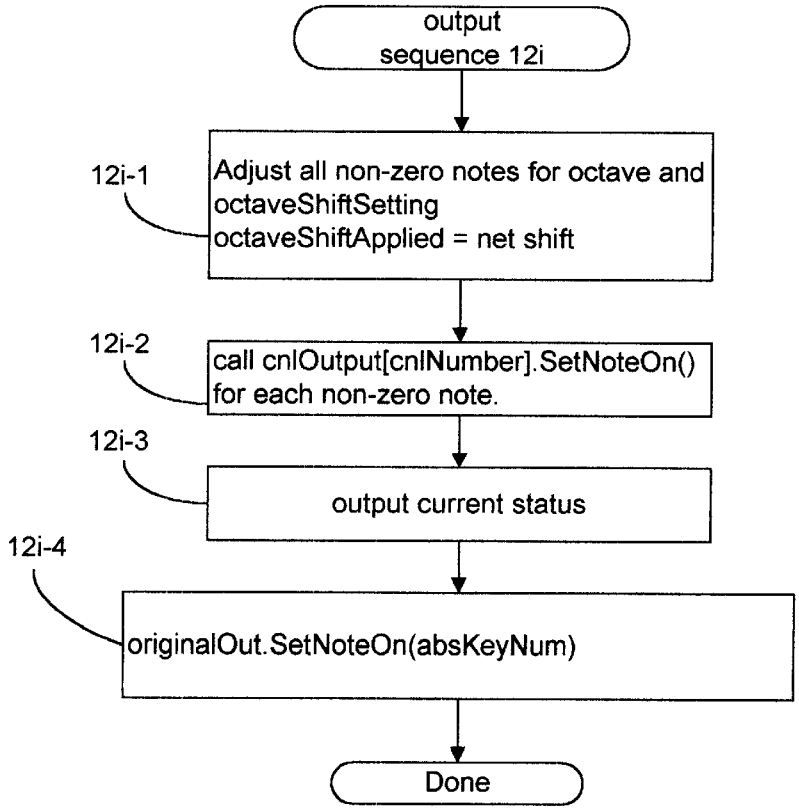
Figure 12D:
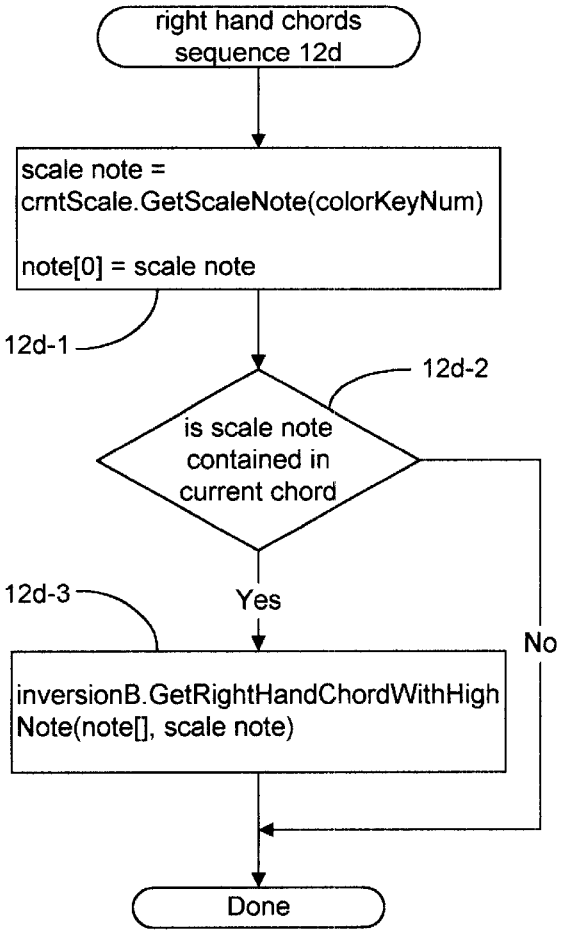
Figure 12C:
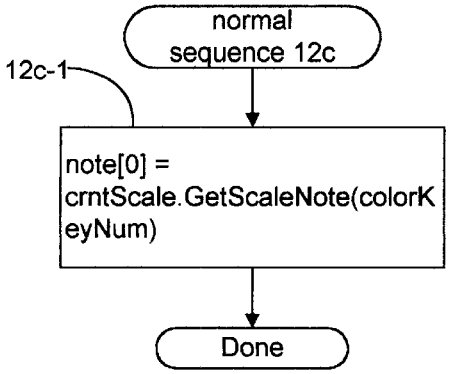

FIG. 12*c* depicts a flow diagram of the normal (mode=0) sequence. This plays a single note (note[0]) that is fetched from the current scale object based on the particular white key pressed (colorKeyNum).

FIG. 12*d* gives a flow diagram of the right hand chord (mode=1) sequence. This sequence first fetches the single normal note as in normal mode in step 12*d*-1. It then checks if this note (note[0]) is contained in the current chord in step 12*d*-2. If it is not, then the sequence is done. If it is, then the right hand chord is fetched from chord inversion B object with the scale note (note[)]) as the highest note in step 12*d*-3.

Figure 12E:
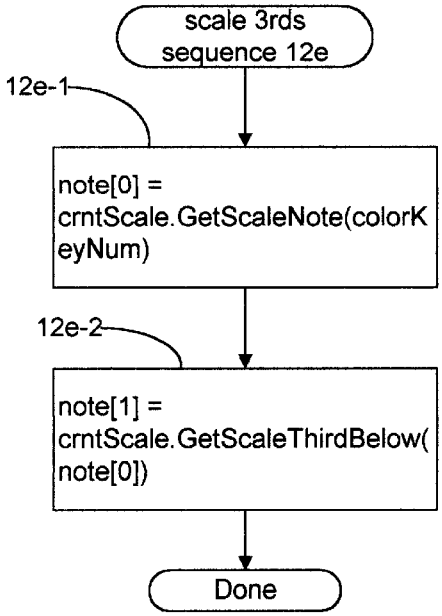

FIG. 12*e* gives a flow diagram of the scale thirds (mode 2) sequence. This sequence sets note[0] to the normal scale note as in normal mode (12*e*-1). It then sets note[1] to be the scale note one third below note[0] by calling the service 'GetScaleThird(colorKeyNum)' of the current scale object.

Figure 12F:
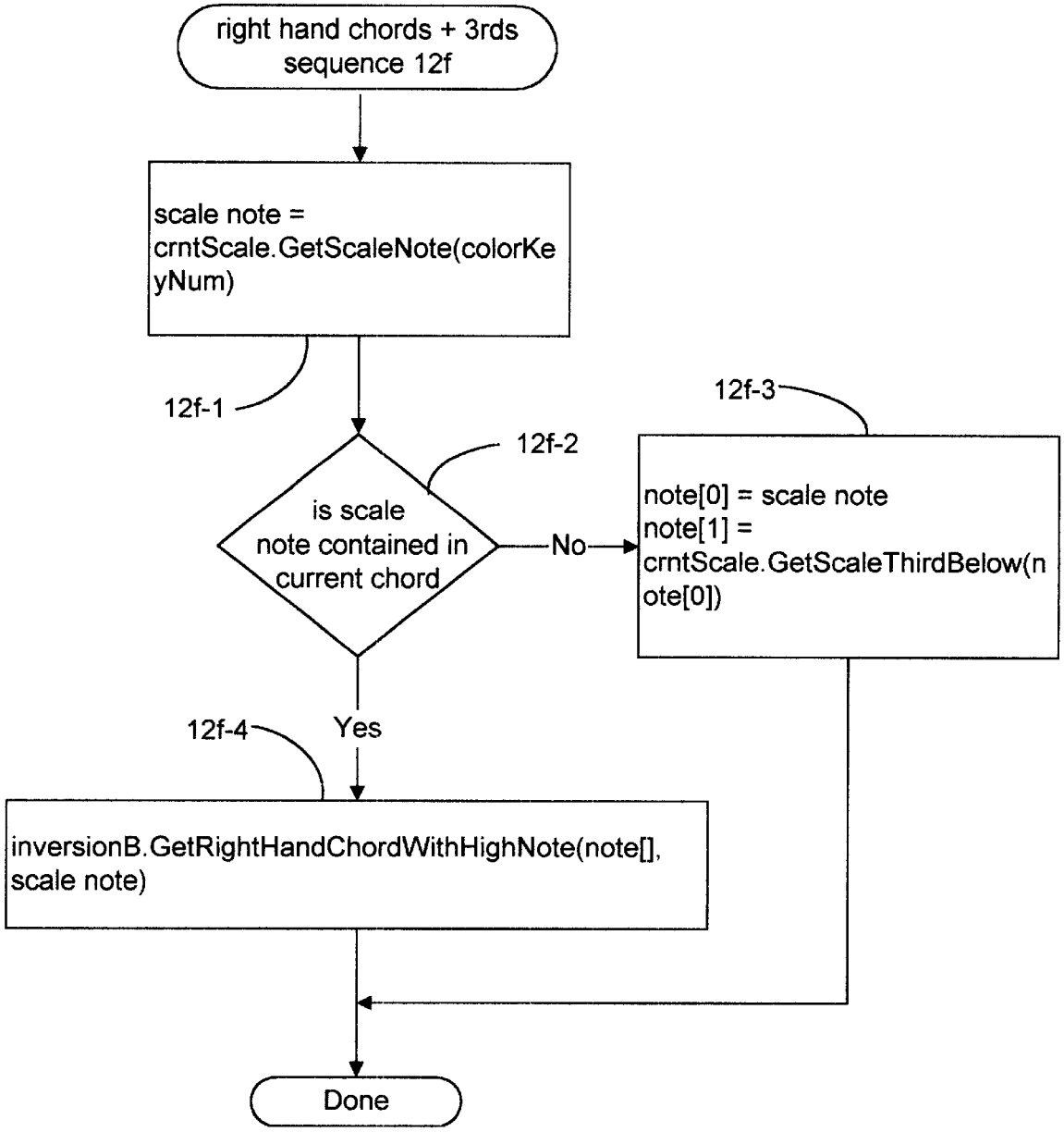

FIG. 12*f* gives a flow diagram of the right hand chords plus scale thirds (mode =3) sequence. This sequence plays a right hand chord exactly as for mode=1 if the normal scale note is in the current chord (12*f*-1, 12*f*-2, and 12*f*-4 are identical to 12*d*-1, 12*d*-2, and 12*d*-3 respectively). It differs in that if the scale note is not in the current chord, a scale third is played as mode 2 in step 12*f*-3.

Figure 12G:
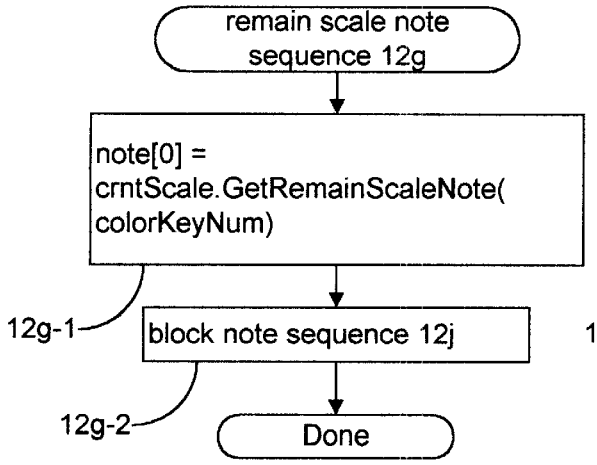

FIG. 12*g* depicts a flow diagram of the remaining scale note (mode=4) sequence. This sequence plays scale notes that are remaining after current chord notes are removed. It sets note[0] to the remaining scale note by calling the service 'GetRemainScaleNote(colorKeyNumber)' of the current scale object instep 12*g*-1. It then adds chord (block) notes based on the numBlkNotes attributes in step 12*g*-2. FIG. 12*j* shows a flow diagram for getting block notes.

Figure 12H:
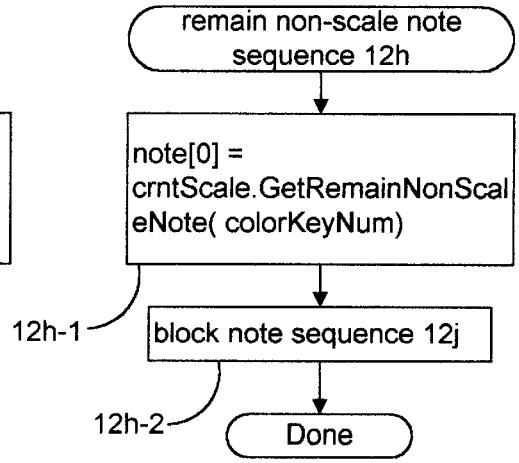
Figure 12J:
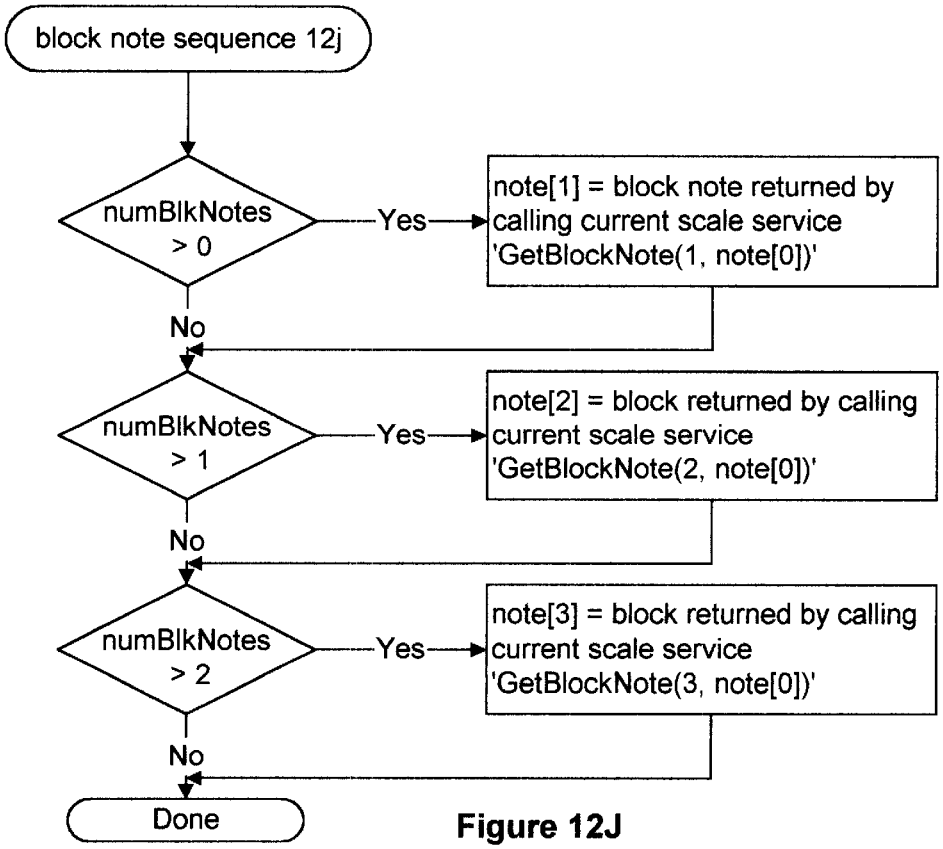

FIG. 12*h* gives a flow diagram of the remaining non-scale notes (mode=5) sequence. This sequence plays notes that are remaining after scale and chord notes are removed. It sets note[0] to the remaining non scale note by calling the service 'GetRemainNonScaleNote(colorKeyNumber)' of the current scale object in step 12*h*-1. It then adds chord (block) notes based on the numBlkNotes attributes in step 12*h*-2.

FIG. 12*j* shows a flow diagram for getting block notes.

FIG. 12*i* shows a flow diagram of the output sequence. This sequence includes adjusting each note for the octave of the key pressed and the shiftOctaveSetting attribute in step 12*i*-1. The net shift is stored in shiftOctaveApplied. Next, each non-zero note is output to the cnlNumber instance of the CnlOutput object in step 12*i*-2. The current status is also sent out to patchOut channel in step 12*i*-3 (see Table 17). Last, the original note (key) is output to the originalOut channel in step 12*i*-4.

Figure 12K:
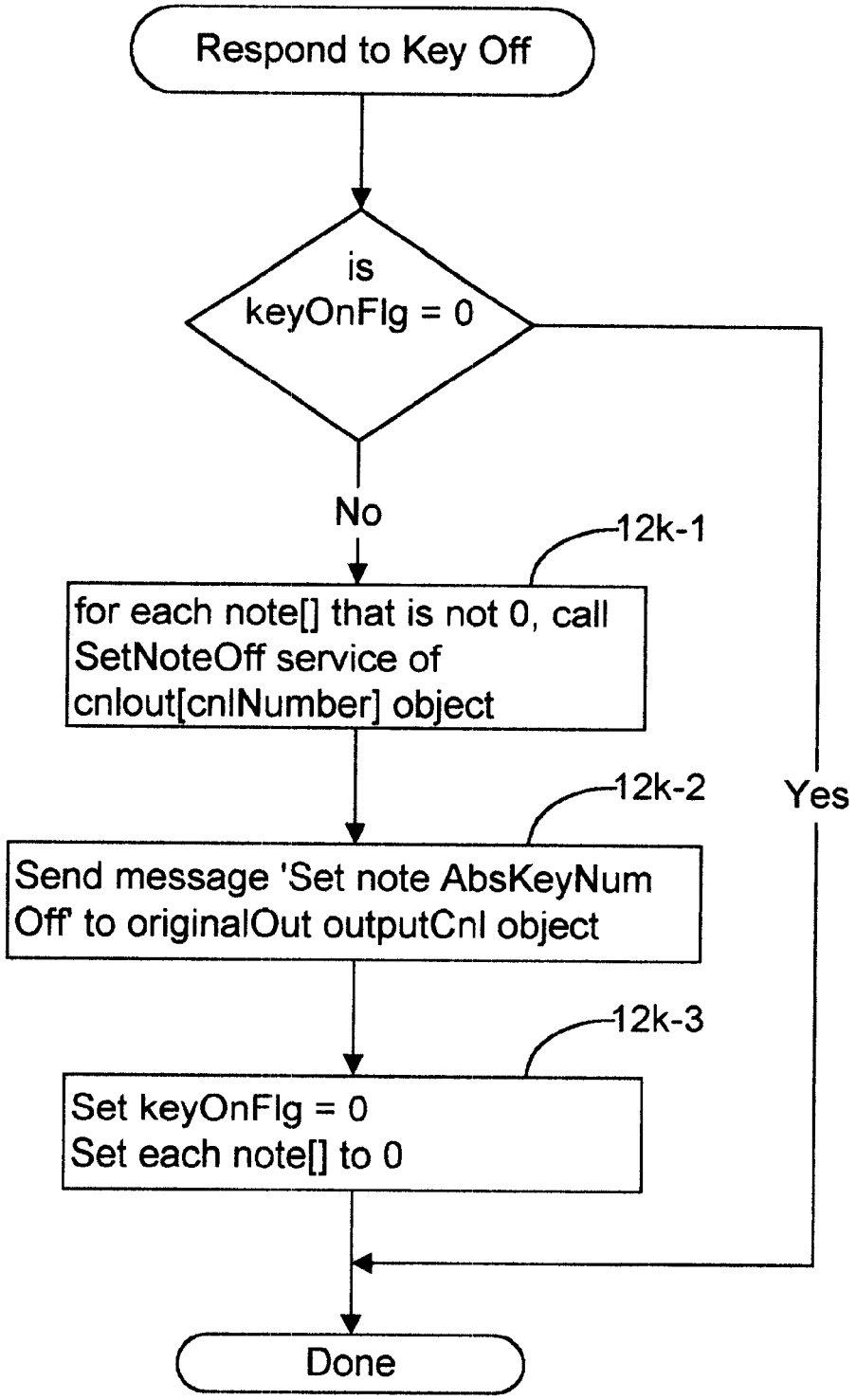

FIG. 12*k* provides a flow diagram for the service 'RespondToKeyOff( )'. This service is called in response to a key being released. If the key has already been released (keyOnFlg=0) then this service does nothing. If the key has been pressed (keyOnFlg=1) then a note off is sent to channel cnlNumber for each non-zero note in step 12*k*-1. A note off message is sent for absoluteKeyNumber to originalOut output channel in step 12*k*-2. Then the keyOnFlg is cleared and the notes are cleared in step 12*k*-3.

The service CorrectKey( ) is called in response to a change in the current chord or scale while the key is on (keyOnFlg=1). This enables the key to correct the notes it has sent out for the new chord or scale. There are four different correction modes (see description for correctionMode attribute above). In the normal correction mode (correctionMode=0), this service behaves exactly as RespondToKeyOn( ) with one exception. If a new note to be turned on is already on, it will remain on. It therefore does not execute the same identical initialization sequence (FIG. 12*b*) in this mode. It first determines the notes to play (as per RespondToKeyOn( ) service) and then turns off only those notes that are not already on and then turns on any new notes. The solo correction modes (correctionMode=1, 2, or 3) takes this a step further. It turns off only those notes that are not in the new current chord (correctionMode=1), scale (correctionMode=2) or combined chord and scale (correctionMode=3). If a note that is already on exists anywhere in the current chord, scale or combined chord and scale it will remain on. The current chord objects service is NoteInChord( ) and the current scale objects services isNoteInScale and is NoteInCombinedScale( ) are used to determine if each note already on should be left on or turned off.

When in solo mode (correctionMode=1, 2, or 3), the original key (absKeyNum) that will be output to a unique channel, as shown in step 12*i*-4 of FIG. 12*i*. The output channel is determined by adding the correction mode multiplied by 9 to the channel determined in 12*i*-4. For example, if correctionMode is 2 then 18 is added to the channel number determined in step 12*i*-4. This allows the software to determine the correction mode when the original performance is played back.

Step 12*b*-2 of FIG. 12*b* decodes the correctionMode and channel number. The original key channels are local to the software and are not MIDI channels, as MIDI is limited to 16 channels.

The services SetMode( ), SetCorrectionMode( ) and SetNumBlkNotes( ) set the mode, correctionMode and numBlkNotes attributes respectively using simple assignment (example: mode=newMode).

FIG. 13 and Table 14

The BlackMelodyKey object is responsible for handling all black melody key events. This involves, depending on mode, getting notes from the current scale object and/or chord inversion object and sending the notes out.

The class attributes for this object include mode, which may be set to one of Normal=0, RightHandChords=1 or Scale3rds=2. The attribute correctionMode controls how the service CorrectKey behaves and may be set to either Normal=0 or SoloChord=1, SoloScale=2, or SoloCombined=3. The class attribute octaveShiftSetting is set to the number of octaves to shift the output. Positive values shift up, negative shift down. Instance variables include absoluteKeyNum and colorKeyNum and octave (see FIG. 2). The attribute destChannel holds the destination channel for the key on event. keyOnFlag indicates whether the Key in pressed or not. Velocity holds the velocity the key was pressed with and note[4] holds the notes that were sounded (if any).

TABLE 14

| PianoKey::BlackMelodyKey Attributes and Services |
|---|
| Class Attributes: |
| 1. mode |
| 2. correctionMode |
| 3. octaveShiftSetting |
| Instance Attributes: |
| 1. absoluteKeyNum |
| 2. colorKeyNum |
| 3. octave |
| 4. destChannel |
| 5. keyOnFlag |
| 6. velocity |
| 7. note[4] |
| 8. octaveShiftApplied |
| Services: |
| 1. ResondToKeyOn(sourceChannel, velocity); |
| 2. RespondToKeyOff(sourceChannel); |
| 3. CorrectKey( ); |
| 4. SetMode(newMode); |
| 5. SetCorrectionMode(newCorrectionMode); |
| 6. SetOctaveShift(numberOctaves); |

FIGS. 13*a* through 13*f* shows a flow diagram for the RespondToKeyOn( ) service. This service is called in response to the black melody key being pressed. It is responsible for generating the note(s) to be sounded. It is entered with the velocity of the key press and the channel the key was received on. It starts by initializing itself in step 13*a*-1, as described below. Next, it branches to a specific sequence that is dependent on the mode in step 13*a*-2. These specific sequences generate the notes. It finishes by outputting the generated notes in step 13*a*-3.

Figure 13A:
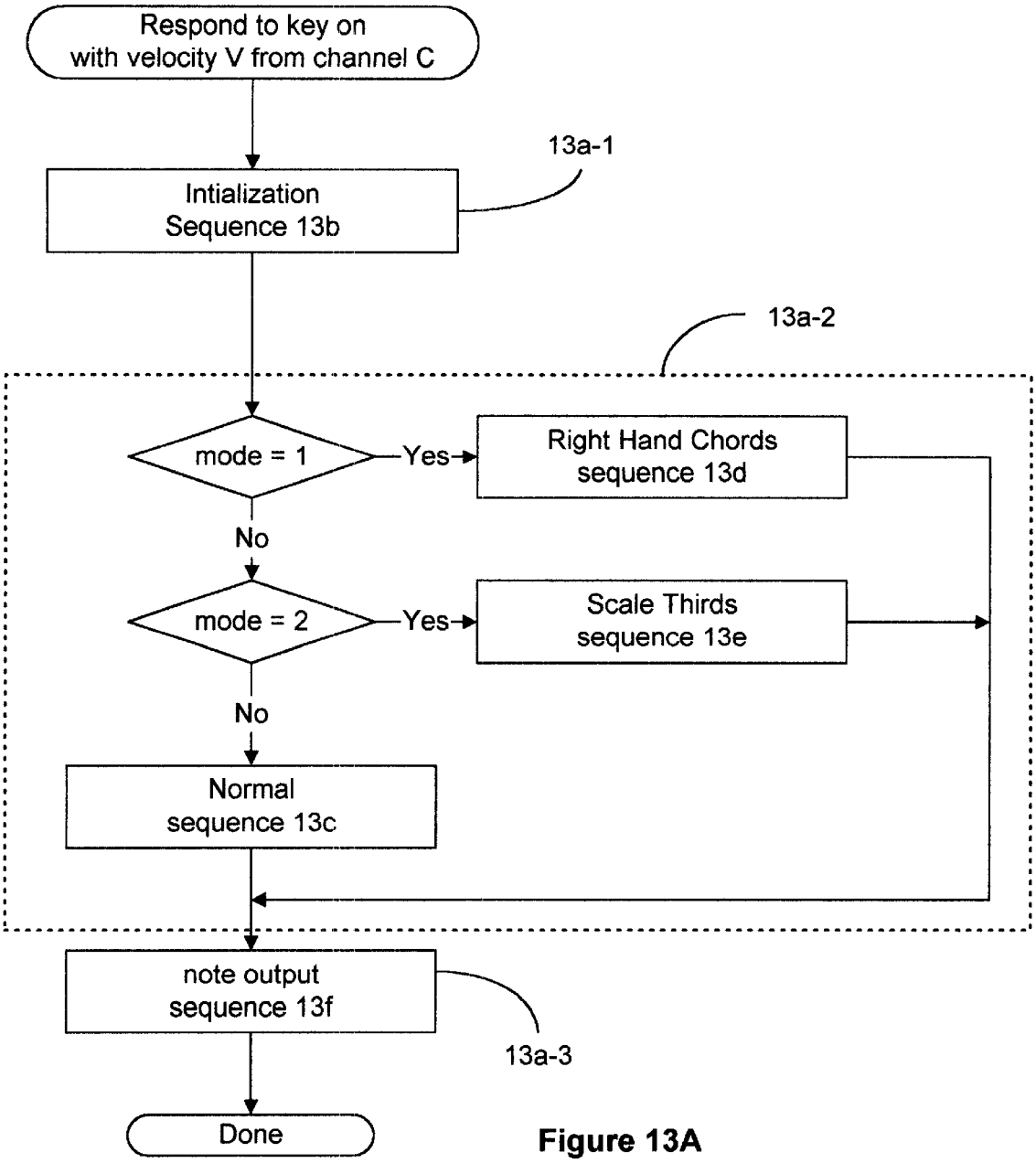
FIGS. 13A through 13F together are a logic flow diagram of the PianoKey::MelodyKey objects 'Respond To Key On' service.
Figure 13B:
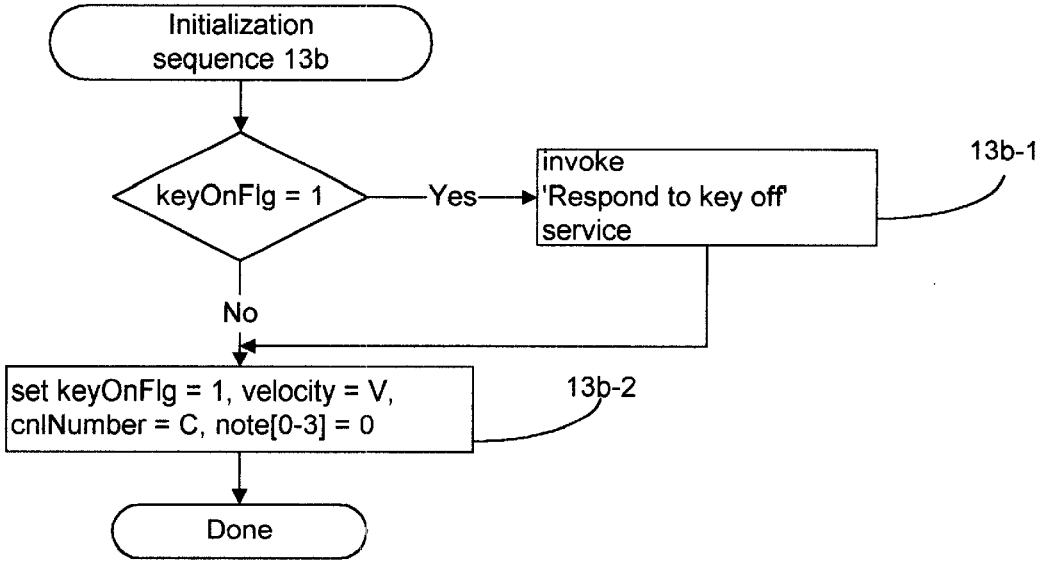

The initialization sequence, shown in FIG. 13*b*, first checks if the key is already pressed. If it is (keyOnFlg=1), the service 'RespondToKeyOff( )' service will be called in step 13*b*-1. Then, keyOnFlg is set to 1, indicating the key is pressed, the velocity and destCnl attributes are set and the notes are cleared by being set to 0 in step 13*b*-2.

Figure 13F:
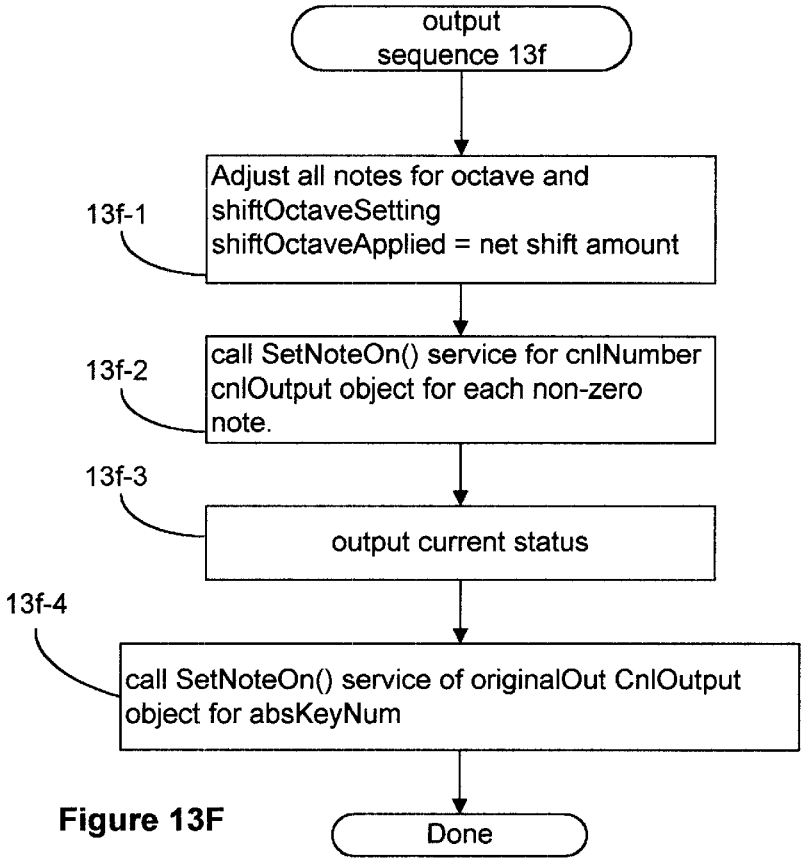
Figure 13C:
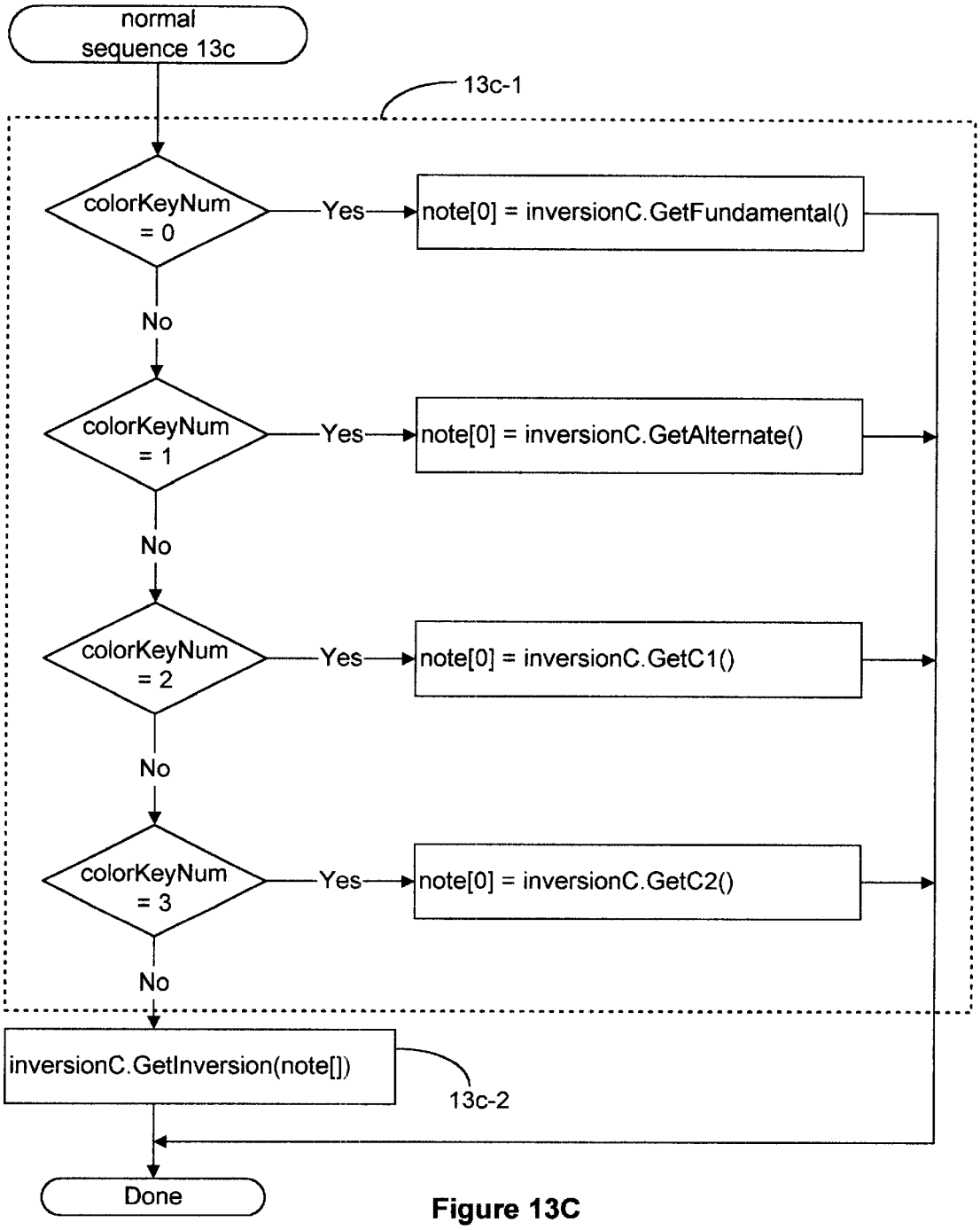

FIG. 13*c* shows a flow diagram of the normal (mode=0) sequence. The note(s) played depends on which black key it is (colorKeyNum). Black (colorKeyNum) keys 0, 1, 2, and 3 get the fundamental, alternate, C1 and C2 note of inversionC, respectively as simply diagramnmed in the sequence 13*c*-1 of FIG. 13C. Black (colorKeyNum) key 4 gets the entire chord by calling the GetInversion( ) service of inversionC (13*c*-2).

Figure 13D:
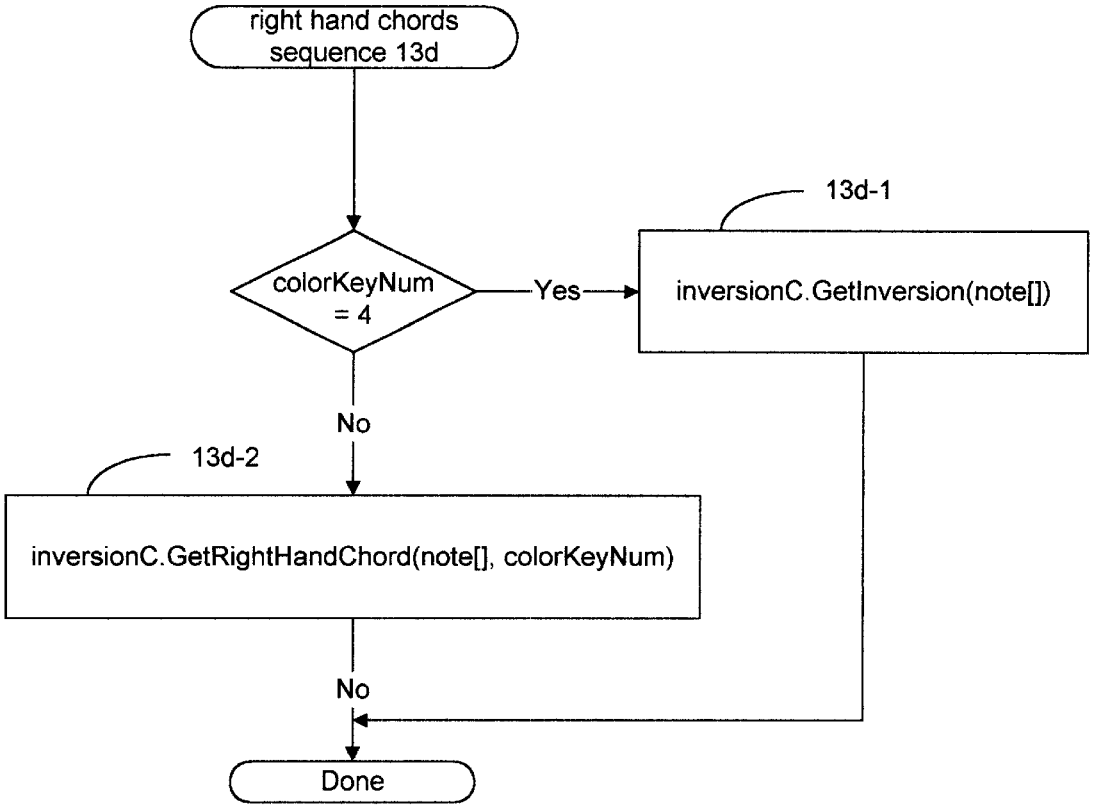

FIG. 13*d* shows a flow diagram of the right hand chords (mode=1) sequence. If the colorKeyNum attribute is 4 (meaning this is the 5th black key in the octave), then the current chord in the current inversion of inversionC is fetched and played in step 13*d*-1. Black keys 0 through 3 will get right hand chords 1 through 4 respectively.

Figure 13E:
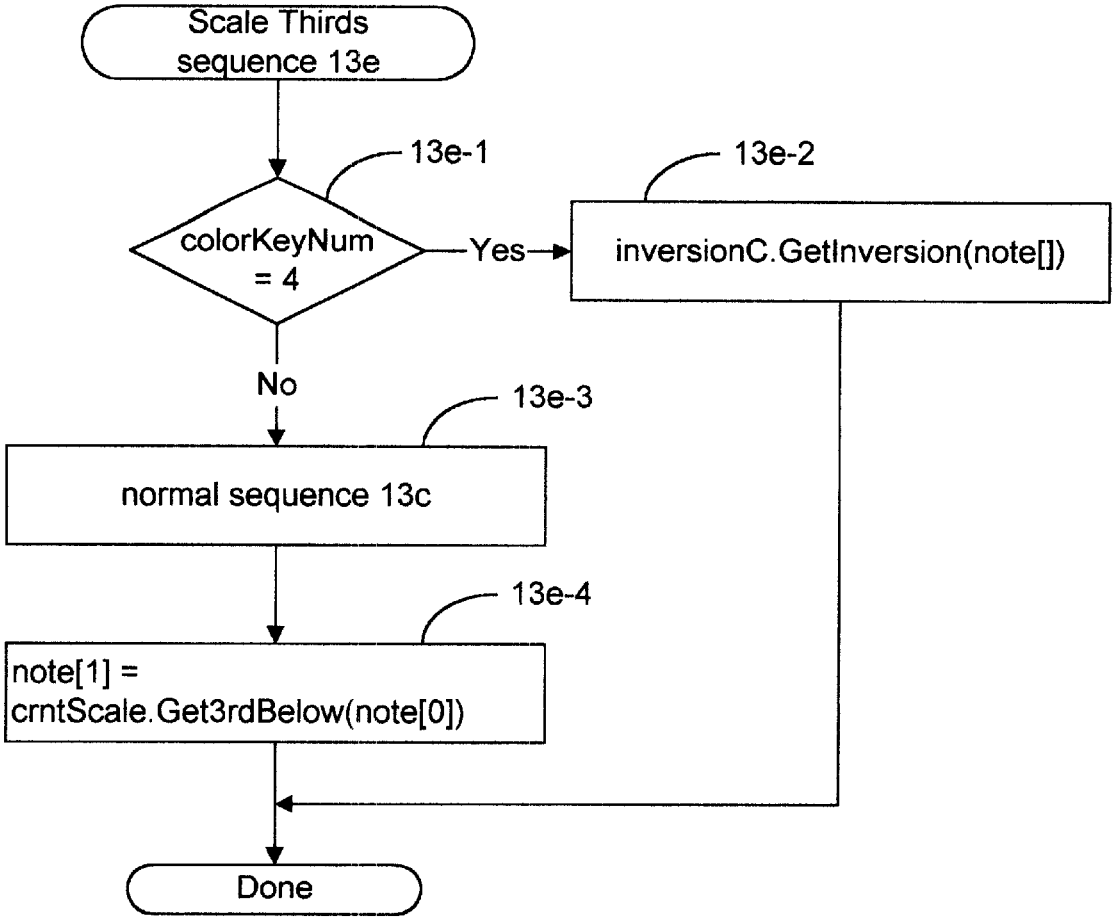

FIG. 13*e* shows a flow diagram of the scale thirds (mode=2) sequence. 13*e*-1 checks if this is the 5th black key (colorKeyNum=4). If it is, the 13*e*-2 will get the entire chord from inversionC object. If it is not the 5th black key, then the normal sequence shown in FIG. 13*c* is executed (13*e*-3). Then the note one scale third below note[0] is fetched from the current scale object (13*e*-4).

FIG. 13*f* shows a flow diagram of the output sequence. This sequence includes adjusting each note for the octave of the key pressed and the octaveShiftSetting attribute in step 13*f*-1. The net shift is stored in octaveShiftApplied. Next, each non-zero note is output to the compOut instance of the CnlOutput object in step 13*f*-2. The current status is also sent out to channel 2 in step 13*f*-3 (see Table 17). Finally, the original note (key) is output to the proper channel in step 13*f*-4.

The service RespondToKeyOff( ) sends note offs for each note that is on. It is identical the flow diagram shown in FIG. 12*k*.

The service CorrectKeyOn( ) is called in response to a change in the current chord or scale while the key is on (keyOnFlg=1). This enables the key to correct the notes it has sent out for the new chord or scale. There are four different correction modes (see description for correction-Mode attribute above).

In the normal correction mode (correctiortMode=0), this service behaves exactly as RespondToKeyOn( ) with one exception. If a new note to be turned on is already on, it will remain on. It therefore does not execute the same identical initialization sequence (FIG. 13*b*) in this mode. It first determines the notes to play (as per RespondToKeyOn( ) service) and then turns off only those notes that are not already on and then turns on any new notes. The solo correction modes (correctionMode=1, 2, or 3) takes this a step further. It turns off only those notes that are not in the new current chord (correctionMode=1), scale (correctionMode=2) or combined chord and scale correctionMode=3). If a note that is already on exists any wherein the current chord, scale or combined chord and scale it will remain on. The current chord objects service isNoteInChord( ) and the current scale objects services isNoteInScale and isNoteInCombinedScale( ) are used to determine if each note already on should be left on or turned off. The output channel for the original key is determined as for the while melody key as described above. It should be noted that all note correction methods described by the present invention are illustrative only, and can easily be expanded to allow note correction based on any single note, such as chord fundamental or alternate, or any note group. A specific mode may also be called for any of a plurality of input controllers.

The services SetMode( ) and SetCorrectionMode( ) set the mode and correctionMode attributes respectively using simple assignment (example: mode=newMode).

Table 15

Since the black chord progression keys play non-scale chords, they are seldom used in music production. These keys become more useful as a control (function) key or toggle switches that allow a user to easily and quickly make mode and configuration changes on the fly. Note that any key can be used as a control key, but the black chord progression keys (non-scale chords) are the obvious choice. The keys chosen to function as control keys are simply instantiated as the desired key type (as are all the other key types). The present invention uses 4 control keys. They are piano keys with absKeyNum of 49, 51, 54 and 56. They have three services, RespondToKeyOn( ), RespondToProgramChange and RespondToKeyOff( ). Presently, the RespondToKeyOff( ) service does nothing (having the service provides a consistent interface for all piano key objects, relieving the music administrator object 3-3 from having to treat these keys differently from other keys. The RespondToKeyon( ) service behaves as follows. Key 49 calls config.setSongKeyBank(0), key 51 calls config.SongKeyBank(1), key 54 calls config.SetScaleBank (0), and key 56 calls config.SetScaleBank(1). Note that these same functions can be done via a user interface. A program change equal to the absKeyNum attribute is also output as for the chord progression keys (see 10-16). The service RespondToProgramChange( ) service is identical to the RespondToKeyOn( ) service. It is provided to allow received program changes (patch triggers) to have the same controlling effect as pressing the control keys.

TABLE 15

| PianoKey::ControlKey Attributes and Services |
|---|
| Attributes: |
| 1. absKeyNum |
| Services: |
| 1. RespondToKeyOn(sourceChannel, velocity); |
| 2. RespondToKeyOff(sourceChannel) |
| 3. RespondToProgramChange(sourceChannel); |

FIGS. 14*a*, 14*b*, 14*c*, 14*d* and 14*e* and Table 16

There is one instance of the music administrator object called musicAdm 3-3. This is the main driver software for the present invention. It is responsible for getting music input from the music input object 3-4 and calling the appropriate service for the appropriate piano key object 3-6. The piano key services called will almost always be RespondToKeyOn( ) or RespondToKeyOff( ). Some music input may be routed directly to the music output object 3-12. Table 16 shows the music administrators attributes and services. Although the description that follows assumes there are 16 input channels, the description is applicable for any number of input channels. All attributes except melodyKeyFlg[16][128] are user setable per user preference. The attribute mode applies to all input channels and may be either off (0) or on (1). The array melodyKeyFlg [16][128] is an array of flags that indicate which melody keys are on (flag=1) and which are off (flag=0). The array holds 128 keys for each of 16 input channels. The cnlMode[ 16] attribute holds the mode for each of 16 input channels. This mode may be one of normal, bypass or off. If cnlMode [y]=bypass, then input from channel y will bypass any processing and be heard like a regular keyboard. Those of ordinary skill will recognize that an embodiment of the present invention may allow designated keys to function as bypassed keys, while other keys are used for chord note and/or scale note performance. If cnlMode[x]=off, then input from channel x will be discarded or filtered out. The attribute firstMldyKey[16] identifies the first melody key for each input channel. FirstMldyKey[y]=60 indicates that for channel y, keys 0–59 are to be interpreted as chord progression keys and keys 60–127 are to be interpreted as melody keys. FirstMldyKey[x]=0 indicates that channel x is to contain only melody keys and firstMldyKey[z]=128 indicates that channel z is to contain only chord progression keys. It should be noted that with minor modification, shifting may be applied to the actual key input before being processed by the music software as a key input. After a key has been determined as either a chord progression key or a melody key by the firstMldyKey[ ] attribute, shifting may then be applied to the key. Any resulting key (shifted or unshifted) originally identified as a chord progression key is processed as a chord progression key, and any resulting key (shifted or unshifted) originally identified as a melody key is processed as a melody key. The attribute chordProcCnl[16] and mldyProcCnl[16] identify the process channel for an input channel's chord progression keys and melody keys respectively. This gives a user the ability to map input to different channels, and/or to combine input from 2 or more channels and to split the chord and melody keys to 2 different channels if desired. By default, the process channels are the same as the receive channel.

TABLE 16

| Music Administrator Objects Attributes and Services |
|---|
| Attributes: |
| 1. mode |
| 2. melodyKeyFlg[16][128] |
| 3. cnlMode[16] |
| 4. firstMldyKey[16] |
| 5. chordProcCnl[16] |
| 6. mldyProcCnl[16] |
| Services: |
| 1. Update( ); |
| 2. SetMode(newMode); |
| 3. SetCnlMode(cnlNum, newMode); |
| 4. SetFirstMldyKey(cnlNum, keyNum); |
| 5. SetProcCnl(cnlNum, chordCnl, mldyCnl); |
| 6. CorrectKeys( ); |

The service SetMode(x) sets the mode attribute to x The service SetCnlMode(x, y) sets attribute cnlMode[x] to y. SetFirstMldyKey(x, y) sets firstMldyKey[x] to y and the service SetProcCnl(x, y, z) sets attribute chordProcCnl[x] to y and attribute mldyProcCnl[x] to z. The above services are called by the user interface object 3-2.

The Update( ) service is called by main (or, in some operating systems, by the real time kernel or other process scheduler). This service is the music software's main execution thread. FIGS. 14*a* through 14*d* show a flow diagram of this service. It first checks if there is any music input received in step 14*a*-1 and does nothing if not. If there is input ready, step 14*a*-2 gets the music input from the music input object 3-4. This music input includes the key number (KeyNum in FIG. 14*a* through 14*d*), the velocity of the key press or release, the channel number (cnl in FIG. 14) and whether the key is on (pressed) or off (released).

If mode attribute is off (mode=0) then the music input is simply echoed directly to the output in step 14*a*-4 with the destination channel being specified by the attribute mldyProcCnl[rcvCnl]. There is no processing of the music if mode is off. If mode is on (mode=1), then the receiving channel is checked to see if it is in bypass mode in step

14*a*-5. If it is, then the output is output in step 14*a*-4 without any processing. If not in bypass mode, then step 14*a*-6 checks if the channel is off. If it is off then execution returns to the beginning. If it is on execution proceeds with the flow diagram shown in FIG. 14*b*.

Step 14*b*-2 checks if it is a key on or off message. If it is, then step 14*b*-3 checks if it is a chord progression key (keys<firstMldyKey[cnl]) or a melody key (>=firstMldyKey [cnl]). Processing of chord progression keys proceeds with U3 (FIG. 14*c*) and processing of melody keys proceeds with U4 (FIG. 14*d*). If it is not a key on/off message then step 14*b*-4 checks if it is a program change (or patch trigger). If it is not then it is a pitch bend or other MIDI message and is sent unprocessed to the output object by step 14*b*-7, after which it returns to U1 to process the next music input. If the input is a patch trigger then step 14*b*-5 checks if the patch trigger is for a chord progession key indicated by the program number being<firstMldyKey[cnl]. If it is not, then the patch trigger is sent to the current status object in step 14*b*-8 by calling the RcvStatus(patchTrigger) service (see Table 17) and then calling the CorrectKey( ) service (14*b*-9), followed by returning to U1.

If the patch trigger is for a chord progression key, then step 14*b*-6 calls the RespondToProgramChange( ) service of the chordKey of the same number as the patch trigger after changing the channel number to that specified in the attribute chordProcCnl[rcvCnl] where rcvCnl is the channel the program change was received on. Execution then returns to U1 to process the next music input.

Figure 14A:
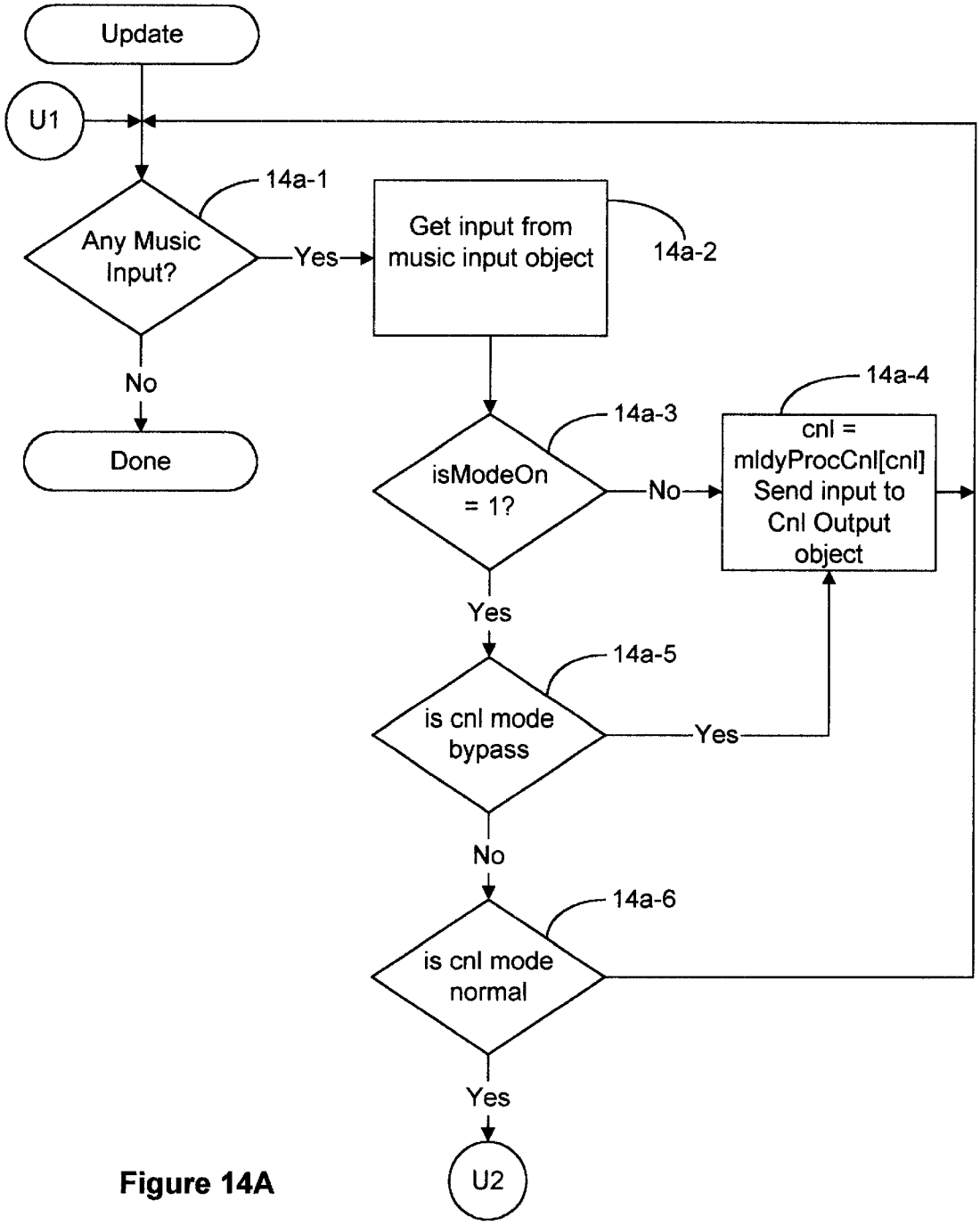
FIGS. 14A through 14D together are a logic flow diagram of Music Administrator objects 'Update' service.
Figure 14B:
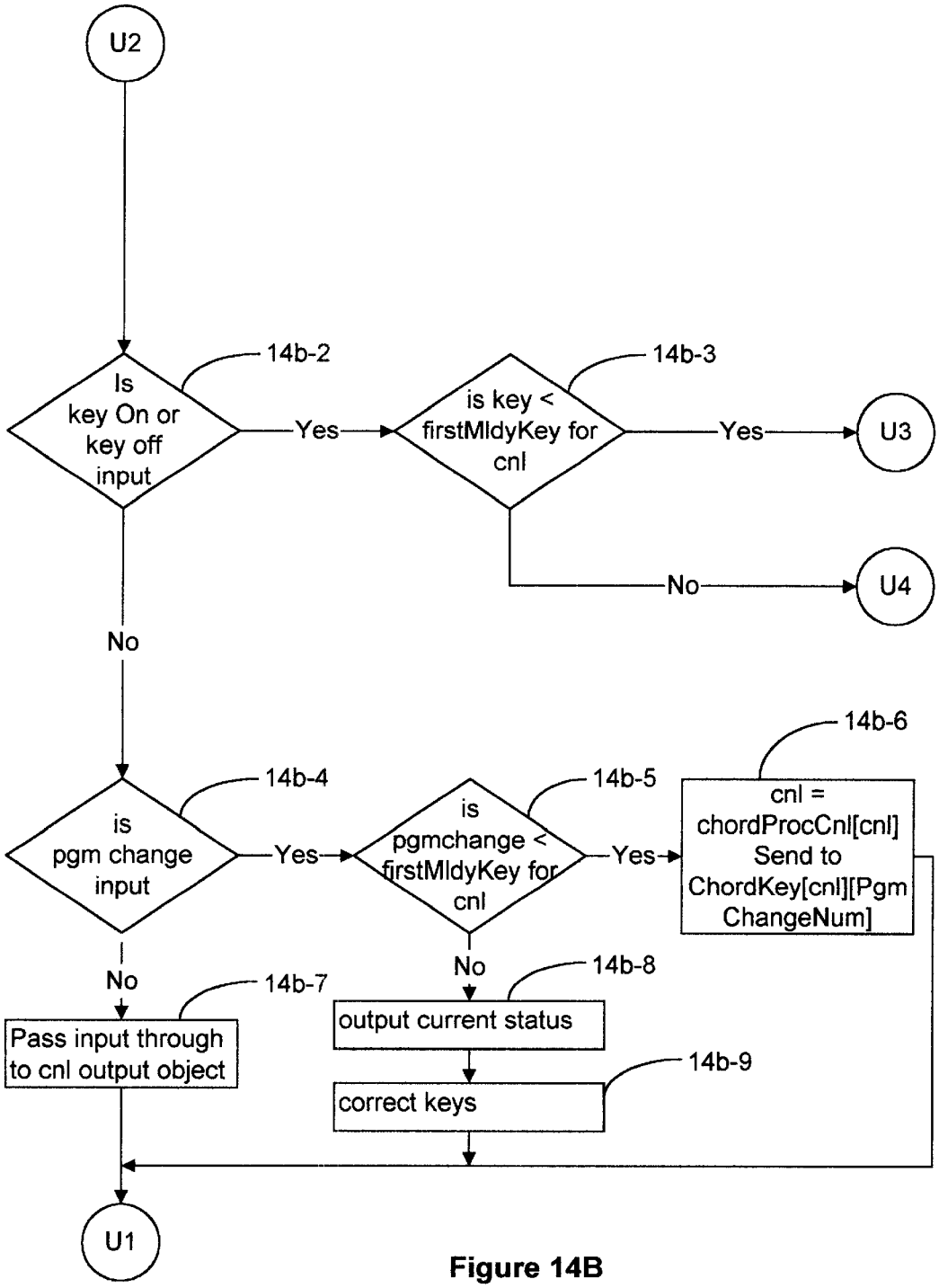
Figure 14C:
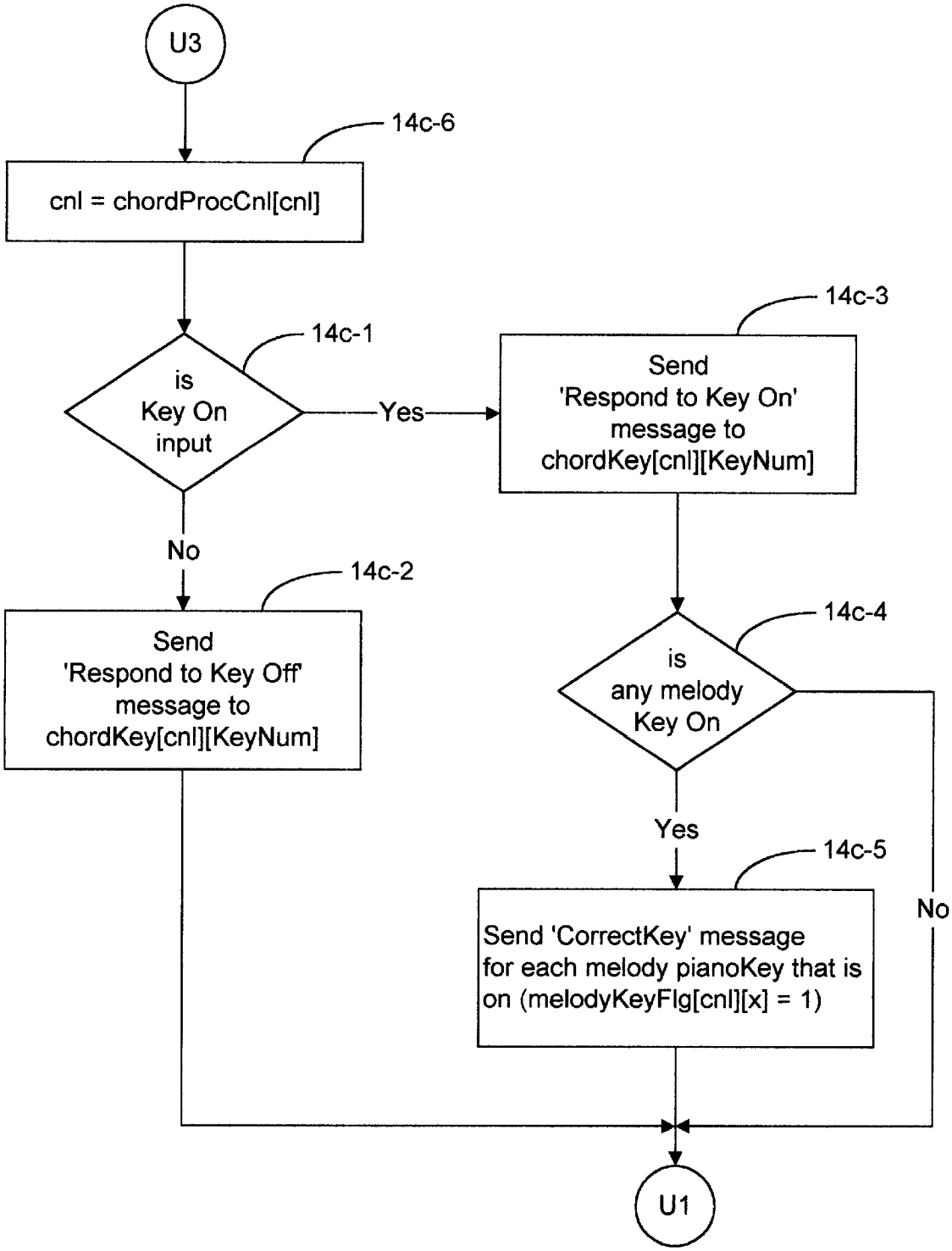
Figure 14D:
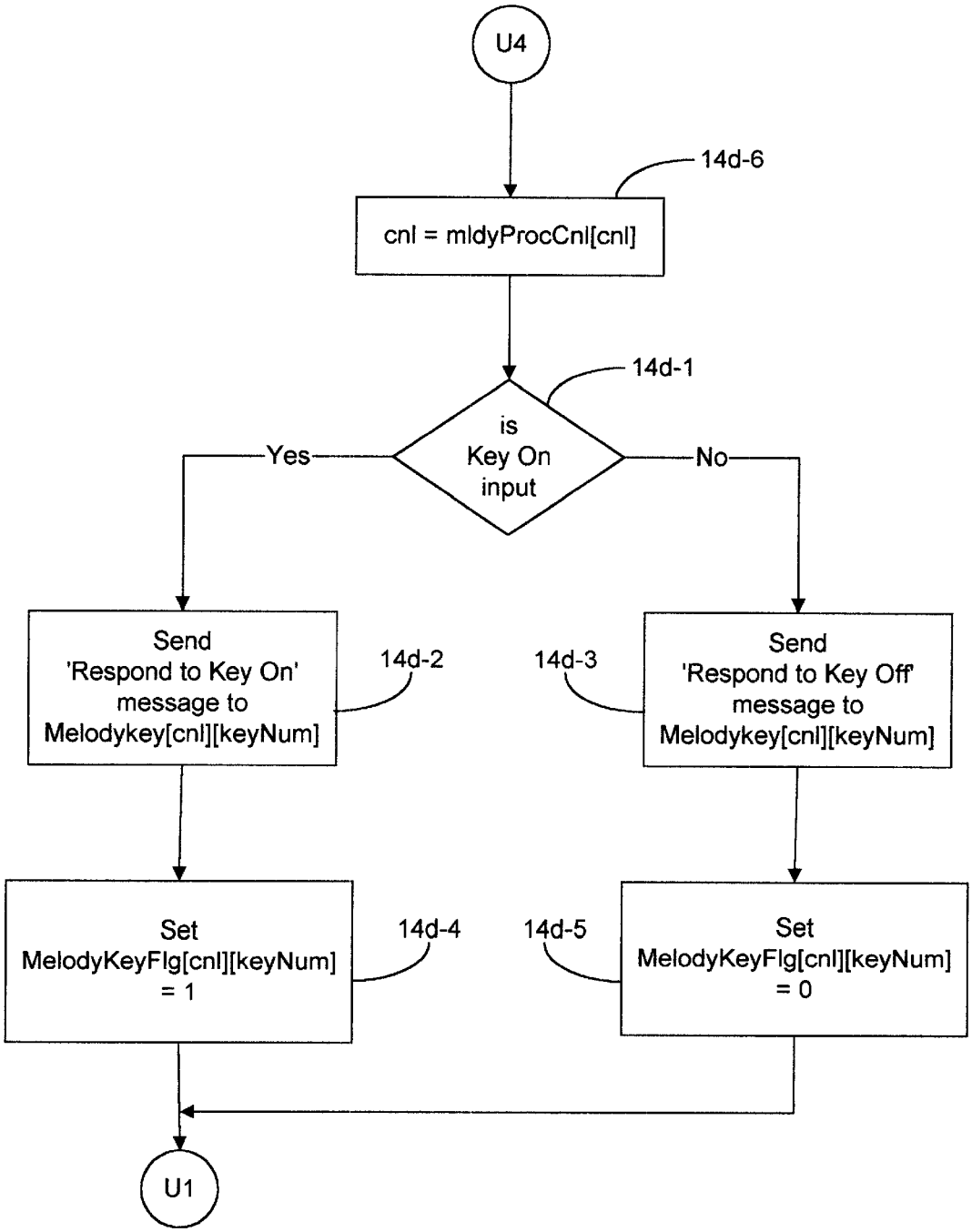

Referring to FIG. 14*c*, step 14*c*-6 changes the channel (cnl in FIG. 14) to that specified by the attribute chordProcCnl [cnl]. Next, step 14*c*-1 checks if the music input is a key on message. If it is not, step 14*c*-2 calls the RespondToKey Off( ) service of the key. If it is, step 14*c*-3 calls the RespondToKeyOn( ) service. After the KeyOn service is called, steps 14*c*-4 and 14*c*-5 call the CorrectKey( ) service of any melody key that is in the on state, indicated by melodyKeyFlg[cnl][Key number]=1. Processing then proceeds to the next music input.

Referring to FIG. 14*d*, step 14*d*-6 changes the channel (cnl in FIG. 14) to that specified by the attribute mldyProcCnl[cnl]. Next, step 14*d*-1 checks if the melody key input is a Key On message. If it is, then step 14*d*-2 calls the RespondToKeyOn( ) service of the specified melody key. This is followed by step 14*d*-4 setting the melodyKeyFlg [cnl][key] to 1 indicating that the key is in the on state. If the music input is a key off message, then step 14*d*-3 calls the RespondToKeyOff( ) service and step 14*d*-5 clears the melodyKeyflg[cnl][key] to 0. Execution then proceeds to U1 to process the next input.

In the description thus far, if a user presses more than one key in the chord progression section, all keys will sound chords, but only the last key pressed will assign (or trigger) the current chord and current scale. It should be apparent that the music administrator object could be modified slightly so that only the lowest key pressed or the last key pressed will sound chords.

The CorrectKeys( ) service is called by the user interface in reponse to the song key being changed or changes in chord or scale assignments. This service is responsible for calling the CorrectKey( ) services of the chord progression key(s) that are on followed by calling the CorrectKey( ) services of the black and white melody keys that are on.

Table 17

Table 17 shows the current status objects attributes and services. This object, not shown in FIG. 3, is responsible for sending and receiving the current status which includes the song key, the current chord (fundamental and type), the current scale (root and type). Current status may also include the current chord inversion, a relative chord position identifier (i.e. see Table 2, last two rows), as well as various other identifiers described herein (not listed in Table 17). The current status message sent and received comprises 6 consecutive patch changes in the form 61, 1*aa*, 1*bb*, 1*cc*, 1*dd* and 1*ee*, where 61 is the patch change that identifies the beginning of the current status message (patch changes 0–59 are reserved for the chord progression keys).

aa is the current song key added to 100 to produce 1*aa*. The value of aa is found in the song key attribute row of Table 2 (when minor song keys are added, the value will range from 0 through 23). bb is the current chord fundamental added to 100. The value of bb is also found in the song key attribute row of Table 2, where the number represents the note in the row above it. cc is the current chord type added to 100. The value of cc is found in the Index column of Table 4. dd is the root note of the current scale added to 100. The value of dd is found the same as bb. ee is the current scale type added to 100. The possible values of ee are found in the Index column of Table 6a.

The attributes are used only by the service RcvStatus( ) which receives the current status message one patch change at a time. The attribute state identifies the state or value of the received status byte (patch change). When state is 0, RcvStatus( ) does nothing unless statusByte is 61 in which case is set state to 1. The state attribute is set to 1 any time a 61 is received. When state is 1, 100 is subtracted from statusByte and checked if a valid song key. If it is then it is stored in rcvdSongKey and state is set to 2. If not a valid song key, state is set to 0. Similarly, rcvdChordFund (state=2), rcvdChordType (state=3), rcvdScaleRoot (state=4) and rcvdScaleType (state=5) are sequentially set to the status byte after 100 is subtracted and value tested for validity. The state is always set to 0 upon reception of invalid value. After rcvdScaleType is set, the current song key, chord and scale are set according to the received values and state is set to 0 in preparation for the next current status message.

The service SendCurrentStatus( ) prepares the current status message by sending patch change 61 to channel 2, fetching the song key, current chord and current scale values, adding 100 to each value and outputting each to channel 2.

It should also be noted that the current status messages may be used to generate a "musical metronome". Traditional metronomes click on each beat to provide rhythmic guidance during a given performance. A "musical metronome" however, will allow a user to get a feel for chord changes and/or possibly scale changes in a given performance. When the first current status message is received during playback, the current chord fundamental is determined, and one or more note ons are provided which are representative of the chord fundamental. When a new and different chord fundamental is determined using a subsequently received current status message, the presently sounded chord fundamental note(s) are turned off, and the new and different chord fundamental note(s) are turned on and so on. The final chord fundamental note off(s) are sent at the end of the performance or when a user terminates the performance. This will allow a plurality of chord changes in the given performance to be indicated to a user by sounding at least fundamental chord notes. Those of ordinary skill will recognize that selected current scale notes may also be determined and sounded if desired, such as for indicating scale changes for example. Additional selected chord notes may also be sounded. In a given performance where a chord progression and/or various scale combinations in the given performance are known, the musical metronome data may be easily generated with minor modification such as before the commencement of the given performance, for example.

TABLE 17

| Current Status Objects Attributes and Services |
|---|
| Attributes: |
| 1. state |
| 2. rcvdSongKey |
| 3. rcvdChordFund |
| 4. rcvdChordType |
| 5. rcvdScaleRoot |
| 6. rcvdScaleType |
| Services: |
| 1. SendCurrentStatus( ); |
| 2. RcvStatus(statusByte); |

An alternative to the current status message described is to simplify it by identifying only which chord, scale, and song key bank (of the configuration object) is selected, rather than identifying the specific chord, scale, and song key. In this case, 61 could be scale bank 1, 62 scale bank 2, 63 chord group bank 1, 64 chord group bank 2, 65 song key bank 1, 66 song key bank 2, etc. The RcvStatus( ) service would, after reception of each patch trigger, call the appropriate service of the configuration object, such as SetScaleBank(1 or 2). However, if the configuration has changed since the received current status message was sent, the resulting chord, scale, and song key may be not what a user expected. It should be noted that the current status messages as well as patch triggers described herein may be output from input controller performances in both the chord section and melody section, then stored. This is useful when a user is recording a performance, but has not yet established a chord progression using the chord progression keys. This will allow the music software to prepare itself for performance of the correct current chord notes and current scale notes on playback.

Table 18

There is one music input object musicIn 3-4. Table 18 shows its attributes and services. This is the interface to the music input hardware. The low level software interface is usually provided by the hardware manufacturer as a 'device driver'. This object is responsible for providing a consistent interface to the hardware "device drivers" of many different vendors. It has five main attributes. keyRcvdFlag is set to 1 when a key pressed or released event (or other input) has been received. The array rcvdKeyBuffer[ ] is an input buffer that stores many received events in the order they were received. This array along with the attributes bufferHead and bufferTail enable this object to implement a standard first in first out (FIFO) buffer. The attribute ChannelMap[64] is a table of channel translations. ChannelMap[n]=y will cause data received on channel n to be treated as if received on channel y. This allows data from two or more different sources to combined on a single channel if desired.

The services include isKeyInputRcvd( ) which returns true (1) if an event has been received and is waiting to be read and processed. GetMusicInput( ) returns the next event received in the order it was received. The InterruptHandler( ) service is called in response to a hardware interrupt triggered by the received event. The MapChannelTo (inputCnl, outputCnl) service will set ChannelMap [inputCnl] to outputCnl. The use and implementation of the music input object is straight forward common. Normally, all input is received from a single source or cable. For most MIDI systems, this limits the input to 16 channels. The music input object 3-4 can accommodate inputs from more than one source (hardware device/cable). For the second, third and fourth source inputs (if present), the music input object adds 16, 32 and 48 respectfully to the actual MIDI channel number. This extends the input capability to 64 channels.

TABLE 18

| Music Input Objects Attributes and Services |
|---|
| Attributes: |
| 1. keyRcvdFlag |
| 2. rcvKeyBuffer[n] |
| 3. channelMap[64] |
| 4. bufferHead |
| 5. bufferTail |
| Services: |
| 1. isKeyInputRcvd( ); keyRcvdFlag |
| 2. GetMusicInput( ); rcvdKeyBuffer[bufferTail] |
| 3. InterruptHandler( ) |
| 4. MapChannelTo(inputCnl, outputCnl); |

Table 19

There is one music output object musicOut 3-12. Table 19 shows its attributes and services. This is the interface to the music output hardware (which is usually the same as the input hardware). The low level software interface is usually provided by the hardware manufacturer as a 'device driver'. This object is responsible for providing a consistent interface to the hardware 'device drivers' of many different vendors.

The musicOut object has three main attributes. The array outputKeyBuffer[ ] is an output buffer that stores many notes and other music messages to be output This array along with the attributes bufferHead and bufferTail enable this object to implement a standard first in first out (FIFO) buffer or output queue.

The service OutputMusic( ) queues music output. The InterruptHandler( ) service is called in response to a hardware interrupt triggered by the output hardware being ready for more output. It outputs music in the order is was stored in the output queue. The use and implementation of the music output object is straight forward and common. As with the music input object 3-4, the music output object 3-12 can accommodate outputting to more than one physical destination (hardware device/cable). Output specified for channels 1–16, 17–32, 33–48 and 49–64 are directed to the first, second, third and fourth destination devices respectfully.

TABLE 19

| Music Output Objects Attributes and Services |
|---|
| Attributes: |
| 1. outputKeyBuffer[n] |
| 2. bufferHead |
| 3. bufferTail |
| Services: |
| 1. OutputMusic(outputByte); |
| 2. InterruptHandler( ); |

User Interface 3-2

There is one User Interface object 3-2. The user interface is responsible for getting user input from computer keyboard and other inputs such as foot switches, buttons, etc., and making the necessary calls to the other objects to configure the software as a user wishes. The user interface also monitors the current condition and updates the display(s) accordingly. The display(s) can be a computer monitor, alphanumeric displays, LEDs, etc.

In the present invention, the music administrator object 3-3 has priority for CPU time. The user interface 3-2 is allowed to run (have CPU time) only when there is no music input to process. This is probably not observable by the user on today's fast processors (CPUs). The user interface does not participate directly in music processing, and therefore no table of attributes or services is provided (except the Update( ) service called by the main object 3-1). The user interface on an embedded instrument will look quite different from a PC version. A PC using a window type operating system interface will be different from a non-window type operating system.

User Interface Scenarios.

The user tells the user interface to turn the system off. The user interface calls musicAdm.SetMode(0) 3-3 which causes subsequent music input to be directed, unprocessed, to the music output object 3-12.

The user sets the song key to D MAJOR. The user interface 3-2 calls songKey.SetSongKey(D MAJOR) (3-8). All subsequent music processing will be in D MAJOR.

A user assigns a minor chord to key 48. The user interface 3-2 calls config.AssignChord(minor, 48) 3-5. The next time pianoKey[48] responds to a key on, the current chord type will be set to minor.

As a user is performing, the current chord and scale are changed per new keys being played. The user interface monitors this activity by calling the various services of cmtChord, cmtScale etc. and updates the display(s) accordingly.

FIGS. 15A through 15K and Tables 20 through 26.

Figure 15A:
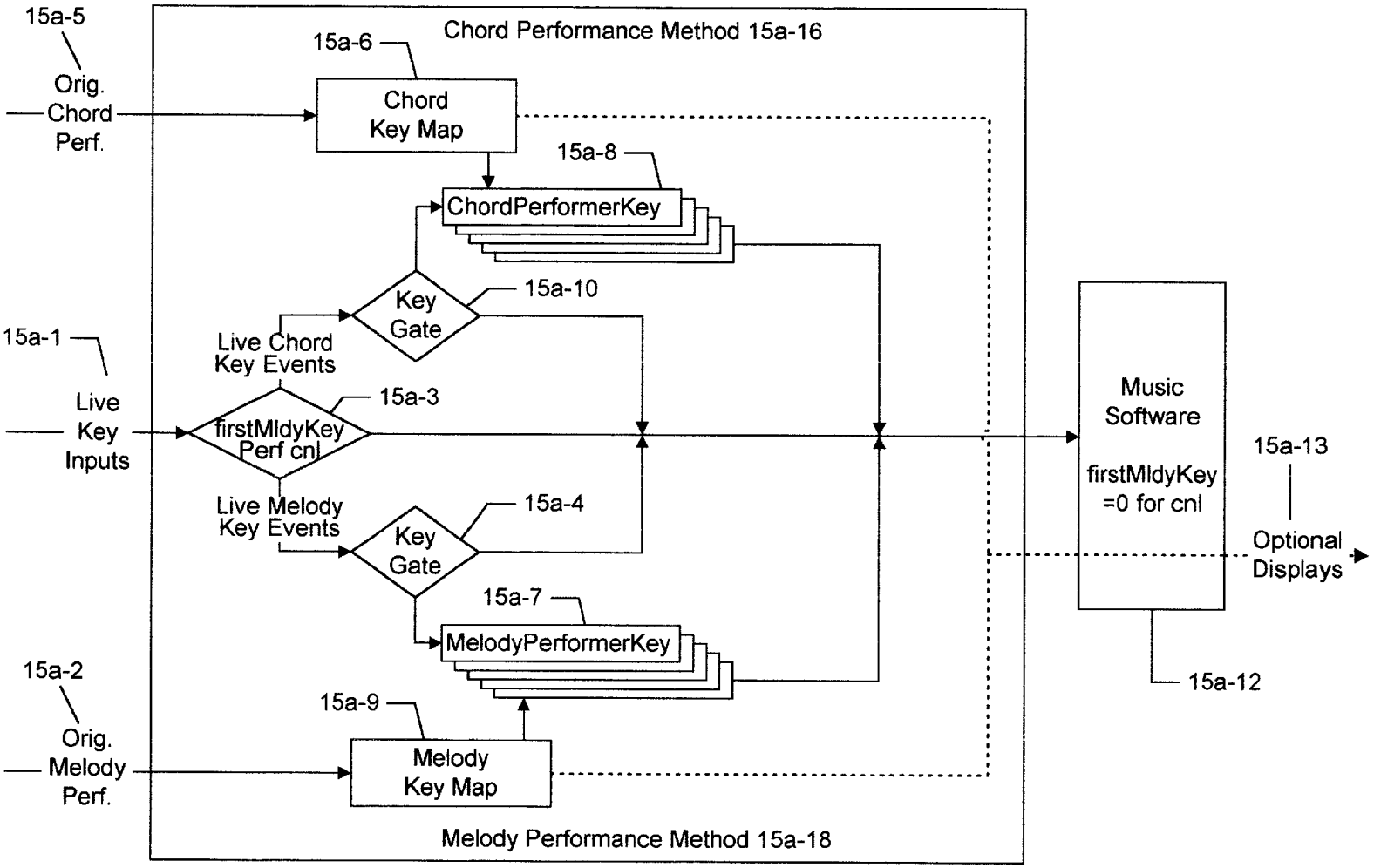
FIG. 15A is a general overview of a performance function of the present invention.

FIG. 15A shows a general overview of a chord performance method and a melody performance method of the present invention. The performance embodiments shown, allow previously recorded or stored musical data to be used for effecting a given performance from various input controller pluralities, even if the given performance represents a composition originally composed by the author(s) from a different number of input controllers. The method uses indicators or "indications" to allow a user to discern which input controllers to play in a given performance. The use of indicators for visually assisted musical performance is well known in the art, and generally involves a controller which contains the processing unit, which may comprise a conventional microprocessor. The controller retrieves indicator information in a predetermined order from a source. The processing unit determines a location on the musical instrument corresponding to the indicator information. The determined location is indicated to the user where the user should engage the instrument in order to sound notes corresponding to the indicator information, as described in Shaffer et al., U.S. Pat. No. 5,266,735. It should be noted that a guitar with a MIDI controller, known in the art, may be used to effect a performance as described herein. The current status messages described herein, may also be used to drive an indicator system corresponding to a guitar, although this method will do nothing to actually reduce the demanding physical skills required to perform the music. Indicators of the present invention can be LEDs, lamps, alphanumeric displays, etc. Indicators may be positioned on or near the input controllers used for performance. They may also be positioned in some other manner, so long as a user can discern which indicator corresponds to which performance input controller. Indicators may also be displayed on a computer monitor or other display, such as by using depictions of performance input controllers and their respective indications, as one example. The indication system described herein, may be incorporated into an embodiment of the present invention, or may comprise a stand-alone unit which is provided to complete an embodiment of the present invention. Those of ordinary skill in the art will recognize that the indicators, as described herein, may be provided in a variety of ways. For purposes of clarification, a given musical performance or "given performance" is defined herein to include any song(s), musical segment(s), composition(s), specific part(s), etc. being performed by a user. A given performance which uses the indicators described herein by FIGS. 15A through 15K, will be readily identifiable and apparent to a user regardless of the number of input controllers, beat, voice selection(s), mode, etc. used to effect the given performance. Various harmony modes, such as those described herein, as well as various other modes, playback tracks, voice selection(s), etc. may be used in a given performance, if desired. Various indications including those described herein, may also be used.

FIG. 15A shows a general overview of one embodiment of the Chord Performance Method 15*a*-16 and Melody Performance Method 15*a*-18 of the present invention. Both methods have been incorporated and shown together in order to simplify the description. An embodiment of the present invention may however, include the Chord Performance Method only 15*a*-16, or the Melody Performance Method only 15*a*-18, if desired. The following performance method description is for one performance channel. Processing may be duplicated, as described later, to allow simultaneous multi-user performance on multiple channels. It should be noted that the present invention is described herein using a basic channel mapping scenario. This was done to simplify the description. Many channel mapping scenarios may be used, and will become apparent to those of ordinary skill in the art. Although the Chord Performance Method and Melody Performance Method are actually part of the music software 15*a*-12, for purposes of illustration they are shown separate. The Melody Performance Method 15*a*-18 of the present invention will be described first. The Melody Performance Method 15*a*-18 involves two main software objects, the Melody Performance Method 15*a*-18 and MelodyPerformerKey 15*a*-7. What the Melody Performance Method 15*a*-18 does is intercept live key inputs 15*a*-1 and previously recorded original melody performance key inputs 15*a*-2, and translates these into the original performance which is then presented to the music software 15*a*-12 for processing as the original performance. Thus the previously recorded or stored original melody performance 15*a*-2 is played back under the control of the live key inputs 15*a*-1. The live key inputs 15*a*-1 correspond to the key inputs 1-13 of FIG. 1A. The previously recorded original melody performance input 15*a*-2 is from the sequencer 1-22 in FIG. 1A. Input data may be provided using a variety of sources, including interchangeable storage devices, etc. This may be useful for providing a user with pre-stored data, such as that which may represent a collection of popular songs, for example. FIG. 15A, 15*a*-2 is referred to as an 'original performance' because it is a sequence of actual keys pressed and presented to the music software and not the processed output from the music software, as has been described herein. When the Melody Performance Method 15*a*-18 uses original melody performance input 15*a*-2 to be presented to the music software for processing, the original melody performance will be re-processed by the music software

15*a*-12. The music software 15*a*-12 is the same as 1-10 in FIG. 1A and the optional displays 15*a*-13 correspond to 1-18 of FIG. 1A.

Table 20

The MelodyPerformerKey object 15*a*-7 will be discussed before the Melody Performance Method object 15*a*-18. Table 20 shows the six attributes of the MelodyPerformerKey object 15*a*-7 and listing of services. Attribute isEngaged is set to TRUE when the object is engaged and is set to FALSE when the object is disengaged. The defaultKey attribute holds the default key (MIDI note) value for the object. The originalDefaultKey attribute holds the default key value when first set. The originalDefaultKey attribute may be used to reset a default key back to its original value when various optional steps described herein are used. The armedKey[64] attribute is an array of 64 keys that each MelodyPerformerKey object 15*a*-7 may be armed with. The attribute velocity holds the velocity parameter received with the last Engage(velocity) service. Attribute isArmedDriverKey is set to TRUE when the object is armed with a key and is set to FALSE when the object is disarmed of all keys. Each instance of MelodyPerformerKey object 15*a*-7 is initialized with isEngaged =FALSE, defaultKey=−1, originalDefaultKey=−1, velocity=0, each armedKey[ ] set to −1, and isArmedDriverKey=FALSE. The value −1 indicates the attribute is null or empty. The service SetDfltKey (keyNum) will set the defaultKey attribute and originalDefaultKey attribute to keyNum where keyNum is a MIDI note number in the range 0 to 127. The services IsDriverKeyArmed( ) and IsArmedDriverKeyPressed( ) are used with the optional performance feature shown by FIG. 15K, described later. The following description assumes that a default key will be used. By having a default key, a user will always hear something when a key is pressed, even if it is not part of the previously recorded original performance 15*a*-2. However, it should be obvious to those of ordinary skill that not setting the default key may be used to provide automatic muting, in a presently preferred embodiment. It should be noted that automatic muting combined with the tempo control feature of FIG. 15K, described later, will provide an unprecedented level of professional performance by untrained users. This combination may be used to allow untrained users to perform professionally on stage, while providing a level of assurance that a cumulative performance will sound "clean" even if a user has limited physical skill.

TABLE 20

| MelodyPerformerKey Attributes and Services |
|---|
| Attributes: |
| 1. isEngaged |
| 2. defaultKey |
| 3. originalDefaultKey |
| 4. velocity |
| 5. armedKey[64] |
| 6. isArmedDriverKey |
| Services: |
| 1. Engage(velocity); |
| 2. Disengage( ); |
| 3. Arm(keyNum); |
| 4. DisArm(keyNum); |
| 5. SetDefaultKey(keyNum); |
| 6. IsDriverKeyArmed( ); |
| 7. IsArmedDriverKeyPressed( ); |

Figure 15B:
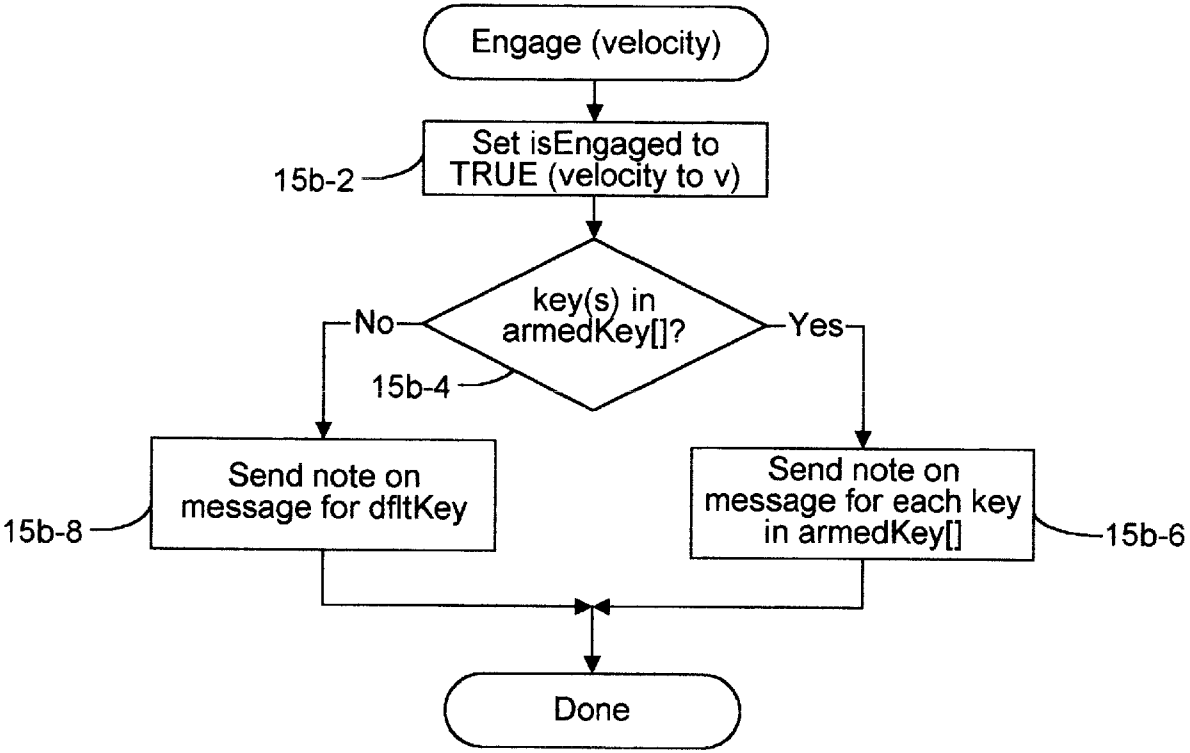
FIG. 15B is a logic flow diagram of the Engage(velocity) service of the performance function.

FIG. 15B shows a flow diagram for the service Engage (velocity). This service is called for the MelodyPerformerKey object 15*a*-7 when a live key 15*a*-1 (MIDI note number) is pressed that corresponds to the MelodyPerformerKey object 15*a*-7, as will be described later. Step 15*b*-2 will set attribute isEngaged to TRUE and velocity to v. Step 15*b*-4 determines if one or more keys are in the armedkey[ ] attribute. If one or more keys are in the armedKey[ ] attribute, then step 15*b*-6 sends a MIDI note on message with velocity v on sourceChannel for each key (MIDI note number) in the armedKey[ ] attribute, and processing finishes. These note on messages are sent to the music software 15*a*-12 for processing as an original performance input. It should be noted that the sourceChannel attribute is common to the Melody Performance Method 15*a*-18, and will be described in more detail later. If there are no keys in the armedKey[ ] attribute in step 15*b*-4, then step 15*b*-8 sends a note on message with velocity v on sourceChannel for the defaultKey attribute, and processing finishes. This note on message is also sent to the music software 15*a*-12 for processing as an original performance input.

Figure 15C:
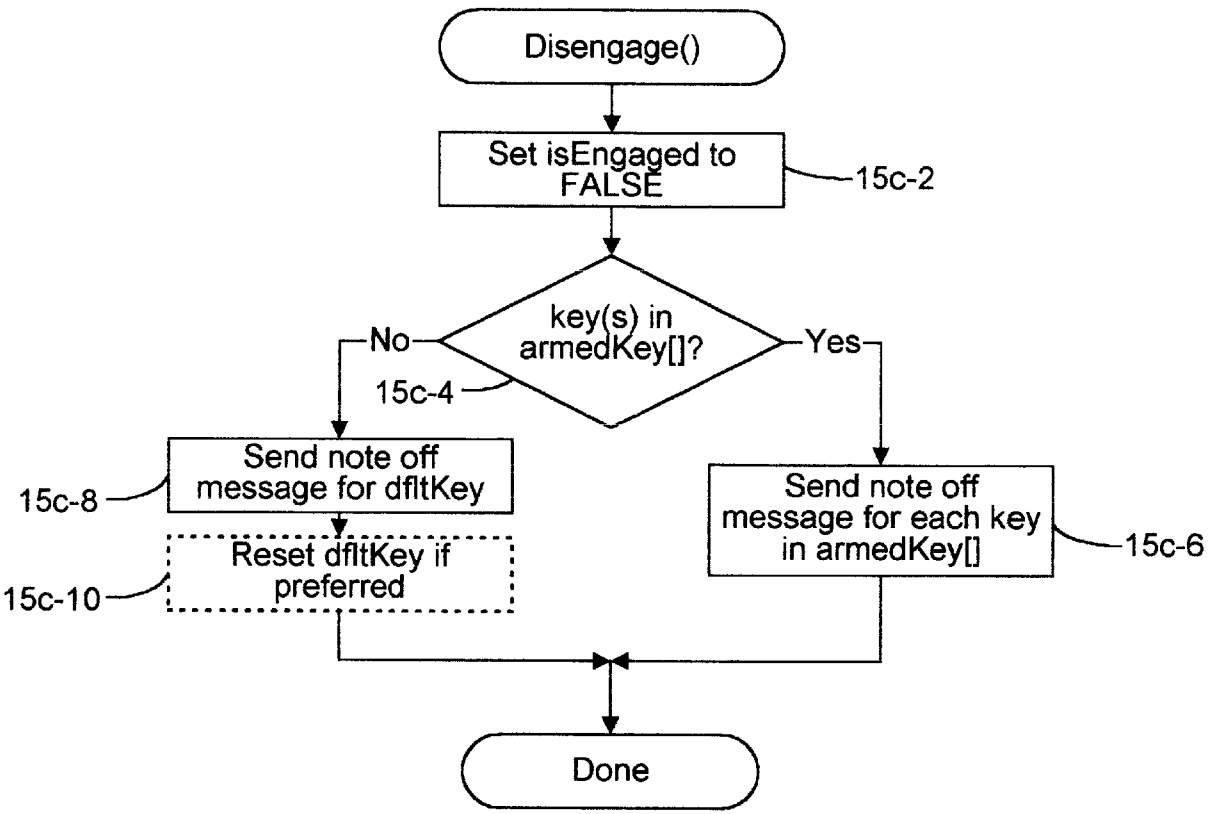
FIG. 15C is a logic flow diagram of the Disengage( ) service of the performance function.

FIG. 15C shows a flow diagram for the service Disengage( ). This service is called for the MelodyPerformerKey object 15*a*-7 when a live key 15*a*-1 (MIDI note number) is released that corresponds to the MelodyPerformerKey object 15*a*-7, as will be described later. Step 15*c*-2 will set isEngaged to FALSE. Step 15*c*-4 determines if one or more keys are in the armedKey[ ] attribute. If one or more keys are in the armedKey[ ] attribute, then step 15*c*-6 sends a note off message on sourceChannel for each key in armedkey[ ] array, and processing finishes. Each note off message is sent to the music software 15*a*-12 for processing as an original performance input. If there are no keys in the armedKey[ ] attribute, then step 15*c*-8 sends a note off message on sourceChannel for the defaultKey attribute, and processing finishes. This note off message is also sent to the music software 15*a*-12 for processing as an original performance input. Although not required, optional step 15*c*-10 (shown by dotted lines) may then reset the defaultKey attribute using the originalDefaultKey value (if different), and processing finishes. The designer has the option of using this additional step 15*c*-10 when optional step 15*e*-10 of FIG. 15E is used (shown by dotted lines). Although not required, these optional steps 15*c*-10 and 15*e*-10 may be used in one embodiment of the present invention for the purpose of providing smoother performance playback.

Figure 15D:
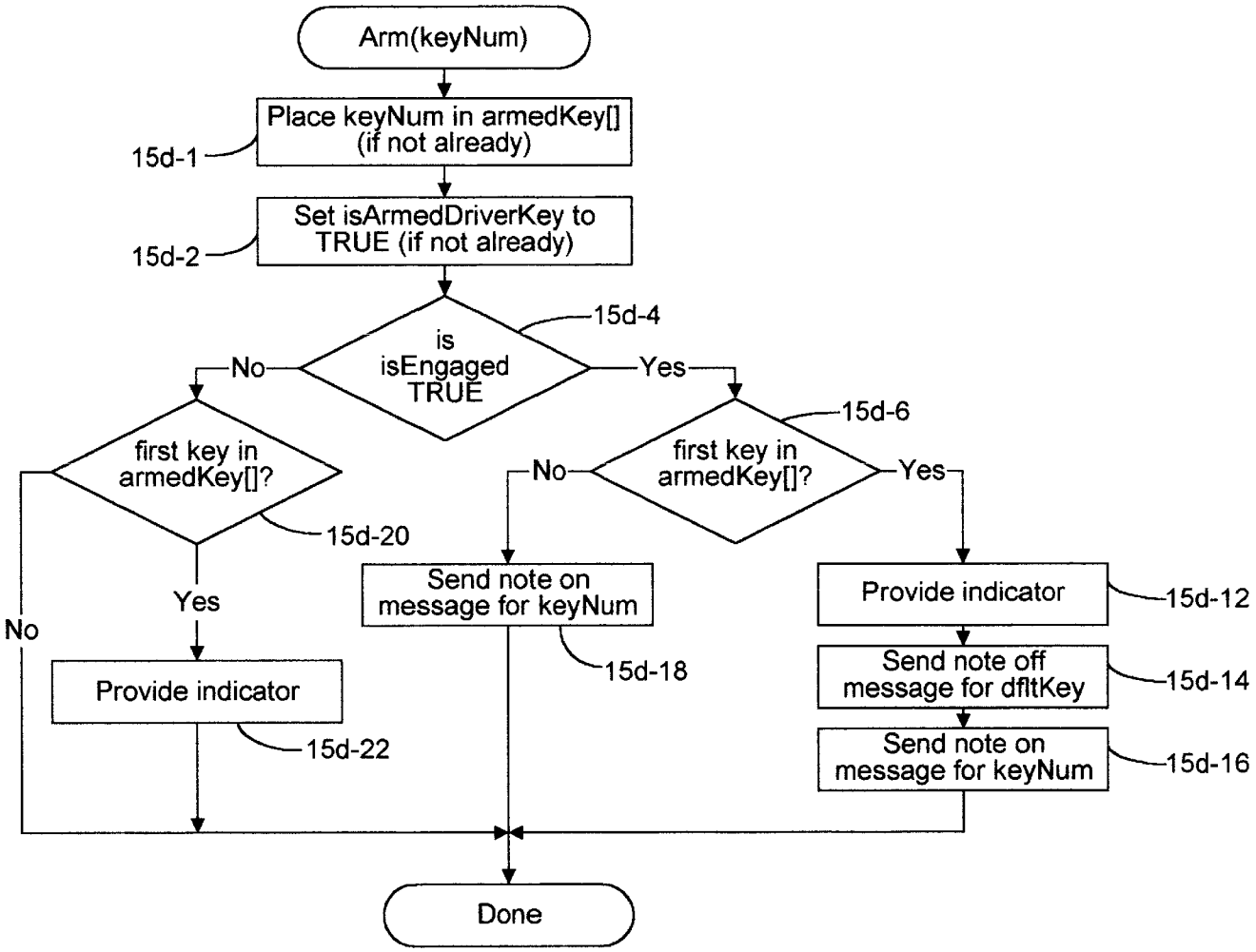
FIG. 15D is a logic flow diagram of the Arm(keyNum) service of the performance function.
Figure 15E:
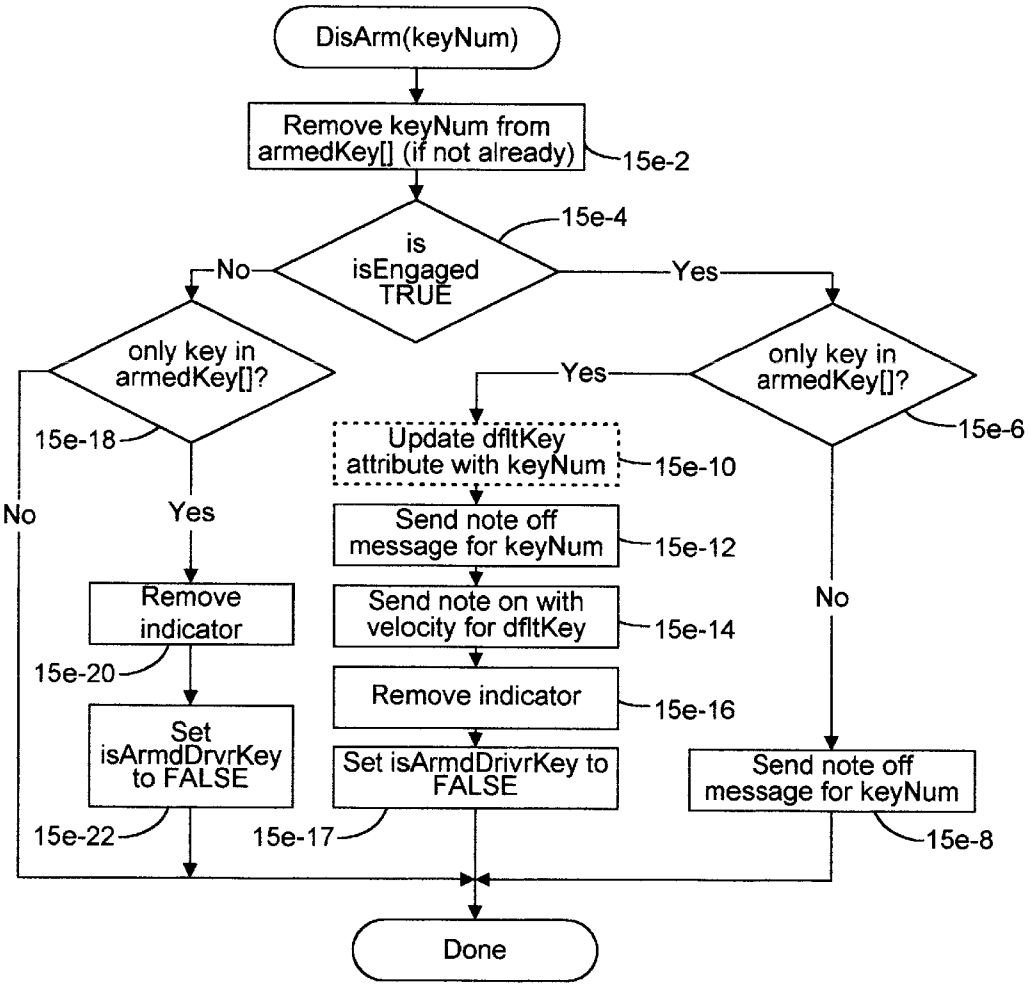
FIG. 15E is a logic flow diagram of the DisArm(keyNum) service of the performance function.

FIG. 15D shows a flow diagram for the service Arm (keyNum). This service is called for the MelodyPerformerKey object 15*a*-7 when an original melody performance note on event 15*a*-2 (keyNum) is received that corresponds to the MelodyPerformerKey object 15*a*-7. Mapping to the object is handled by the melody key map 15*a*-9, as will be described later. Step 15*d*-1 will first place keyNum in the armedkey[ ] array (if not already). Step 15*d*-2 will set isArmedDriverKey to TRUE (if not already). It should be noted that the Arm(keyNum) and DisArm(keyNum) services of FIGS. 15D and 15E, respectively, each set the isArmedDriverKey attribute. However, this attribute (and the steps shown for setting the attribute) are not required unless the additional performance feature shown by FIG. 15K is used. The performance feature of FIG. 15K may be used in an embodiment of the present invention to provide tempo control, as will be described later. Step 15*d*-4 determines if the isEngaged attribute is set to TRUE for the object. If it is set to TRUE, then step 15*d*-6 determines if this is the first key in the armedKey[ ] array. If it is, then step 15*d*-12 provides (or turns on) an indicator corresponding to the live key 15*a*-1 of the object. It should be noted that this indicator may be provided on a specific channel or network address in an embodiment of the present invention. For example, an instrument providing live key inputs 15*a*-1 may be set to send and receive on channel x or network address x. If so, then live key inputs 15*a*-1 are received from channel x or network address x, and indicators are provided to the instrument on channel x or network address x. This will allow indications to be provided independently for each instrument in a multi-user performance, including over networks. Step 15*d*-14 then sends a note off message on sourceChannel for the default key to the music software 15*a*-12. Step 15*d*-16 then sends a note on message for keyNum (with velocity) on sourcechannel to the music software 15*a*-12, and processing finishes. If in step 15*d*-6 it is not the first key in the armedkey[ ] array, then step 15*d*-18 sends a note on message for keyNum (with velocity) on sourcechannel to the music software 15*a*-12, and processing finishes. If in step 15*d*-4 isEngaged is not TRUE, but instead is FALSE, then step 15*d*-20 determines if this is the first key in the armedKey[ ] array. If it is, then step 15*d*-22 provides (or turns on) an indicator corresponding to the appropriate live key 15*a*-1 thus indicating to a user that this live key is armed with an original performance event that needs to be played, and processing finishes. If it is not the first key in the armedKey[ ] array, then processing finishes.

FIG. 15E shows a flow diagram for the service DisArm (keyNum). This service is called for the MelodyPerformer-Key object 15*a*-7, when an original melody performance note off event 15*a*-2 (keyNum) is received that corresponds to the MelodyPerformerKey object 15*a*-7. Mapping to the object is also handled by the melody key map 15*a*-9, as will be described later. Step 15*e*-2 will remove keyNum from armedKey[ ] array (if in the array). Step 15*e*-4 determines if the isEngaged attribute is set to TRUE for the object. If it is set to TRUE, then step 15*e*-6 determines if this is the only key in the armedKey[ ] array. If it is not, then step 15*e*-8 sends a note off message for keyNum on sourceChannel to the music software 15*a*-12, and processing finishes. If it is the only key in the armedKey[ ] array, then step 15*e*-12 sends a note off message on sourceChannel for keyNum to the music software 15*a*-12. Step 15*e*-14 then sends a note on message with velocity on sourceChannel for the defaultKey attribute. This note on message is also sent to the music software 15*a*-12 for processing. Step 15*e*-16 removes (or turns off) the indicator corresponding to the physical live key 15*a*-1, thus indicating to a user that this live key is not armed with an original performance event that needs to be played. Step 15*e*-17 then sets isArmedDriverKey to FALSE, and processing finishes. Step 15*e*-10 (shown by dotted lines) is the optional step mentioned previously when describing FIG. 15C. Although not required, this optional step 15*e*-10 may be used to update the defaultKey attribute with keyNum (if different). This will allow a note to continue to play even though it has been removed from armedKey[ ] array, and the corresponding indicator for the live key has been removed (or turned off). When optional step 15*e*-10 is used, steps 15*e*-12 and 15*e*-14 are not used. Steps 15*e*-16 and 15*e*-17, however, are still used as described previously, and then processing finishes. If in step 15*e*-4 isEngaged is not TRUE, but instead is FALSE, then step 15*e*-18 determines if this is the only key in the armedKey[ ] array. If it is, then step 15*e*-20 removes (or turns off) the indicator corresponding to the physical live key 15*a*-1 as described previously. Step 15*e*-22 sets isArmedDriverKey to FALSE, and processing finishes. If it is not the only key in the armedKey[ ] array in step 15*e*-18, then processing finishes. The net effect of all of the previously described, is that in response to a live key 15*a*-1 being received (and Engaging a MelodyPerformer-Key object 15*a*-7) a previously recorded key 15*a*-2 (having armed the MelodyPerformerKey object) will be played (or presented to the music software object 15*a*-12 as an original performance), and the live keys that are armed will be indicated to a user.

Table 21 lists the Melody Performance Method 15*a*-18 attributes and services. The attribute melodyPerformerOctave[ ] identifies the $1^{st}$ key of the octave where a user wishes to perform a previously recorded performance. It may also hold the last key if desired. It should be noted that, although the term melody performer "octave" is used to describe the present invention, a variety of different key ranges may be used for performance. MelodyPerformerKey[12] is an array of 12 instances of the MelodyPerformerKey objects 15*a*-7 as described previously, one instance for each key in one octave. The melody key map 15*a*-9 maps or identifies which MelodyPerformerKey[ ] instance should be armed with a given original melody performance key 15*a*-2. The present invention maps all C keys (relative key 0, see FIG. 2) to the $1^{st}$ MelodyPerformerKey instance, all C sharps to the $2^{nd}$ instance etc., although a variety of mapping scenarios may be used. One example of another mapping scenario is to encode a MelodyPerformerKey object identifier into each original note on/off event 15*a*-2. These identifiers may then be read by the mapping service to provide the desired routing to a MelodyPerformerKey object 15*a*-7. This will allow the melody key map 15*a*-9 to be optimized for the particular original melody performance 15*a*-2 to be effected. Various other routing techniques, including various other on-the-fly routing techniques, may be used in an embodiment of the present invention and will become apparent to those of ordinary skill in the art. The illustrative mapping scenario described herein, is done by dividing an original melody performance key by 12 and letting the remainder (modulus) identify the instance of MelodyPerformerKey[ ] 15*a*-7 that should be armed with that original melody performance key. This enables the original melody performance 15*a*-2 to be performed from a reduced number of keys. The service SetMelodyPerformerOctave (firstNoteNum) establishes which octave will play the original melody performance by setting melodyPerformerOctave[ ] attribute to firstNoteNum, and then by setting the default key and original default key of each MelodyPerformerKey[ ] instance 15*a*-7 to be the actual keys of the octave. This is done by calling the SetDefaultKey (n) service of each MelodyPerformerKey[ ] instance 15*a*-7. The absolute key numbers of the melody performer octave are stored in an attribute called melodyPerfOctaveArray [12]. In this example, the array would hold the 12 absolute key numbers of the melody performer octave, one for each instance of the 12 MelodyPerformerKey objects 15*a*-7. The service RcvOriginalMelodyPerformance(keyEvent) receives the previously recorded original melody performance 15*a*-2 currently designated for the channel. All non note on/off messages (pitch bend, etc.) may be allowed to pass directly to the music software 15*a*-12 on sourceChannel, depending on designer preference. It should be noted that all current status messages are passed directly to the music software 15*a*-12 during a performance (see Table 17 for description of current status). Original melody performance 15*a*-2 note on message for note number x will result in calling the Arm(x) service of MelodyPerformerKey [y] where y is obtained from the melody key map attribute 15*a*-9 (in the present invention, y=x % 12 where % is the modulus or "remainder from division" operator). For example, note number 24 calls Arm(24) of MelodyPerformerKey[0], while note number 30 calls Arm (30) of MelodyPerformerKey[6]. Similarly, note off message for note number x will result in calling the DisArm(x) service of MelodyPerformerKey[y] where y is determined the same as for note on messages. When a MelodyPerformerKey 15*a*-7 is armed with a previously recorded note on event, then playing the appropriate live key 15*a*-1 will result in that previously recorded note on event being replayed. The attribute sourceChannel holds the default channel for sending all melody section messages to the music software 15*a*-12. The sourceChannel attribute for the Chord Performance Method 15*a*-16 and the sourceChannel attribute for the Melody Performance Method 15*a*-18, are set to be the same in the particular embodiment of the present invention described herein. Attribute isDriverOctave, described later, is set to TRUE when the melody performer octave is designated as a driver octave and is set to FALSE when it is not. These attributes are initialized with sourceChannel=cnl, and isDriverOctave=FALSE.

TABLE 21

| Melody Performance Method Attributes and Services |
|---|
| Attributes: |
| 1. melodyPerformerOctave[ ] |
| 2. MelodyPerformerKey[12] |
| 3. Melody Key Maps |
| 4. melodyPerformerOctaveArray[12] |
| 5. sourceChannel |
| 6. isDriverOctave |
| Services: |
| 1. SetMelodyPerformerOctave(firstNoteNum); |
| 2. RcvOriginalMelodyPerformance(keyEvent); |

Tables 22 and 23.

Table 22 shows the six attributes of the ChordPerformerKey object 15*a*-8 and listing of services. Table 23 lists the Chord Performance Method 15*a*-16 attributes and services. The Chord Performance Method 15*a*-16 is carried out using essentially the same processing technique as the Melody Performance Method 15*a*-18. The services shown by FIGS. 15B through 15E are duplicated except with minor differences. The illustrative chord key map 15*a*-6 is also carried out the same as the melody key map 15*a*-9, thus allowing all chords originally performed as 1-4-5, etc. to be played back respectively from a 1-4-5. . . input controller. Therefore only the processing differences for the Chord Performance Method 15*a*-16 shall be described below. All of the ChordPerformerKey objects 15*a*-8 are armed in each instance with a designated BlackMelodyKey colorKeyNum=4, using one example (i.e. absoluteKeyNums 46, 58, etc., see FIG. 2). These absoluteKeyNums will always output the current chord, or at least one note of the current chord depending on the particular BlackMelodyKey used. The original chord performance input 15*a*-5 is used to determine which ChordPerformerKey 15*a*-8 to arm with the designated BlackMelodyKey. For example, using the previously described mapping formula, note number 24 calls Arm(58) of ChordPerformerKey[0], while note number 30 calls Arm (58) of ChordPerformerKey[6]. Note off message for note number x will result in calling the DisArm(58) service of ChordPerformerKey[y]. Key number 58 is the designated BlackMelodyKey in this example. Although not required, optional steps 15*c*-10 and 15*e*-10 of FIGS. 15C and 15E (shown by dotted lines) may also be used in the Chord Performance Method 15*a*-16. They are carried out using the same steps as described previously by the Melody Performance Method 15*a*-18. It should be obvious to those of ordinary skill that a BlackMelodyKey may also be used as a default key, if desired.

TABLE 22

| ChordPerformerKey Attributes and Services |
|---|
| Attributes: |
| 1. isEngaged |
| 2. defaultKey |
| 3. originalDefaultKey |
| 4. velocity |
| 5. armedKey[64] |
| 6. isArmedDriverKey |
| Services: |
| 1. Engage(velocity); |
| 2. Disengage( ); |
| 3. Arm(keyNum); |
| 4. DisArm(keyNum); |
| 5. SetDefaultKey(keyNum); |
| 6. IsDriverKeyArmed( ); |
| 7. IsArmedDriverKeyPressed( ); |

TABLE 23

| Chord Performance Method Attributes and Services |
|---|
| Attributes: |
| 1. chordPerformerOctave[ ] |
| 2. ChordPerformerKey[12] |
| 3. Chord Key Maps |
| 4. chordPerformerOctaveArray[12] |
| 5. sourChannel |
| 6. isDriverOctave |
| Services: |
| 1. SetChordPerformerOctave(firstNoteNum); |
| 2. RcvOriginalChordPerformance(keyEvent); |

Figure 15F:
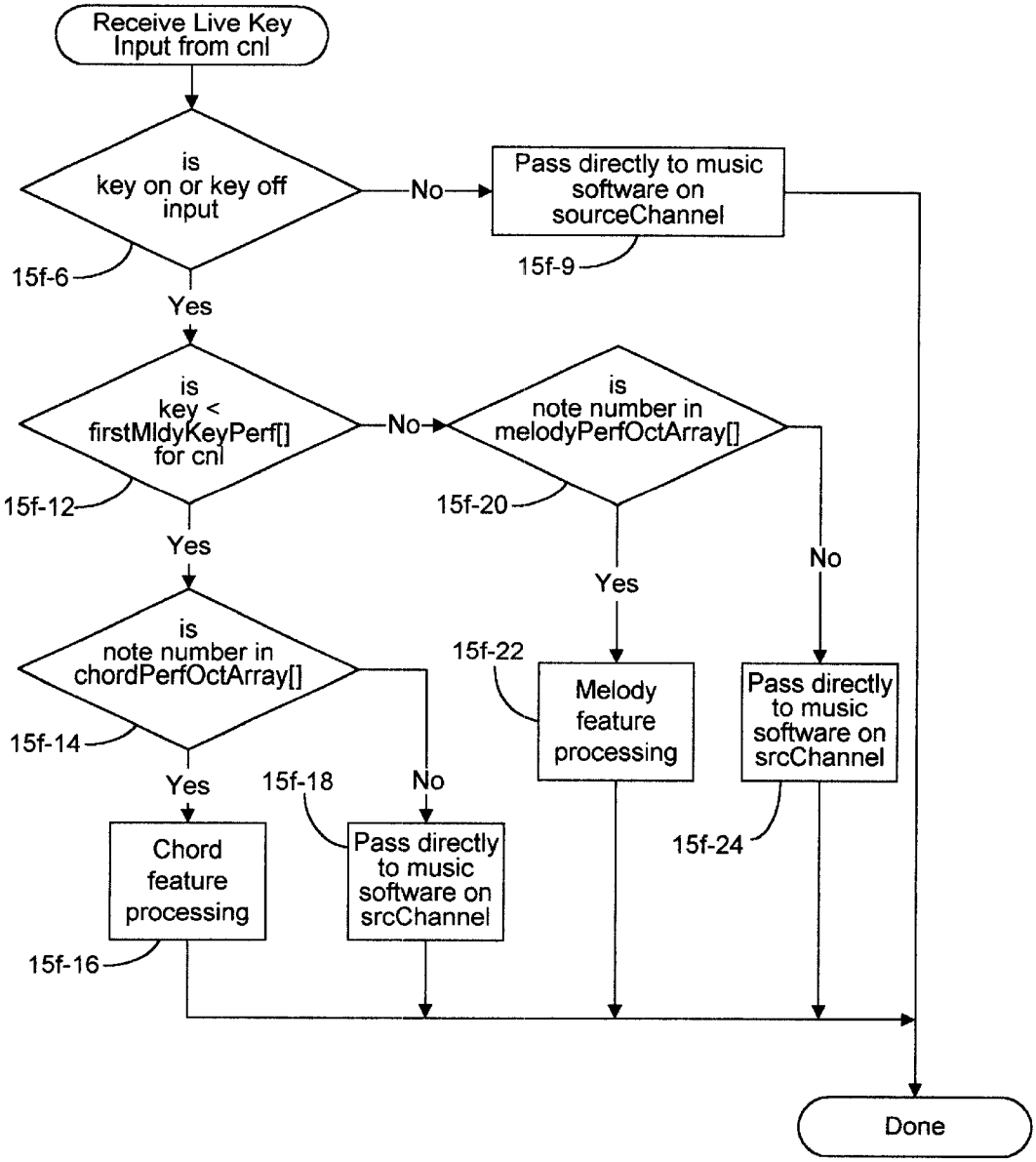
FIG. 15F is a logic flow diagram of the RcvLiveKey (keyEvent) service of the performance function.

FIG. 15F shows a flow diagram for the service RcvLiveKey(keyEvent) listed in Table 24. This service is common to both the Chord Performance Method 15*a*-16 and Melody Performance Method 15*a*-18 for the channel, and is called when the performance feature is on for the channel (i.e. mode >0). All live key inputs received for a channel where mode=0 for the channel, are processed in the usual manner by the music software 15*a*-12, as described herein. The service of FIG. 15F responds to live key inputs 15*a*-1 for the channel and provides key gating 15*a*-3, 15*a*-4, and 15*a*-10. The live key inputs for the channel 15*a*-1 are received from an input buffer that stores many received events in the order they were received (see Table 18 for description of input buffering). The keyEvent contains the status, note number, channel and velocity information. Step 15*f*-6 determines if a key on or key off is input. If a key on or key off is not input (but instead pitch bend, etc.), then step 15*f*-9 passes the input directly to the music software 15*a*-12 on sourceChannel (either chord method sourceChannel or melody method sourceChannel, which are the same), and processing finishes. If a key on or key off is input in step 15*f*-6, then step 15*f*-12 determines if the key (MIDI note number) is less than the firstMldyKeyPerf[ ] setting for the channel 15*a*-3 (see Table 26 for description of firstMldyKeyPerf[ ]). If it is less, then step 15*f*-14 (key gate 15*a*-10) determines if the note number is in the chordPerfOctaveArray[ ]. If it is in the chordPerfOctaveArray[ ], then it is processed by the Chord Performance Method 15*a*-16 in step 15*f*-16. Note on messages that are in the chordPerfOctaveArray[ ], result in calling the Engage(v) service of ChordPerformerKey[r] 15*a*-8 where v is the velocity and r is the relative key number of the received note on. Similarly note off messages that are in the chordPerfOctaveArray[ ], result in calling the Disengage( ) service of ChordPerformerKey[r] 15*a*-8 where r is the relative key number of the received note off. It should be noted that in some embodiments of the present invention, r may be the position in the chordPerfOctaveArray[ ] of the received note number. This may be the case when the chordPerfOctaveArray[ ] holds absolute key numbers which are not in consecutive order, using one example. Normally in a case such as this, a defaultKey and an originalDefaultKey will be set to be the same as their corresponding absolute key number in the chordPerfOctaveArray[ ]. If the note number is not in the chordPerfOctaveArray[ ], then step 15*f*-18 passes the note on/off message directly to the music software 15*a*-12 on the chord method sourceChannel, and processing finishes. If in step 15*f*-12 it is determined that the key (MIDI note number) is greater than or equal to the firstMldyKeyPerf[ ] setting 15*a*-3 for the channel, then step 15*f*-20 (key gate 15*a*-4) determines if the note number is in the melodyPerfOctaveArray[ ]. If it is in the melodyPerfOctaveArray[ ], then it is processed by the Melody Performance Method 15*a*-18 in step 15*f*-22. Note on messages that are in the melodyPerfOctaveArray[ ], result in calling the Engage(v) service of MelodyPerformerKey[r] 15*a*-7 where v is the velocity and r is the relative key number of the received note on. Similarly note off messages that are in the melodyPerfOctaveArray[ ], result in calling the Disengage( ) service of MelodyPerformerKey[r] 15*a*-7 where r is the relative key number of the received note off. Again, in some embodiments of the present invention r may be the position in the melodyPerfOctaveArray[ ] of the received note number, as described previously. If the note number is not in the melodyPerfOctaveArray[ ], then step 15*f*-24 passes the note on/off message directly to the music software 15*a*-12 on the melody method sourceChannel, and processing finishes.

Figure 15G:
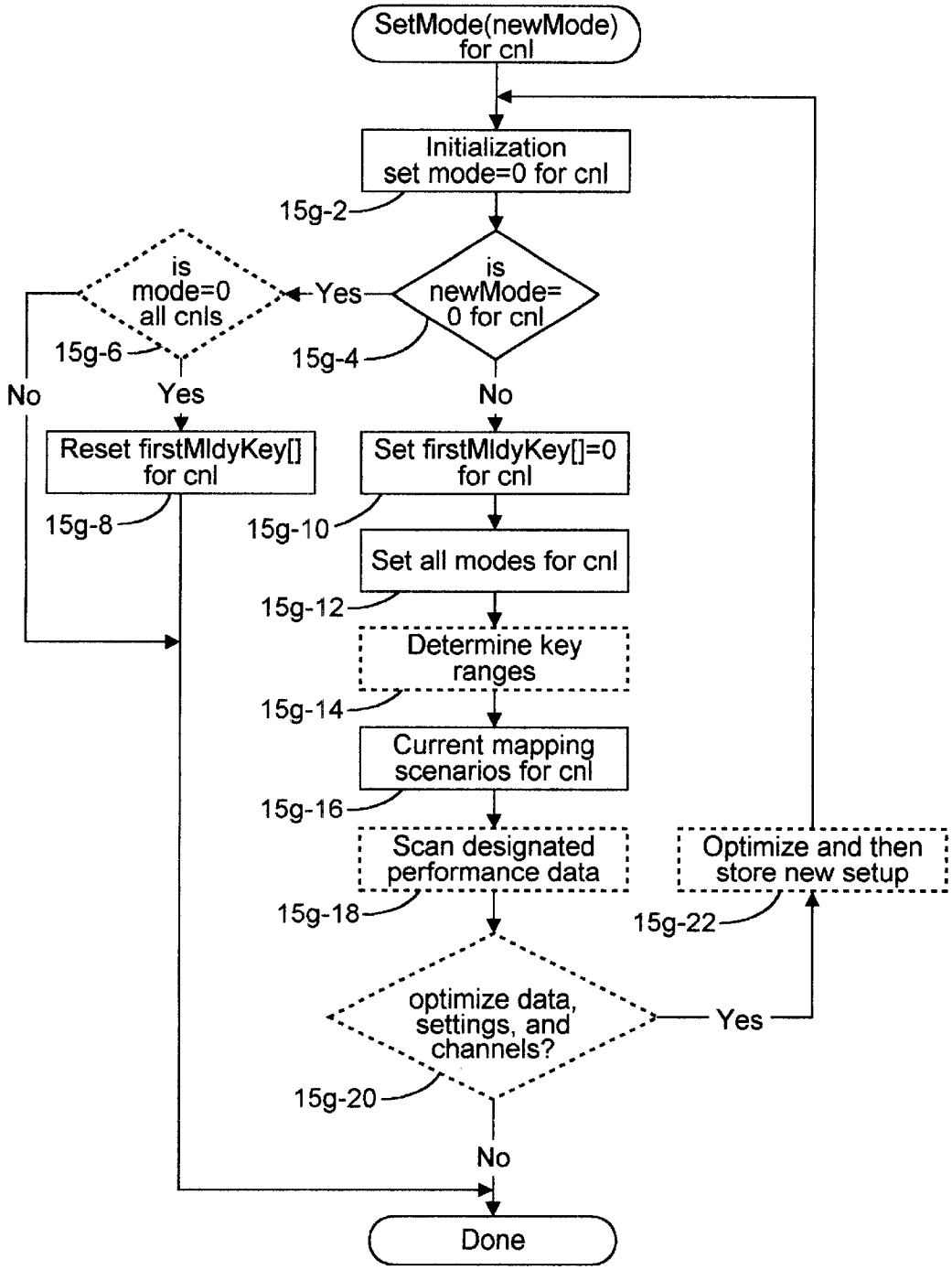
FIGS. 15G through 15J together are a logic flow diagram of mode setting services for the performance function.

FIG. 15G and Tables 24 and 25.

The performance mode settings are common to both the Chord Performance Method 15*a*-16 and Melody Performance Method 15*a*-18 for the channel. FIG. 15G shows a flow diagram for the service SetMode(newMode) listed in Table 24. This service is called when the mode is set for the channel. Table 25 shows possible mode setting combinations according to one embodiment of the present invention. The mode settings may be simplified or expanded as desired in an embodiment of the present invention. Step 15*g*-2 performs the initialization by setting attributes to their initialization values (and setting mode=0 for cnl), removing or turning off any indicators, turning off notes, resetting flags, etc. in the usual manner. No original performance data 15*a*-2 and 15*a*-5 should be designated for the channel in step 15*g*-2. Step 15*g*-4 then determines if newMode is equal to 0. If it is, then step 15*g*-8 resets the firstMldKey[ ] setting for the channel, if needed, using the originalFirstMldyKey[ ] setting for the channel, and processing finishes (see Table 26 for description of originalFirstMldyKey[ ]). Optional step 15*g*-6 (shown by dotted lines) may be used when multiple performance channels are used, as will be described later. If in step 15*g*-4, newMode is not equal to 0, but instead is greater than zero, then step 15*g*-10 sets the firstMldyKey[ ] setting for the channel to 0, if not already. Step 15*g*-12 then sets all modes for the channel according to the flow diagrams shown in FIGS. 15H, 15I, and 15J and a selected mode setting combination shown in Table 25. Step 15*g*-16 then determines the current mapping scenario(s) for the channel. In one presently preferred embodiment of the present invention, a plurality of stored mapping scenarios are made available to a user. A mapping scenario will include a PerformerKey[x] array of x instances of the PerformerKey objects. It will also include a performerOctaveArray[x] which includes x absolute key numbers of the performer octave. It may also include a performerOctave[ ] attribute which includes the lowest absolute key number and highest absolute key number of the performer octave. It will also include one or more mapping services for mapping the stored original performance to the x instances of the PerformerKey objects. Normally when performanceMode=1 (chord performance only), a user may choose to effect a chord performance using any number of input controllers (up to the entire keyboard range) as one example. When performanceMode=2 (melody performance only), a user may effect a melody performance using any number of input controllers (up to the entire keyboard range) as one example. If performanceMode=3 (chord performance and melody performance), then the mapping scenarios available for the chord performance and melody performance are determined by the firstMldyKeyPerf[ ] setting z 15*a*-3 for the channel. A designer may know the key ranges and the firstMldyKeyPerf[ ] setting for the sending instrument. Therefore, all mapping scenarios may be predetermined and stored as desired. If not, optional step 15*g*-14 (shown by dotted lines) may be used. A user may be prompted to press the lowest key on the instrument, which is stored in the attribute lowestkey x, then the highest key on the instrument which is stored in the attribute highestkey y. The firstMldyKeyPerf[ ] setting z 15*a*-3 for the channel may then be determined or be made user-selectable. Then, Y−X+1=[totalKeysAvailable], Z−X=[chordKeysAvailable], Y−Z+1=[melodyKeysAvailable], chordSectionRange=X through Z−1, and melodySectionRange=Z through Y. These values may be used to allow appropriate mapping scenarios to be made available for the particular sending instrument, thus providing one way of allowing a performance to be optimized for the particular instrument. For example, the chordKeysAvailable may be 24. Chord performance bank 24A may then be used for providing chord mapping scenarios as one example. Chord performance bank 24A may hold a plurality of chord mapping scenarios which allow a user to effect the chord performance using up to 24 keys. It should be noted that the absolute key numbers in chordPerfOctaveArray[ ], chordPerfOctave[ ] attribute, and default keys for the ChordPerformerKey objects, are normally adjusted so as to be note numbers in the chordSectionRange (X through Z−1). Similarly, melodyKeysAvailable may be 37. Melody performance bank 37A may then be used for providing melody mapping scenarios as one example. Melody performance bank 37A may hold a plurality of melody mapping scenarios which allow a user to effect the melody performance using up to 37 keys. It should be noted that the absolute key numbers in melodyPerfOctaveArray[ ], melodyPerfOctave[ ] attribute, and default keys for the MelodyPerformerKey objects, are normally adjusted so as to be note numbers in the melodySectionRange (Z through Y). Each performance bank (i.e. 24A, 24B, 24C, etc.) may include different sets of services (FIGS. 15B through 15E and mapping service(s)) in an embodiment of the present invention. A performance bank may be designated based on the stored original performance data to be performed, as one example, or designated based on one or more particular mode settings for the channel. The optional automatic optimization process 15*g*-20 and 15*g*-22 (shown by dotted lines) may also be used to designate a particular performance bank, if desired.

Optional steps 15g-18, 15g-20, and 15g-22 (shown by dotted lines) of FIG. 15G may be used for performance optimization. A performance may be optimized for the channel or for all channels in steps 15g-20 and 15g-22. All performance settings for all channels may be stored as a new setup in step 15g-22. The service shown in FIG. 15G is then called for each channel, and possibly new settings are made and new mapping scenarios are determined for selected channels, based on the stored setup information. A user may save the stored setup such as to disk, etc. for later recall. One example of an automatic optimization process, is to encode PerformerKey object identifiers into one or more stored original performances (i.e. 15a-2). The identifiers are read by the mapping service for routing original performance input to the PerformerKey objects during a performance. Matching identifiers are encoded into each note on/corresponding note off event in the stored original performance (i.e. 15a-2). The value of the identifier to be encoded into each specific note on/corresponding note off pair, may be based on the interval x between a note on event and the next note on event in the sequence, using one example. Note on events with intervals of x or less between them in a particular segment of stored notes, may be given a selected PerformerKey object identifier. This encoding may be used to allow a difficult to play or "quick" passage to be routed to a specific PerformerKey during the performance for ease-of-play. A note on event in the stored original performance (i.e. 15a-2), where the interval between the note on event and the previous note on event is greater than x, and the interval between the note on event and the next note on event is greater than x, may be encoded (along with its corresponding note off event) with a designated identifier which allows routing to a PerformerKey to be handled by the mapping service (i.e. based on a formula, etc.), as described herein. The previously described method allows one or more notes in a difficult to play passage to be automatically sounded during a performance. This effect may also be accomplished using various on-the-fly techniques. As one example of an on-the-fly technique, the RcvOriginalMelodyPerformance(keyEvent) service of Table 21 may be modified to allow automatic note sounding to be provided on-the-fly in a performance. In steps not shown, a timer is reset (if needed) and started when a first original performance note on event is received in the performance (i.e. 15a-2). Each time a subsequent original performance note on event is received during the performance (i.e. 15a-2), the current time of the timer is stored in an attribute called autoNoteTimer, then the timer is reset and started again. For original performance note on events received where autoNoteTimer is less than x, a note on message is automatically sent for keyNum on sourceChannel to the music software 15a-12 for processing as an original performance input, and keyNum is stored in an attribute called autoNotesArray[ ]. The processing of FIGS. 15A 15a-9 and 15a-7, and FIG. 15D is not carried out for keyNum. For original performance note on events received where autoNoteTimer is greater than or equal to x, processing is carried out normally as described herein (see FIGS. 15A 15a-9 and 15a-7, and FIG. 15D). Each time an original performance note off event is received in the performance (i.e. 15a-2), the autoNotesArray[ ] is first checked to see if keyNum is in the array. If it is in the array, then a note off message is automatically sent for keyNum on sourceChannel to the music software 15a-12 for processing as an original performance input, and keyNum is removed from the autoNotesArray[ ]. The processing of FIGS. 15A 15a-9 and 15a-7, and FIG. 15E is not carried out for keyNum. If keyNum is not in the autoNotesArray[ ], then processing is carried out normally as described herein (see FIGS. 15A 15a-9 and 15a-7, and FIG. 15E). It should be noted that an additional time y (which will be less than x) may also be used. For original performance note on events received where autoNoteTimer is less than or equal to y, processing is carried out normally as described herein (see FIGS. 15A 15a-9 and 15a-7, and FIG. 15D). This is useful for allowing a stored performance (i.e. 15a-2) which represents an originally played multi-press performance, to be indicated as it was originally played.

The timer method and the attributes of the previously described on-the-fly method, may optionally be used only for routing selected original performance input (i.e. 15a-2) to a specific PerformerKey during a performance, thus allowing processing to function normally as described herein, while allowing difficult to play passages to be performed from a specific indicated key. Each of the previously described automatic note sounding methods will allow musical data containing note-identifying information to be automatically provided for sounding one or more notes in a given performance, wherein the musical data is automatically provided based on the rate at which the one or more notes are to be sounded in the given performance. This holds true even in embodiments where PerformerKeys are armed with actual stored processed performance note events, as described herein in the modifications section, using one example. It should be noted that a previously described on-the-fly method, may be combined with an embodiment of the optional tempo control method of FIG. 15K, described later, to provide a user with further creative control in a given performance. When these two are combined, a user may actually be allowed to vary the amount of the automatically provided musical data in the given performance, based on the rate at which the user performs one or more keys. A user may also be allowed to vary the number of input controller selections needed to effect the given performance, based on the rate at which the user performs one or more keys. Many variations and/or combinations of the previously described automatic note sounding methods may be used in an embodiment of the present invention, and will become apparent to those of ordinary skill in the art.

TABLE 24

Chord Performance and Melody Performance Attributes and Services

Attributes:

1. mode
2. performanceMode
3. tempoControlMode
4. optionalMode

Services:

1. RcvLiveKey(keyEvent);
2. SetMode(newMode);

TABLE 25

Chord Performance and Melody Performance Mode Setting Combinations

| Mode Index | Performance Mode | Tempo Control Mode | Optional Mode |
|---|---|---|---|
| 0 | 0 (off) | 0 (off) | 0 (off) |
| 1 | 1 (chord perf. only) | 0 (off) | 0 (off) |

TABLE 25-continued

Chord Performance and Melody Performance Mode Setting Combinations

| Mode Index | Performance Mode | Tempo Control Mode | Optional Mode |
|---|---|---|---|
| 2 | 1 | 0 | 1 (indicators only/chord) |
| 3 | 1 | 1 (chord driven) | 0 (off) |
| 4 | 1 | 1 | 1 (indicators only/chord) |
| 5 | 2 (melody perf. only) | 0 (off) | 0 (off) |
| 6 | 2 | 0 | 2 (indic. only/melody) |
| 7 | 2 | 2 (melody driven) | 0 (off) |
| 8 | 2 | 2 | 2 (indic. only/melody) |
| 9 | 3 (chord/ melody perf.) | 0 (off) | 0 (off) |
| 10 | 3 | 0 | 1 (indicators only/chord) |
| 11 | 3 | 0 | 2 (indic. only/melody) |
| 12 | 3 | 0 | 3 (BYPASS chord proc.) |
| 13 | 3 | 0 | 4 (BYPASS mel. proc.) |
| 14 | 3 | 1 (chord driven) | 0 (off) |
| 15 | 3 | 1 | 1 (indicators only/chord) |
| 16 | 3 | 1 | 2 (indic. only/melody) |
| 17 | 3 | 1 | 4 (BYPASS mel. proc.) |
| 18 | 3 | 2 (melody driven) | 0 (off) |
| 19 | 3 | 2 | 1 (indicators only/chord) |
| 20 | 3 | 2 | 2 (indic. only/melody) |
| 21 | 3 | 2 | 3 (BYPASS chord proc.) |
| 22 | 3 | 3 (chord/melody driven) | 0 (off) |
| 23 | 3 | 3 | 1 (indicators only/chord) |
| 24 | 3 | 3 | 2 (indic. only/melody) |

Figure 15H:
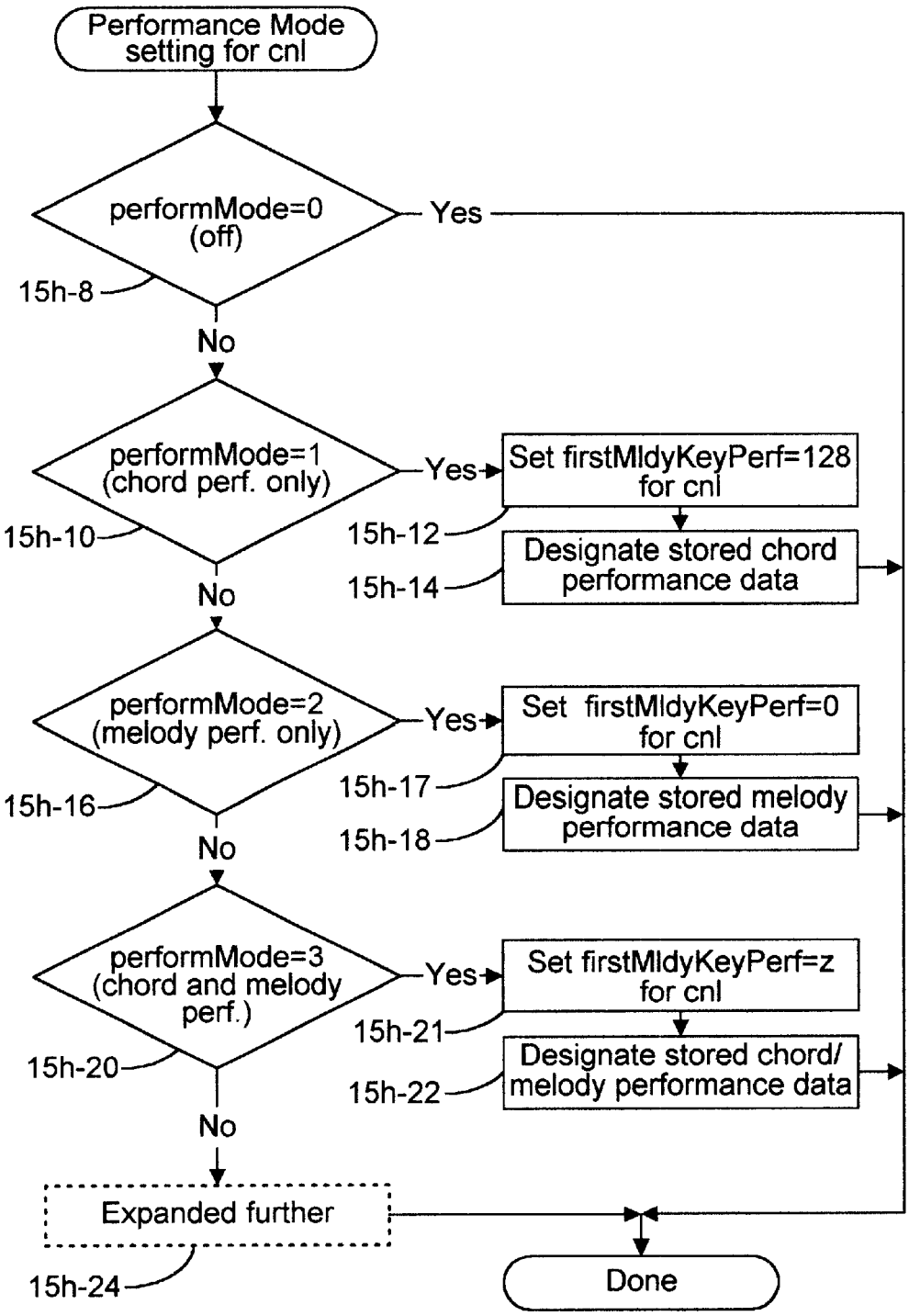

FIG. 15H shows a flow diagram for setting the performanceMode for the channel. FIG. 15A will be referred to while describing the flow diagram. If in step 15*h*-8 performanceMode=0 (off for cnl), then processing finishes. If performanceMode=1 in step 15*h*-10, then step 15*h*-12 sets firstMldyKeyPerf[ ] to 128 for cnl if not already. Step 15*h*-14 then designates stored chord performance data 15*a*-5 to be used for performance, and processing finishes. It should be noted that this designated stored performance data 15*a*-5 may be predetermined or user-selectable. If performanceMode=2 in step 15*h*-16, then step 15*h*-17 sets firstMldyKeyPerf[ ] to 0 for cnl if not already. Step 15*h*-18 then designates stored melody performance data 15*a*-2 to be used for performance as described previously, and processing finishes. If performanceMode=3 in step 15*h*-20, then step 15*h*-21 sets firstMldyKeyPerf[ ] to Z for cnl if not already (Z may be predetermined or user-selectable). Step 15*h*-22 then designates stored melody performance data 15*a*-2 and stored chord performance data 15*a*-5 to be used for performance as described previously, and processing finishes. Step 15*h*-24 shows a possible expansion of performance modes. One example of possible expansion, is to slightly modify the system to allow more than one Melody Performance Method 15*a*-18 for the channel, and more than one Chord Performance Method 15*a*-16 for the channel, etc. Another example of possible expansion is to provide a simplified "indicators only" mode which may be used to indicate a performance as originally played. The original performance data 15*a*-2 and 15*a*-5 would then be used only for providing indicators on the instrument. All other processing by the performance methods 15*a*-16 and 15*a*-18 would be bypassed, and live key inputs 15*a*-1 would be passed directly to the music software 15*a*-12.

Figure 15I:
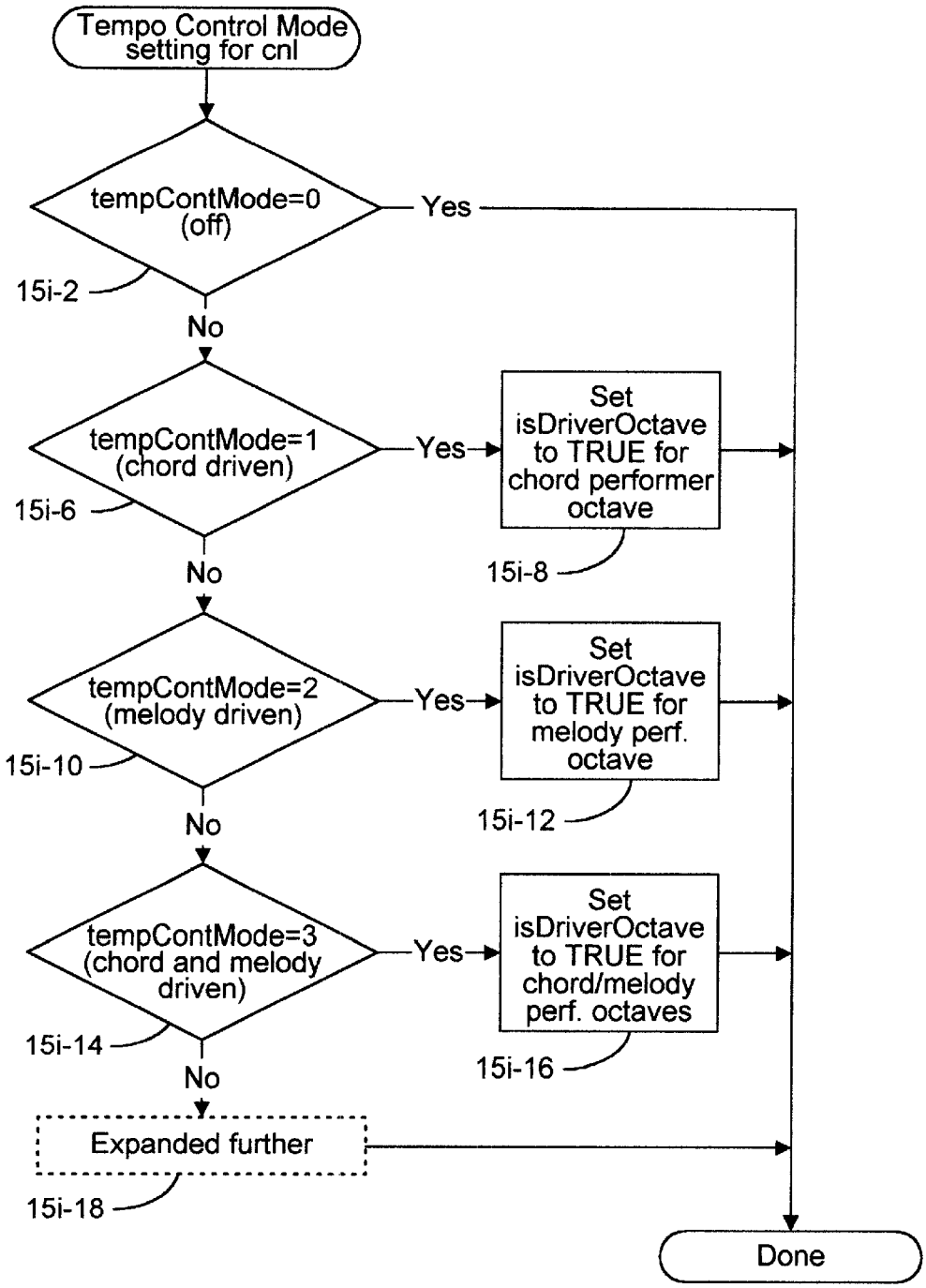

FIG. 15I shows a flow diagram for setting the tempoControlMode for the channel. Tempo control is an optional feature described later by FIG. 15K. If in step 15*i*-2 tempoControlMode=0 (off for cnl), then processing finishes. If tempoControlMode=1 in step 15*i*-6, then step 15*i*-8 sets isDriverOctave to TRUE for the chord performer octave and processing finishes. If tempoControlMode=2 in step 15*i*-10, then step 15*i*-12 sets isDriverOctave to TRUE for the melody performer octave and processing finishes. If tempoControlMode=3 in step 15*i*-14, then step 15*i*-16 sets isDriverOctave to TRUE for both the melody performer octave and the chord performer octave, and processing finishes. Step 15*i*-18 shows a possible expansion of tempo control modes.

Figure 15J:
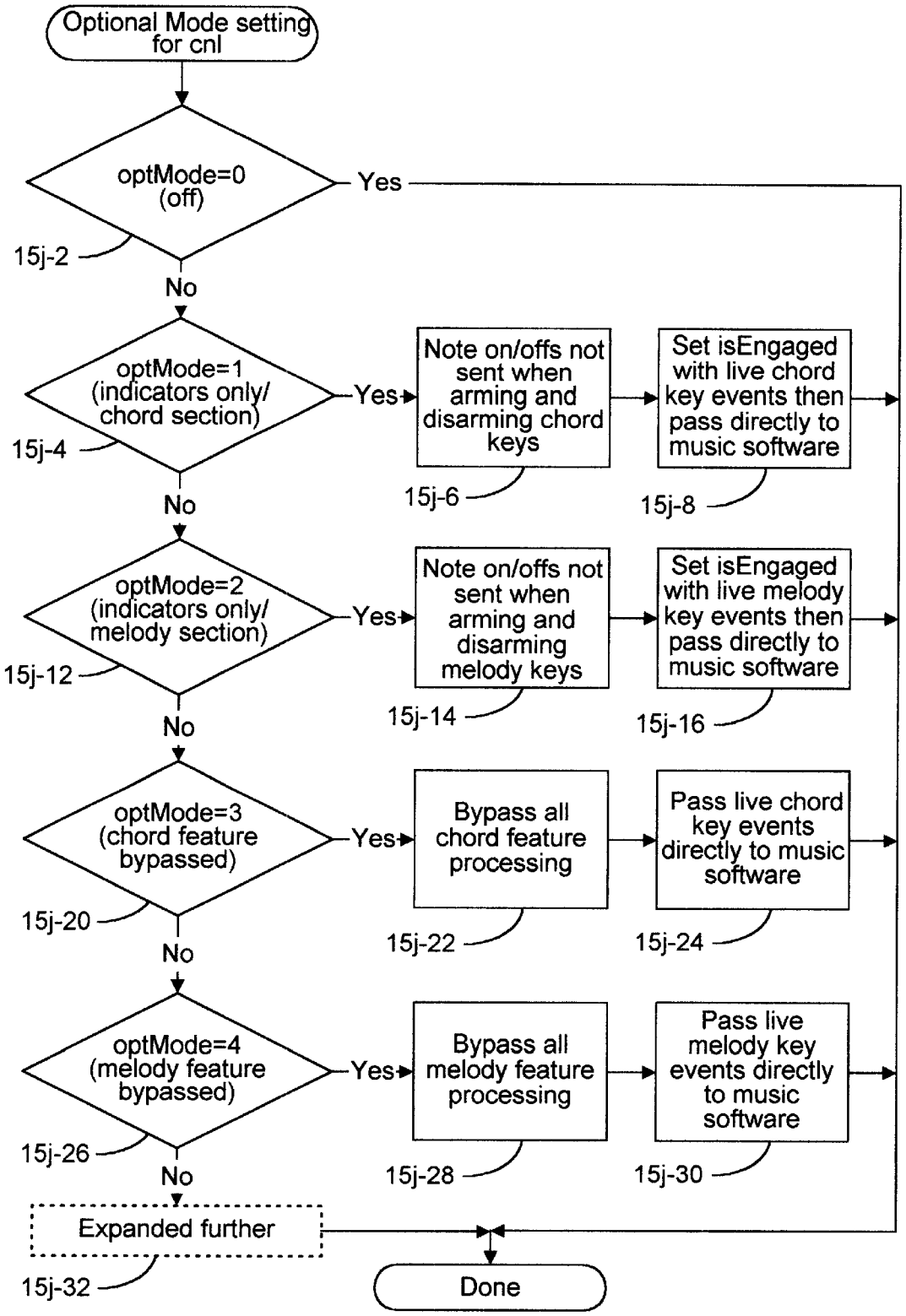
Figure 15K:
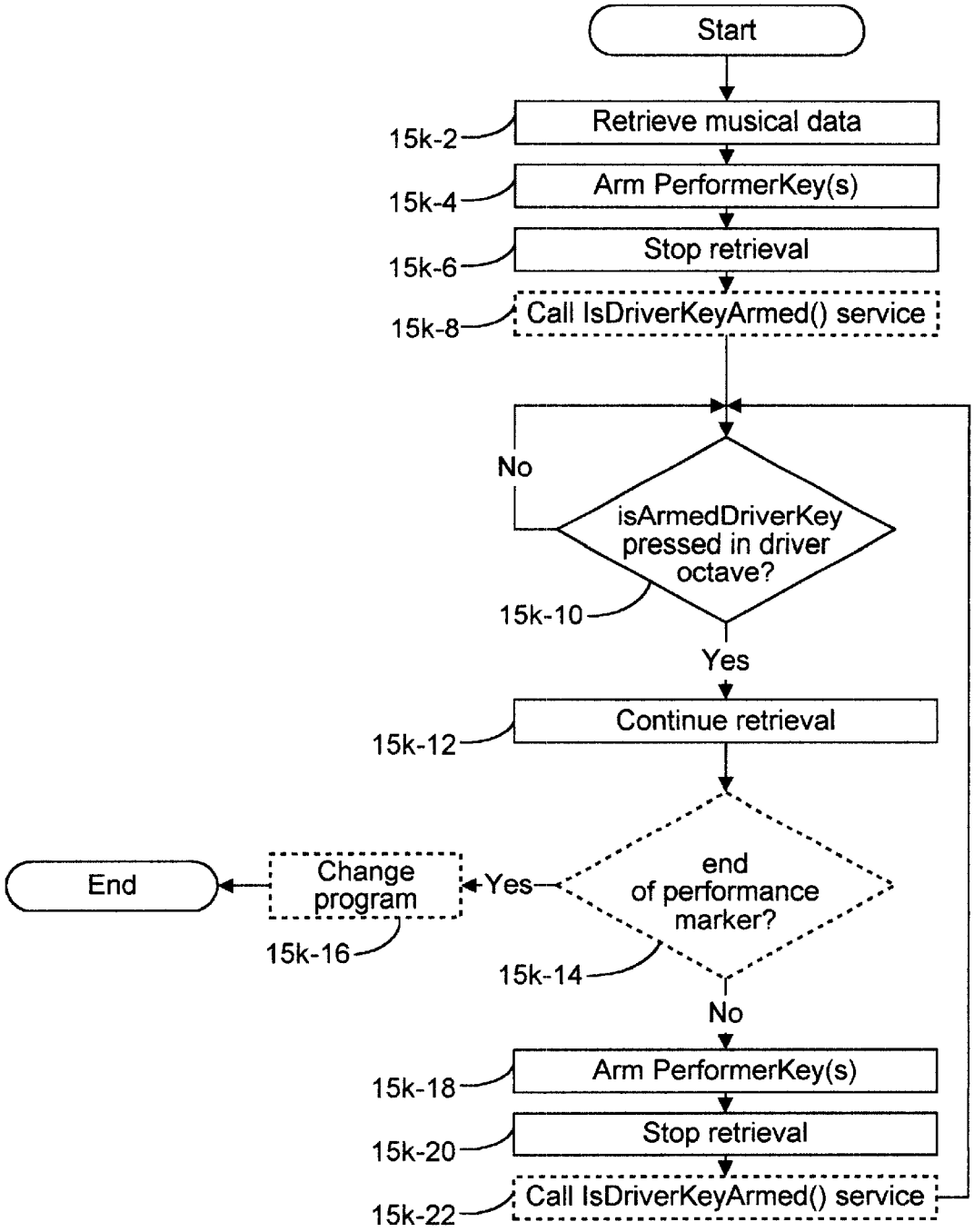
FIG. 15K is a logic flow diagram of a tempo control feature of the performance function.

FIG. 15J shows an overview in the form of a flow diagram for setting various optional modes which may be used in an embodiment of the present invention, although not required. FIG. 15A will be referred to while describing the overview. If in step 15*j*-2 optMode=0 (off for cnl), then processing finishes. If optMode=1 in step 15*j*-4, then note on/off messages are not generated and sent when arming and disarming ChordPerformerKey objects as illustrated by 15*j*-6. To accomplish this, the services Arm and DisArm (FIGS. 15D and 15E) are modified not to send any note on/off messages. Non note on/off messages (pitch bend, etc.) in the original chord performance 15*a*-5 are not sent to the music software 15*a*-12. Live chord key events in the chord performer octave are used only to set the isEngaged attribute, and then are passed directly to the music software 15*a*-12 on chord method sourceChannel, as illustrated by 15*j*-8. Note on/off messages are not generated and sent by the Engage and Disengage services (FIGS. 15B and 15C/requires minor modification to these services). All live chord key events not in the chord performer octave are passed directly to the music software 15*a*-12 on chord method sourceChannel. If optionalMode=2 in step 15*j*-12, then note on/off messages are not generated and sent when arming and disarming MelodyPerformerKey objects as illustrated by 15*j*-14. To accomplish this, the services Arm and DisArm (FIGS. 15D and 15E) are modified not to send any note on/off messages. Non note on/off messages (pitch bend, etc.) in the original melody performance 15*a*-2 are not sent to the music software 15*a*-12. Live melody key events in the melody performer octave are used only to set the isEngaged attribute, and then are passed directly to the music software 15*a*-12 on melody method sourceChannel, as illustrated by 15*j*-16. Note on/off messages are not generated and sent by the Engage and Disengage services (FIGS. 15B and 15C/requires minor modification to these services). All live melody key events not in the melody performer octave are passed directly to the music software 15*a*-12 on melody method sourceChannel. If optionalMode=3 in step 15*j*-20, then all Chord Performance Method processing 15*a*-16 (including indicators) is bypassed as illustrated by 15*j*-22. All live chord key events are passed directly to the music software on chord method sourceChannel as illustrated by 15*j*-24. If optionalMode=4 in step 15*j*-26, then all Melody Performance Method processing 15*a*-18 (including indicators) is bypassed as illustrated by 15*j*-28. All live melody key events are passed directly to the music software on melody method sourceChannel as illustrated by 15*j*-30. Step 15*j*-32 shows a possible expansion of optional modes.

Table 26 shows the performance method attributes common to all performance channels. This table will be described while referring to FIG. 15A. The attribute originalFirstMldyKey[16] holds the current firstMldyKey [16] settings for the channels while the performance feature is off for all channels (i.e. mode=0 for all channels, See Table 16 for description of firstMldyKey[16] attribute). The firstMldyKey[16] settings for all channels will be set to 0, if needed, when the performance feature is turned on for a channel (i.e. mode=0 for a channel). The originalFirstMldyKey[16] settings for the channels are not changed when mode is set greater than 0 for a channel. The originalFirstMldyKey[16] settings may then be used to reset the firstMldyKey[16] settings back to their original state when the performance feature is turned off for all channels (i.e. mode=0 for all channels). The attribute firstMelodyKeyPerformance[16] 15*a*-3 identifies the first melody key for each performance channel. All live key events 15*a*-1 for the performance channel which are less than the firstMldyKeyPerf[ ] setting for the channel, are interpreted as a chord section performance. All live key events 15*a*-1 for the performance channel which are greater than or equal to the firstMldyKeyPerf[ ] setting for the channel, are interpreted as a melody section performance.

TABLE 26

| Performance Method Attributes (common to all performance channels) |
|---|
| Attributes: |
| 1. originalFirstMldyKey[16] |
| 2. firstMelodyKeyPerformance[16] |

The previously described performance methods of the present invention may be used on multiple performance channels. Tables 20 through 25 as well as the performance processing shown by FIGS. 15A through 15J may simply be duplicated for each performance channel. The service of FIG. 15G may be modified as follows, if desired, when multiple performance channels are used. Optional step 15*g*-6 of FIG. 15G (shown by dotted lines), will determine if mode=0 for all channels. If mode=0 for all channels, then step 15*g*-8 will reset the firstMldyKey[ ] settings for all channels back to their original state, if needed, using the originalFirstMldyKey[16] settings (see Table 26), and processing finishes. Step 15*g*-10 will set the firstMldyKey[ ] settings for all channels to 0, if needed, then processing continues to step 15*g*-12 as before. An embodiment of the present invention may be optimized for single user performance, or for simultaneous multi-user performance. Each user may select one or more given performance parts, thus allowing multiple users to cumulatively effect a given performance, possibly along with stored playback tracks. At least one user in the group may perform in bypassed mode as described herein, thus allowing traditional keyboard play, drum or "percussion" play (possibly along to indications), etc. An embodiment of the present invention may allow one or more users to perform an original user composition using dynamically provided indicators, as described herein. An original user composition is defined herein to include a composition representative at least in part of an original work, wherein at least a portion of the original work was originally played and recorded by one or more users using a fixed-location type musical method known in the art. Multiple instances of indication are dynamically provided for each of a plurality of input controllers, for performance of at least a portion of note-identifying information representative of the original work which was originally played and recorded by one or more users using a fixed-location type musical method known in the art. Various other playback tracks, parts, segments etc. may also be included in and one or more possibly indicated in, a given performance of the original user composition.

FIG. 15K shows a flow diagram for one embodiment of an additional performance feature of the present invention. The method shown allows a user to creatively control the tempo of a performance based on the rate at which a user performs one or more indicated keys. The advanced method described herein provides complete creative tempo control over a performance, even while using the improvisational and mapping capabilities as described herein. This feature is common to all performance channels. However, it may also be used in simplified systems including one instrument systems, etc. This method may be used to "step through" the indications in a given performance in response to a user performance of one or more indicated keys. In the embodiment shown, this is accomplished by controlling the rate at which the stored original performance 15*a*-2 and 15*a*-5 is received by the performance methods 15*a*-16 and 15*a*-18 (all channels). Markers are included in the stored original performance 15*a*-2 and 15*a*-5 at various predetermined intervals in the sequence. The markers may then be used to effectively allow a user to "step through" the performance at the predetermined intervals. An end-of-performance marker may be included at the end of the longest stored performance to be effected. It should be noted that in a presently preferred embodiment, all marker data is normally stored in a separate storage area than that of the original performance data 15*a*-2 and 15*a*-5. When tempoControlMode=1 (chord driven mode), a chord section performance is used to control the tempo. When tempoControlMode=2 (melody driven mode), a melody section performance is used to control the tempo. When tempoControlMode=3 (chord driven and melody driven mode), both a chord section performance and a melody section performance are used to control the tempo. Processing commences after the mode has been set (see FIG. 15G), and tempoControlMode is equal to either 1, 2, or 3 (see Table 25 for mode setting combinations). Processing may commence automatically or in response to user-selectable input (i.e. play button on the user interface being selected, etc.). Step 15*k*-2 begins by retrieving the stored musical data 15*a*-2, 15*a*-5, and marker data at a predetermined rate. The stored musical data may include notes, intentional musical pauses, rests, etc. Step 15*k*-4 arms one or more PerformerKeys in the usual manner until a marker is received. It should be noted that markers are normally stored at intervals in the performance, so as to always allow at least one PerformerKey (where isDriverOctave=TRUE) to be armed before stopping retrieval of the musical data. Step 15*k*-6 stops the retrieval of the musical data when the marker is received. Step 15*k*-10 determines if an isArmedDriverKey is pressed in an isDriverOctave. This is done by calling the IsArmedDriverKeyPressed( ) service for each instance of PerformerKey[ ] (all channels) where isDriverOctave=TRUE and isArmedDriverKey=TRUE. This service will return True (1) where isDriverOctave=TRUE, isArmedDriverKey=TRUE, and isEngaged=TRUE for the PerformerKey object. It will return False (0) where isDriverOctave=TRUE, isArmedDriverKey=TRUE, and isEngaged=FALSE for the PerformerKey object. Step 15*k*-10 effectively performs a continuous scan by calling the IsArmedDriverKeyPressed( ) service repeatedly as necessary until a value of True (1) is returned for a PerformerKey. This will indicate that a user has pressed an indicated live key 15*a*-1 (isArmedDriverKey=TRUE) which is currently designated as a driver key (isDriverOctave=TRUE). When at least a value of True (1) is returned, execution then proceeds to step 15*k*-12. Step 15*k*-12 retrieves the next segment of stored musical data 15*a*-2, 15*a*-5, and marker data at a predetermined rate. Step 15*k*-1 8 arms one or more PerformerKeys in the usual manner until a next marker is received. Step 15*k*-20 stops the retrieval of the musical data when the previously mentioned next marker is received. Step 15*k*-10 determines if an isArmedDriverKey is pressed in a driver octave as before, and then processing continues as previously described until there is no more musical data left to retrieve. If end-of-performance markers are used, step **15*k*-14 will terminate the performance when an end-of-performance marker is received. Optional step 15*k*-16 may be used to change the program at the end of a given performance. This is useful when mapping scenarios are to be changed automatically for the performance, using one example. This may allow the performance to be made progressively harder, improvisational parts to be added and indicated, harmonies to be added, etc. It should be noted that the processing of 15*k*-10 may be implemented in a variety of ways. As one example, a counter (initialized with a value of zero) may be used that is common to all performance channels. The counter is incremented where a PerformerKey object (on any channel) is engaged, armed, and isDriverOctave TRUE, and decremented where a PerformerKey object (on any channel) is changed from this state. Step 15*k*-10 may then continuously scan for a counter value which is greater than zero, before continuing retrieval of the musical data 15*k*-12 (This requires minor modification to the services shown in FIGS. 15B through 15**E).

Those of ordinary skill will recognize that with minor modification, an embodiment of the present invention may allow a user to auto-locate to predetermined points in a performance, which is known in the art. A given performance may also be "temporarily bypassed" for allowing a user to improvise using one or more instruments, before resuming the given performance. In a presently preferred embodiment of temporary bypassing, any or all users release all keys, then a user activates the temporary bypassing of the given performance, such as in response to user-selectable input provided via switching on the instrument, etc. In optional steps not shown in FIG. 15K, which occur just prior to step **15*k*-10, the status of any temporary bypassing is determined. If the optional step determines that temporary bypassing is active, then all live key inputs 15*a*-1 (on all channels) are passed directly to the music software 15*a*-12 for processing as original performance inputs, thus allowing a user to improvise using an instrument. It should be noted that an additional step may also be used to reset the firstMldyKey[16] settings back to their original state using the originalFirstMldyKey[16] settings as described previously, thus allowing a user to possibly even initiate chord and scale changes in the temporary bypassing. The optional step then performs a continuous scan for determining the status of the temporary bypassing. When the optional step determines that temporary bypassing is inactive, then the firstMldyKey[16] settings for all channels will be set to 0, if required. Stored current status messages may then be scanned for determining the first current status message corresponding to the current given performance location, if required, in the event a chord change or scale change has been initiated by a user in the temporary bypassing. This determined current status message is then read by the music software to prepare the software for performance of the correct current chord notes and current scale notes before the given performance is resumed. Processing then continues to step 15*k*-10 for processing in the usual manner. It should be noted that the bypassing function may be automated, such as by including "bypass in"/"bypass out" markers in the stored musical data and performing appropriate steps when the markers are received. Those of ordinary skill will recognize that "temporarily bypassing the given performance" as defined herein, may still allow a user to advance the given performance depending on the particular embodiment and on which live key inputs 15*a*-1 are passed directly to the music software 15*a*-12 during the temporary bypassing. Although the presently preferred embodiment is to pass all live key inputs 15*a*-1 (on all channels) directly to the music software 15*a*-12**, this is not required in an embodiment of the "temporary bypassing of the given performance". Those of ordinary skill will also recognize that "resuming the given performance" as defined herein, may include resuming the given performance from a different location, using various different performance data for resuming the given performance, etc. The temporary bypassing method of the present invention may also be used on simplified systems, including those described herein which may simply display indicators to a user at a predetermined tempo. Many variations of the "temporary bypassing" method of the present invention are possible, and will become apparent to those of ordinary skill.

Optional steps **15*k*-8 and 15*k*-22 (shown by dotted lines) may also be used in an embodiment of the present invention. These steps are used to verify that at least one previously described driver key is currently indicated (armed). These optional steps may be useful in an embodiment of the tempo control method which is used to start and stop a common sequencer, for example. However, they are normally not required, especially if the tick count described below is relatively low. In an embodiment of this type, markers are not required. Instead, start and continue commands are sent in steps 15*k*-2 and 15*k*-12, respectively. Stop commands are sent in steps 15*k*-6 and 15*k*-20. These start and stop commands are internal to the software and do not result in notes being turned off or controllers being reset. When arming data 15*a*-2 and 15*a*-5 is received in step 15*k*-4 for a first PerformerKey (where isDriverOctave=TRUE), a tick count, or a timer (not shown) commences. After a predetermined number of ticks, or time has expired, a stop command is then sent in step 15*k*-6 to effectively stop retrieval of the musical data. This tick count, or timer method is also carried out in step 15*k*-18. A tick count or timer is especially useful for allowing stored original performance data occurring over a short time frame to arm the appropriate PerformerKeys before retrieval of the musical data is stopped. Optional steps 15*k*-8 and 15*k*-22 are used to call the IsDriverKeyArmed( ) service for each instance of PerformerKey[ ] (all channels) where isDriverOctave=TRUE. This service will return True (1) where isDriverOctave=TRUE and isArmedDriverKey=TRUE for the PerformerKey object. It will return False (0) where isDriverOctave=TRUE and isArmedDriverKey=FALSE for the PerformerKey object. If a value of False (0) is returned for each PerformerKey object, then the next segment of stored musical data 15*a*-2 and 15*a*-5 is retrieved at a predetermined rate. One or more PerformerKeys are armed in the usual manner as described previously and then stopped as before. The IsDriverKeyArmed( ) service is then called again for each instance of PerformerKey[ ] as described previously. Processing continues in this manner until at least a value of True (1) is returned for a PerformerKey object. Execution then proceeds to step 15*k*-10 and processing is carried out in the usual manner. It should be noted that data may also simply be retrieved until the next arming note is received 15*a*-2 and 15*a*-5** (where isDriverOctave=TRUE) instead of retrieving data as previously described. Many modifications and variations of the start/stop methods of the present invention may be used, and will become apparent to those of ordinary skill in the art.

A tempo offset table (not shown) may also be stored in memory for use with the previously described tempo control methods of the present invention. This tempo offset table may be used to further improve the tempo control method of the present invention. Using the tempo offset table, a user will be allowed to maintain complete creative control over the tempo of a performance, and actually control the rate at which a subsequent indicator is displayed in a given performance. The tempo offset table includes a plurality of current timer values (i.e. 0.10 seconds, 0.20 seconds, 0.30 seconds, etc.) each with a corresponding tempo offset value (i.e. positive or negative value), for use with the attributes described below. An attribute called originalTempoSetting holds the original tempo of the performance when first begun. An attribute called currentTempoSetting holds the current tempo of the performance. An attribute called currentTimerValue holds the time at which an armed driver key is pressed in a driver octave as determined in step **15*k*-10. These attributes are initialized with currentTimerValue=0, originalTempoSetting=x, and currentTempoSetting=x, where x may be predetermined or selected by a user. A timer (not shown) is reset (if needed) and started just prior to step 15*k*-10 being carried out. When in step 15*k*-10 it is determined that an armed driver key is pressed in a driver octave as described previously, the current time of the timer is stored in the attribute currentTimerValue. The currentTimerValue is then used to look up its corresponding tempo offset in the tempo offset table, described previously. It should be noted that this table may include retrieval rates, actual tempo values, etc. for determining a rate or "representative tempo" at which an indicator is displayed. A variety of different tables may be used, if desired, including a different table for each particular song tempo, or for a user with slower/faster reflexes, etc. Step 15*k*-12 then uses this corresponding tempo offset value of the previously mentioned currentTimerValue to determine the current tempo setting of the performance. This is done by adding the tempo offset value to the currentTempoSetting value. This newly determined tempo is then stored in the currentTempoSetting attribute, replacing the previous value. The currentTempoSetting is then used in step 15*k*-12 to control the rate at which original performance data 15*a*-2 and 15*a*-5** is retrieved or "played back". This will allow a user to creatively increase or decrease the tempo of a given performance based on the rate at which a user performs one or more indicated keys in a driver octave. Normally, lower currentTimerValues will increase the tempo (i.e. using positive tempo offsets), higher currentTimerValues will decrease the tempo (i.e. using negative tempo offsets), and currentTimerValues in between the lower and higher currentTimerValues will have no effect on the tempo (i.e. using a +0 tempo offset). This will allow indicators to be displayed in accordance with an intended song tempo, while still allowing a user to creatively vary the rate at which indicators are displayed during a performance. Selected currentTimerValues may also use the originalTempoSetting or currentTempoSetting for setting the new currentTempoSetting, if desired. This may be useful when the currentTimerValue is very high, for example, indicating that a user has paused before initiating or resuming a performance. Also, a +0 tempo offset may be used if the currentTimerValue is very low, for example. This may be used to allow certain automatically sounded passages, as described herein, to be done so at a consistent tempo rate. Many modifications and variations to the previously described may be made, and will become apparent to those of ordinary skill in the art.

In one embodiment of the performance methods described herein, a CD or other storage device may be used for effecting a performance. Some or all of the performance information described herein, may be stored on an information track of the CD or storage device. A sound recording may also be included on the CD or storage device. This will allow a user to effect a given performance, such as the melody line of a song, along with and in sync to the sound recording. To accomplish this, a sync signal may be recorded on a track of the CD. The software then reads the sync signal during CD playback, and locks to it. The software must be locked using the sync signal provided by the CD. This will allow data representative of chord changes and/or scale changes stored in the sequencer, to be in sync with those of the sound recording track on the CD during lockup and playback. This may require the creation of a sequencer tempo map, known in the art. The performance information stored on the CD may be time-indexed and stored in such a way as to be in sync (during lockup and playback), with the performance information stored in the sequencer. It may also be stored according to preference. Optionally, the starting point of the sounding recording on the CD may easily be determined, and then cause the sequencer to commence playback automatically. No sync track is required, and all music processing will then take place completely within the software as described herein. Again, the data representative of chord changes and scale changes, as well as other data stored in the sequencer, will probably require a tempo map in order to stay in sync and musically-correct with the chord changes in the sound recording of the CD.

Figure 16A:
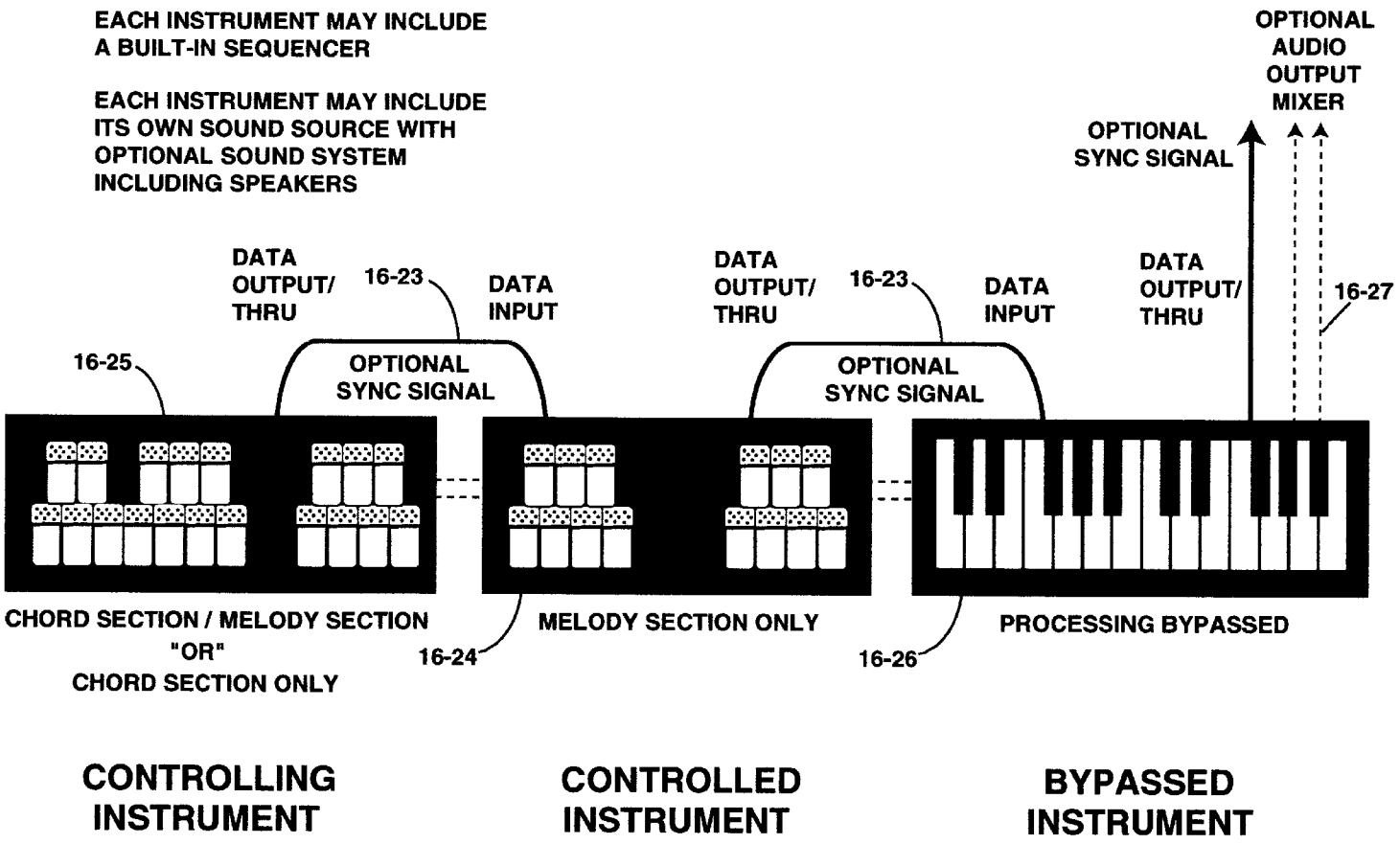
FIG. 16A is a general overview including multiple instruments of the present invention daisy-chained to one another for simultaneous performance.
Figure 16B:
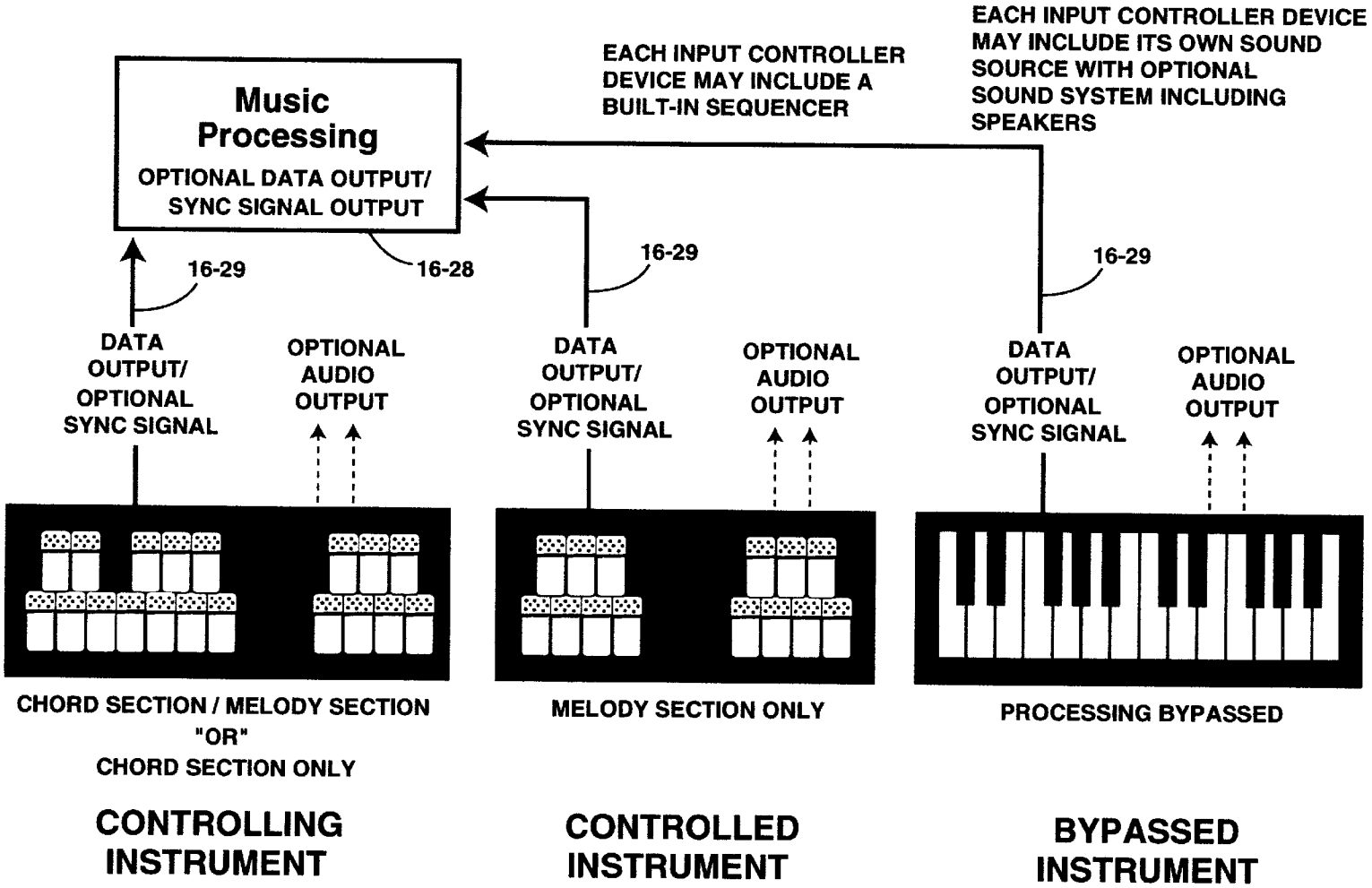
FIG. 16B is a general overview including multiple embodiments of the present invention being used simultaneously with an external processor.
Figure 16C:
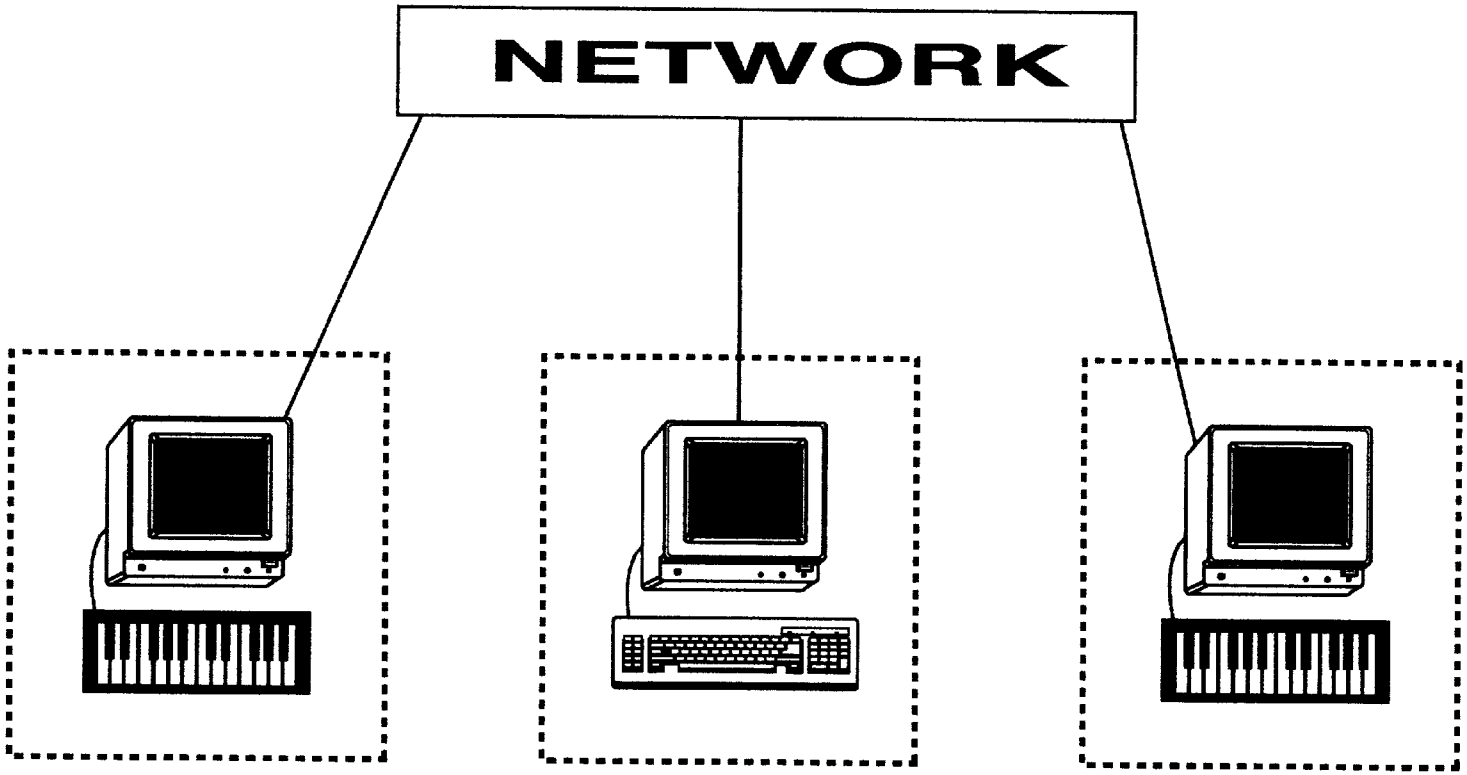
FIG. 16C is a general overview including multiple embodiments of the present invention being used together in a network.

FIGS. 16A, 16B and 16C

FIG. 16A depicts a general overview of one embodiment of the present invention using multiple instruments. Shown are multiple instruments of the present invention synced or daisy-chained together, thus allowing simultaneous recording and/or playback. Each input device may include its own built-in sequencer, music processing software, sound source, sound system, and speakers. Two or more sequencers may be synced or locked together 16-23 during recording and/or playback. Methods of synchronization and music data recording are well known in the art, and are fully described in numerous MIDI-related textbooks. The configuration shown in FIG. 16A provides the advantage of allowing each user to record performance tracks and/or trigger tracks using the sequencer of their own instrument. The sequencers will stay locked 16-23 during both recording and/or playback. This will allow users to record additional performance tracks using the sequencer of their own instrument, while staying in sync with the other instruments. The controlled instruments 16-24 may be controlled by data representative of chord changes, scale changes, current song key, setup configuration, etc. being output from the controlling instrument(s) 16-25. This information may optionally be recorded by one or more controlled or bypassed instruments 16-26. This will allow a user to finish a work-in-progress later, possibly on their own, without requiring the recorded trigger track of the controlling instrument 16-25. Any one of the instruments shown in FIG. 16A may be designated as a controlling instrument 16-25, a controlled instrument 16-24, or a bypassed instrument 16-26 as described herein. It should be noted that multiple instruments of the present invention may be connected using any convenient means known in the art, and the music software described herein may exist on any or all of the connected instruments, in any or all portions or combinations of portions.

In FIG. 16A, if an instrument set for controlled operation 16-24 or bypassed operation 16-26 contains a recorded trigger track, the track may be ignored during performance if needed. The instrument may then be controlled by a controlling instrument 16-25 such as the one shown. An instrument set to controller mode 16-25 which already contains a recorded trigger track, may automatically become a controlled instrument 16-24 to its own trigger track. This will allow more input controllers on the instrument to be used for melody section performance. Processed and/or original performance data, as described herein, may also be output from any instrument of the present invention. This will allow selected performance data to be recorded into the sequencer of another instrument 16-23 if desired. It may also be output to a sound source 16-27. Selected performance data from one instrument may be merged with selected performance data from another instrument or instruments 16-23. This merged performance data 16-23 may then be output from a selected instrument or instruments 16-27. The merged performance data 16-23 may also be recorded into the sequencer of another instrument, if desired. The instruments shown in FIG. 16A may provide audio output by using an internal sound source. Audio output from two or more instruments of the present invention may also be mixed, such as with a digital mixer. It may then be output 16-27 from a selected instrument or instruments using a D/A converter or digital output.

FIG. 16B depicts a general overview of another embodiment of the present invention using multiple instruments. Shown are multiple instruments of the present invention being used together with an external processor 16-28, thus allowing simultaneous recording and/or playback. Optional syncing, as described previously, may also be used to lock one or more of the instruments to the external processor 16-29 during recording and/or playback.

FIG. 16C is an illustrative depiction of one embodiment of the present invention, for allowing multiple performers to interactively create music over a network. Selected musical data described herein by the present invention may be used in a network to allow multiple untrained users to perform music remotely over the network.

FIG. 17

Figure 17:
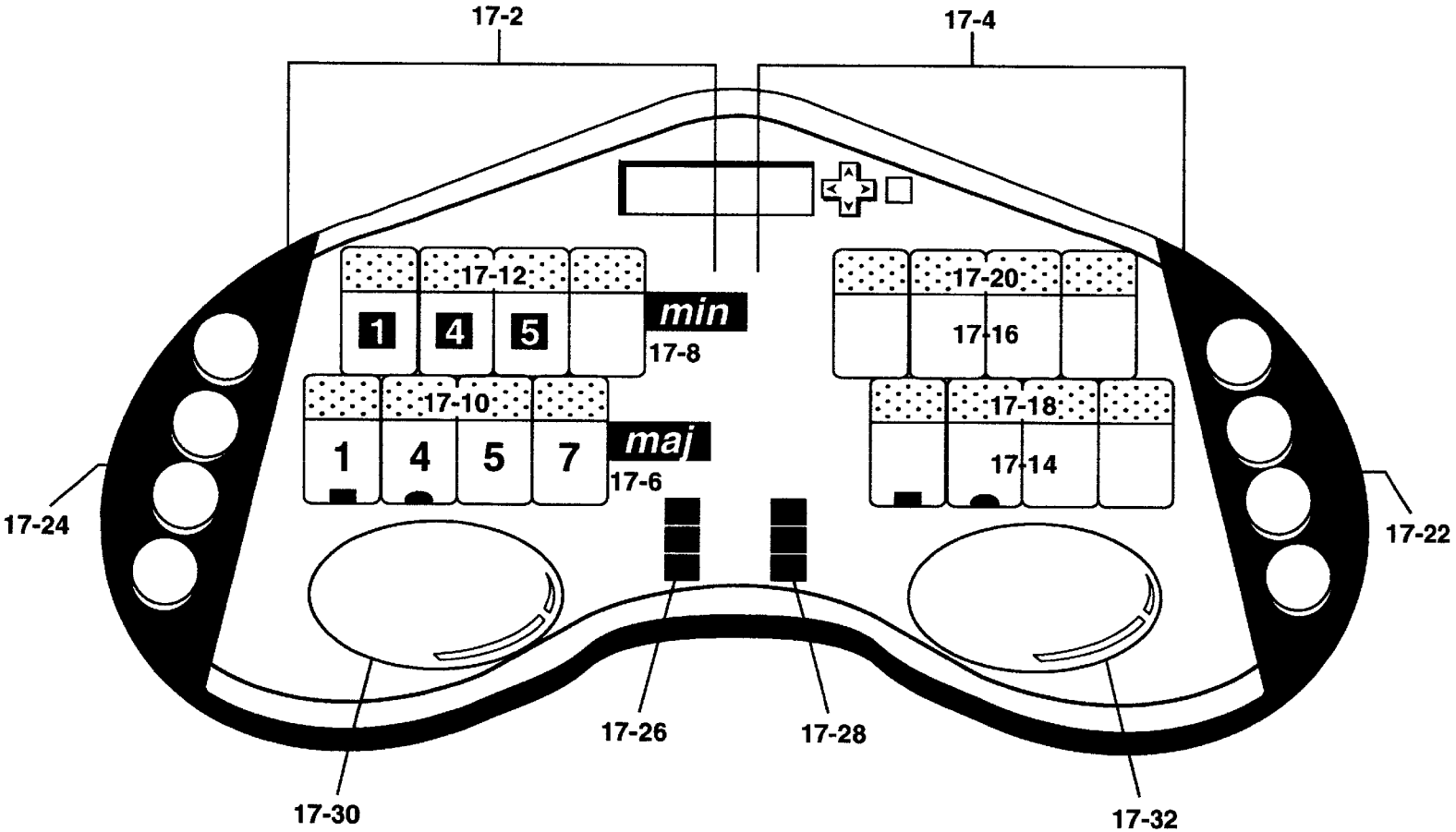
FIG. 17 depicts an embodiment of the present invention in which the number of input controllers on the instrument can be reduced, and professional performance can be achieved with little or no hand movement.

FIG. 17 shows an embodiment of the present invention in which the number of input controllers on the instrument can be reduced, and professional performance can be achieved with little or no hand movement. All key elements needed by an untrained user for professional performance are easily identifiable, thus helping to prevent user confusion. The instrument is divided into a chord section 17-2 and a melody section 17-4. An array of individual input controllers forms a performance group in the chord section 17-2, and an array of individual input controllers forms a performance group in the melody section 17-4. A performance group of the present invention will be easily identifiable to a user regardless of any additional input controllers, such as function controls, etc. which may be included in or near the performance group. In the embodiment shown, the chord progression section 17-2 is used not only to perform the normal chord section data as described herein, but also to perform the data of the first octave of the melody section as described herein. This will allow a user to dynamically change various notes or note groups in the chord section 17-2, during a left-hand performance of a chord progression. A user will thus have complete left-hand improvisational capability over both current chord notes and current scale notes while establishing the chord progression. The white input controllers in the chord section 17-6 and 17-8 are used for the performance of a chord progression as described herein. When a user performs one of these white input controllers 17-6 and 17-8, the individual notes of the current chord are simultaneously made available on one row of dotted input controllers 17-10, and the remaining scale notes as described herein are simultaneously made available on the other row of dotted input controllers 17-12. A variety of different chord roots, types, and inversions, as well as a variety of different scale notes may then be dynamically made available to a user for left-hand performance using only the dotted input controllers shown 17-10 and 17-12. This allows professional left-hand play to be achieved using a reduced number of input controllers, and with little or no hand movement required. It should also be noted that the two rows of dotted input controllers 17-10 and 17-12, may each optionally be used to perform only the individual notes of the current chord. Normally when using this embodiment, chord notes sounded using row 17-10 are sounded in a different octave than the chord notes sounded using row 17-12. This will allow two complete octaves of individual current chord notes to be played from the chord section 17-2 with little or no hand movement, and with no need for octave shifting by a user. Similarly, the two rows of dotted input controllers 17-10 and 17-12, may each optionally be used to play only remaining scale notes, and in different octaves, if desired. Both of these previously described embodiments can be employed by adjusting the firstMldyKey[ ] attribute as described herein, if needed, and configuring the system appropriately (see Table 16 for description of firstMldyKey[ ]). When a white input controller in the chord section 17-6 and 17-8 is performed, various notes and note groups are also simultaneously made available for playing in the melody section 17-4, as described herein. This allows simultaneous professional right-hand play to be achieved with little or no hand movement required. One preferred embodiment of the present invention makes individual current chord notes available for playing on the white input controllers 17-14 and 17-16, and remaining scale notes available for playing on the dotted input controllers 17-18 and 17-20. The two bottom rows of input controllers 17-14 and 17-18 are normally used to perform notes in one octave, while the two top rows of input controllers 17-16 and 17-20 are normally used to perform notes in another octave. This will allow two complete octaves of chord notes and scale notes to be played from the melody section 17-4 with little or no hand movement, and with no need for octave shifting by a user. The melody section 17-4 may also include one or more additional performance groups 17-22. The performance group shown 17-22, may be used for playing all of the different inversions of the current chord if desired. Similarly, the additional performance group shown in the chord section 17-24, may also be used for playing all of the different inversions of the current chord. It should be noted that with minor modification, a user performance in this additional performance group 17-24, may cause the individual notes of the currently played inversion from 17-24, to be simultaneously made available for playing from the dotted input controllers 17-10 and 17-12 (possibly in different octaves) if desired. It should also be noted that the rows of input controllers in the melody section 17-4, may each optionally be used to play partial scales which form one or more complete scales. Each of the complete scales may be sounded in a different octave if desired. A variety of different performance setups are possible in the previously described embodiment, and will become apparent to those of ordinary skill in the art.

The embodiment of the present invention shown in FIG. 17, may also employ multi-press or "multi-selection" operation of input controllers to vary the note-identifying information output from the chord section 17-2, which is well known in the art. Multi-press operation in the previously described embodiment, is normally only employed by the white input controllers in the chord section 17-6 and 17-8.

Multi-press operation will allow more chords to be made available to a user during a chord progression performance, with little or no hand movement being required to perform the chords. The additional performance group in the chord section 17-24, may optionally be used to allow switching between chord setups in real-time. This will allow even more chords to be made available to a user during chord progression performance. Further, both the chord section 17-2 and the melody section 17-4, can each be used for chord progression performance while establishing a chord progression. This will allow even more chords to be made available to a user during chord progression performance. This can be done by simply adjusting the firstMldyKey[ ] attribute as described herein to allow both sections 17-2 and 17-4 to function as a chord section (see Table 16 for description of firstMldyKey[ ]). Once a chord progression is decided upon and recorded by a user, then both the chord section 17-2 and the melody section 17-4, can each be used for melody section performance. In steps not shown, this can be done by simply scanning a designated storage area to determine if current status messages have been recorded (see table 17 for description of current status), then adjusting the firstMldyKey[ ] attribute appropriately, as described herein, to allow both sections 17-2 and 17-4 to function as a melody section. This is one way of allowing all performance groups 17-2, 17-4, 17-22, and 17-24 to be used efficiently at all times, thus reducing the number of input controllers needed to effect professional performance. Multi-press operation can also be used in the chord section to trigger the various other modes described herein by the present invention (i.e. press "1" input controller to sound a one-finger chord, press a "1+2 combination" to sound a fundamental chord note only, press a "1+2+3 combination" to sound an alternate chord note only, etc.: see Table 12 for description of modes). Also, all input controllers in the chord section performance group 17-2 may be set to sound one-finger chords as described herein, thus allowing even more chords to be made available to a user during chord progression performance. Many combinations of these and other note group scenarios are possible, and will become apparent to those of ordinary skill in the art.

The embodiment of the present invention shown in FIG. 17, may also employ octave shifting as described herein by the present invention. When octave shifting is applied, all output from the chord section 17-2 is shifted independently of the output of the melody section 17-4. The nature of the present invention allows performance output for the entire chord section 17-2 to be conveniently shifted from one location 17-26. An embodiment of the present invention may allow convenient user-selectable switching at a position located at or near the base of the performance group 17-26 and 17-30 (described later). The buttons shown 17-26, allow a user to shift the chord section output up by one octave, down by one octave, or back to a default octave in real-time. Output for the entire melody section 17-4 may also be conveniently and independently shifted from one location 17-28 in a similar manner. Optionally, a user may perform octave shifting using other types of switching mechanisms 17-30 and 17-32. The shifting mechanisms shown 17-30 and 17-32, allow a user to shift octaves by using depressions of the hands and/or wrists, possibly via a rocker-type switch, toggle switch, or other switching means known in the art. The shifting methods of the present invention, may be used to allow an untrained user to perform professional music in up to 5 or more complete octaves, with little or no hand movement required.

Figure 18A:
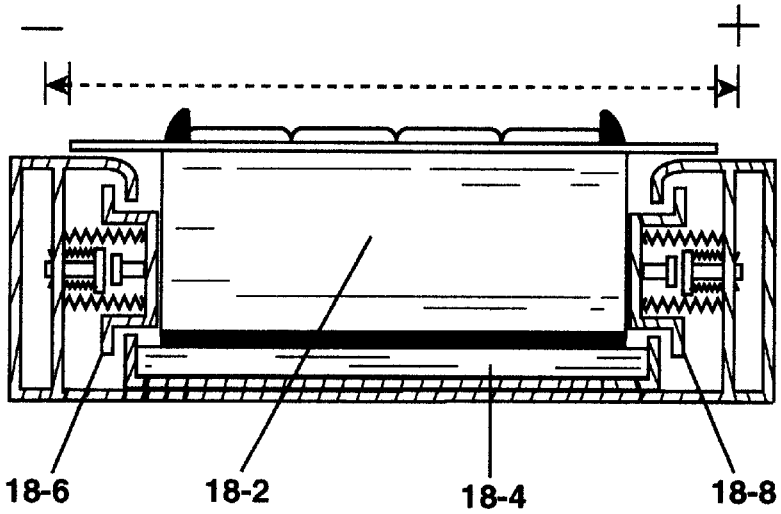
FIG. 18A depicts a sectional view of one type of movable input controller unit which may be used in an embodiment of the present invention.
Figure 18B:
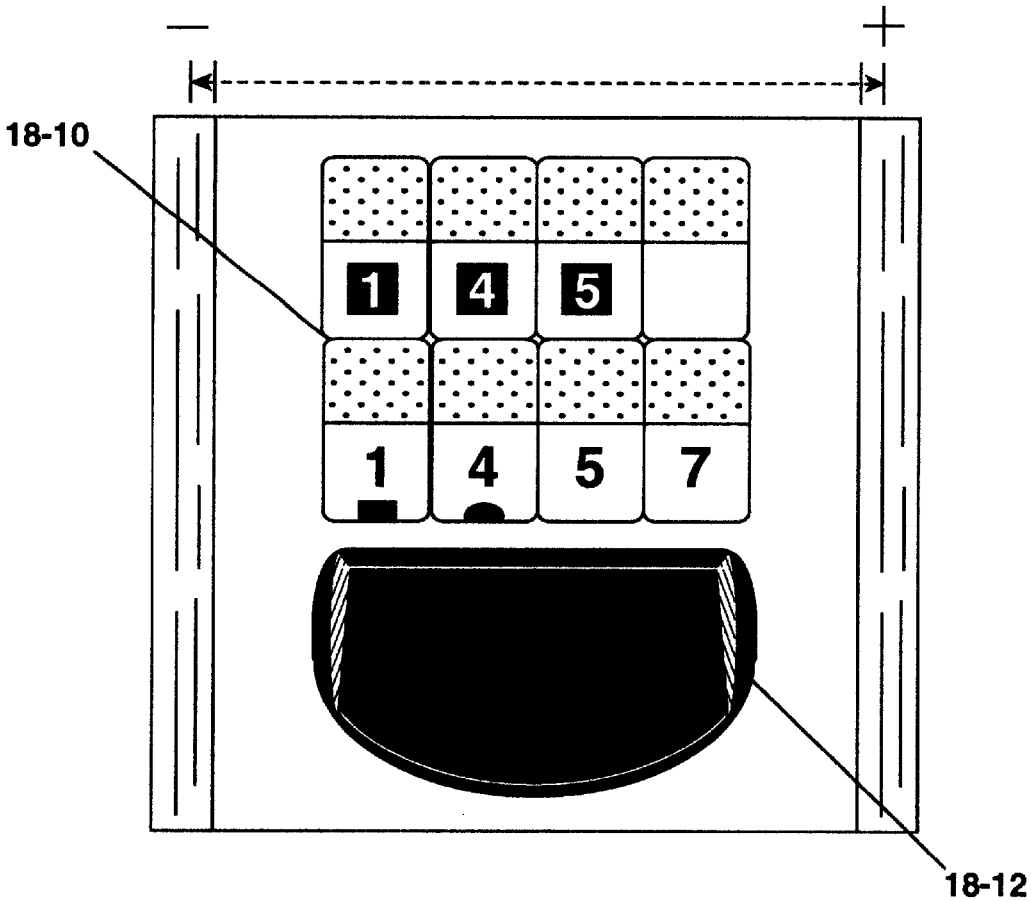
FIG. 18B depicts a perspective top view of the movable input controller unit.

FIGS. 18A and 18B

FIG. 18B shows one type of movable input controller unit which may be used in an embodiment of the present invention. A movable input controller unit may be used in an embodiment of the present invention to initiate shifting and/or note group switching. Movable units including input controllers are known. The movable unit shown, includes input controllers in a performance group 18-10 which are mounted together in any convenient manner, along with a recessed palm support 18-12. The entire unit 18-10 and 18-12 (unit shown in FIG. 18A as 18-2) is mounted on a ball bearing slide 18-4, for allowing left/right movements of the unit to initiate switching 18-6 and 18-8. One or more of the units may be incorporated into an instrument housing in a convenient manner.

Those of ordinary skill will recognize that a variety of different types of shifting mechanisms may be employed in an embodiment of the present invention to provide convenient shifting and/or note group switching. A movable unit including input controllers in an embodiment of the present invention, may allow a variety of different directions of movement of the movable unit to initiate switching. A movable unit may be used to initiate chord and scale changes in a performance. A movable unit of the present invention may also employ a variety of different switching mechanisms, and look very different from the movable unit described herein. The present invention, therefore, is not to be construed as limited to the type of movable unit shown, which is intended to be illustrative rather than restrictive.

It should be noted, however, that gloves may be used as electronic input devices to initiate a musical performance as described in Masubuchi et al., U.S. Pat. No. 5,338,891. This type of instrument is unduly limited in the fact that it does not provide enough input controllers or provide a means of allowing the high levels of flexibility and professional performance that can be achieved using the present invention. All of the various scale note groups, chord note groups, non-scale note groups, octaves, etc. could not be made available simultaneously to the extent of the present invention. Physical control over the inputs on instruments of this type is also very difficult due to the fact that the inputs are not fixed. The unpredictable up-down, left-right, and rotational movement of the fingers and hands makes performance difficult, and does not provide to a user the familiarity, flexibility, and accuracy that the present invention provides. Therefore, performance gloves of this type are not to be construed as the "movable units" defined herein by the present invention.

Different input controller types, quantities, and performance group configurations may also be used in an embodiment of the present invention, and a variety of different note group combinations may be made available to a user at any time. An embodiment of the present invention may also include lighted keys, known in the art, for carrying out various performance functions of the present invention (i.e. see FIGS. 15A through 15K, and associated performance tables). It should also be noted that tuned pitch bend functions, known in the art, as well as modulation functions may also be adapted for and included in an embodiment of the present invention.

An embodiment of the present invention may also provide additional indicators for indicating to a user any shifting requirements in a given performance. In a presently preferred embodiment of providing shifting indicators, a plurality of shifting identifiers are sent and stored during the recording of a performance, such as in response to user-selectable shifting. The presently preferred embodiment sends a negative shifting "on" identifier when negative shifting is applied and a negative shifting "off" identifier when the shift setting is then changed, and a positive shifting "on" identifier when positive shifting is applied and a positive shifting "off" identifier when the shift setting is then changed. These shifting identifiers are then read by the music software 15*a*-12 during "re-performance" for turning the appropriate shifting indicators on and off. It should be noted that when the recording of a performance commences, any current positive or negative shift setting is normally determined, and an appropriate shifting "on" identifier is stored, if applicable, at the beginning of the recorded performance.

It should be noted that during musical performance, selected notes of the present invention may be automatically corrected in response to a chord or scale change. Automatically corrected notes which sound inappropriate may be "weeded out" of a stored processed performance, if desired. Normally, stored processed note on/corresponding note off messages residing in a predetermined range before and after the corresponding stored current status message, are weeded out or removed. Stored original performance data may be quantized, known in the art, possibly together with its corresponding stored processed performance data. It is also useful to scan any stored current status messages before playback of a sequencer commences, or preferably when the sequencer is stopped. This scan is used to determine the first current status message which corresponds to the current sequencer playback location. This determined current status message is then read by the music software to prepare the software for performance of the correct current chord notes and current scale notes. Duplicate current status messages may also be weeded out of a storage area, if desired.

Many modifications and variations may be made in the embodiments described herein and depicted in the accompanying drawings without departing from the concept and spirit of the present invention. Accordingly, it is clearly understood that the embodiments described and illustrated herein are illustrative only and are not intended as a limitation upon the scope of the present invention.

For example, using the techniques described herein, the present invention may easily be modified to send and receive a variety of performance identifiers. Some of these may include current note group setup identifiers, note group identifiers, mode data, shifting identifiers which indicate a current shifting position, link identifiers which identify one or more melody keys as being linked to the chord section during a given performance, relative chord position identifiers (i.e. 1-4-5), identifiers which indicate a performance as a melody section performance or a chord section performance, and identifiers which indicate a performance as being that of a bypassed performance. Some or all of these identifiers may be encoded into each original performance and/or processed performance note event, may be derived, or may be included in a designated storage area, if desired. An embodiment of the present invention may use these identifiers for system reconfiguration, routing, etc., which may be especially useful for "re-performance" purposes.

The performance methods shown in FIGS. 15A through 15K of the present invention, allow a user to effect a given performance using a variable number of input controllers. However, at least four to twelve is currently preferred in an embodiment of the present invention. This will allow a user to feel an interaction with the instrument. The indicators described herein may optionally be generated based on stored processed performance output, if desired. The stored original performance input may be generated based on stored processed performance output and stored trigger data, mode settings, etc. Entire note on/off messages may also be placed in the armedKey[ ] array and sent at the appropriate times. It should be obvious to those of ordinary skill that the note on/off messages placed in the armedKey[ ] array may be of any type, including processed performance note on/off messages provided directly to a sound system, or other pre-stored data as desired. Default keys may also include entire note on/off messages. The armedKey[ ] array may contain note events having a variety of different channels and velocities, each of which may be output. With minor modification, the stored current status messages described herein may also be used to make on-the-fly chord assignments for the indicated live chord keys. A variety of combinations may be used, and will become apparent to those of ordinary skill in the art. The previously mentioned methods will however, lack the flexibility of the embodiments described herein.

Those of ordinary skill will recognize that with minor modification chord setups, drum maps, performance mapping scenarios, modes, etc. may be changed dynamically throughout a performance. Further, improvisational data as well as different harmony scenarios may each be used for enhancement of a performance. An improvisation identifier may be encoded into stored note data for performance purposes. These identifiers may be encoded into note on/off messages sent and stored as a result of pressing an "unarmed/unindicated" live key during a performance, for example. Improvisation identifiers may then be used to provide indicators of a different color, type, etc. This will allow an improvised part to be distinguishable by a user during a subsequent performance. A "driver key" identifier may also be encoded into stored note data used for arming the armedkey[ ] arrays. These identifiers may then be used to indicate that a particular note will be used to set the isArmedDriverKey attribute during the arming/disarming process. This may be useful for determining which indicated keys are to be driver keys, and which indicated keys are not to be driver keys. Driver key identifiers may also be used to provide indicators of a different color, type, etc. This may be useful for allowing a user to distinguish driver keys from other indicated keys. It should be noted that with minor modification, a sustained indicator of a different color, type, etc. may also be provided to indicate a difficult to play passage in a performance, as described herein.

The present invention may also use a different range or ranges than the 54–65 range described herein for note generation, chord voicings, scale voicings, etc. The preferred embodiment allows chords in the chord progression section to be shifted up or down by octaves using user-selectable switching, input controller performances, etc. The previously said switching and performances may also be used to allow more chord types to be available to a user. Chords in the chord section may also be provided in different octaves simultaneously if desired. This is done by simply following the procedures set forth herein for the chords in the melody section. Also, data representative of chord and scale changes may be provided in varying combinations from a recording device, live inputs from a user, using a variety of identifiers, etc. Those of ordinary skill will recognize that a variety of combinations may be used. Each individual component note of a chord may be performed from a separate input controller in the chord progression. This will allow a user to play individual component notes of the chord while establishing a chord progression. Scale notes, non-scale notes, chords, etc. may then be simultaneously made available in the melody section, as described herein.

Any chord type or scale may be used in an embodiment including modified, altered, or partial scales. Any scale may also be assigned to any chord by a user if preferred. Multiple scales may be made available simultaneously. A variety of different chord inversions, voicings, etc. may be used in an embodiment of the present invention. Additional notes may be output for each chord to create a sound that is more full, known in the art. Although chord notes in the preferred embodiment are output with a shared common velocity, it is possible to independently allocate velocity data for each note to give chords a "humanized" feel. In addition to this velocity data allocation, other data such as different delay times, polyphonic key pressure, etc. may also be output. A variety of chord assignment methods may be used in the chord section. Different variations may be used so long as one or more notes to be performed from an input controller form a chord which is musically correct for the current song key, as described herein. A specific relative position indicator may be used to indicate an entire group of input controllers in the chord section if desired. Non-scale chords may also be indicated as a group, possibly without using specific relative position indicators. Any adequate means may be used, so long as a user is able to determine that a given input controller is designated for non-scale chord performance. The same applies to chords which represent Major chords and chords which represent relative minor chords. Each of these may also be indicated appropriately as a group. For example, an indicator representative of Major chords may be provided for a group of input controllers designated for playing Major chords. An indicator representative of relative minor chords may be provided for a group of input controllers designated for playing relative minor chords. An indicator may be provided for a given input controller using any adequate means, so long as Major chords and relative minor chords are distinguishable by a user. The indicators described herein, as well as various other inventive elements of the present invention, may also be used to improve other chord and scale change type systems known in the art.

Key labels in the present invention use sharps (#) in order to simplify the description. These labels may easily be expanded using the Universal Table of Keys and the appropriate formulas, known in the art (i.e. 1-b3-5 etc.). It should be noted that all processed output may be shifted by semitones to explore various song keys, although any appropriate labels will need to be transposed accordingly. With minor modification output may also be shifted by chord steps, scale steps, and non-scale steps, depending on the particular note group to be shifted. Shifting may be applied to the original performance input which is then sent to the music software for processing, or applied to the processed performance output. A variety of different mapping scenarios may be used for mapping the original performance input for performance of one or more desired note groups. A particular mapping scenario may be called based on a particular instrument setup, mode, etc. An event representative of at least a chord change or scale change is defined herein to include dynamically making one or more chord notes, and/or one or more scale notes, available for playing from one or more fixed locations on the instrument. In some instances, chord notes may be included in the scale notes by default.

Duplicate chord notes and scales notes were used in the embodiment of the present invention described herein. This was done to allow a user to maintain a sense of octave. These duplicate notes may be eliminated and new notes added, if preferred. Scales and chords may include more notes than those described herein, and notes may be arranged in any desired order. More than one scale may be made available simultaneously for performance. Scale notes may be arranged based on other groups of notes next to them. This is useful when scale notes and remaining non-scale notes are both made available to a user. Each scale and non-scale note is located in a position so as to be in closest proximity to one another. This will sometimes leave empty positions between notes which may then be filled with duplicates of the previous lower note or next highest note, etc. A note group may be located anywhere on the instrument, and note groups may be provided in a variety of combinations. The present invention may be used with a variety of input controller types, including those which may allow a chord progression performance to be sounded at a different time than actual note generation and/or assignments take place. Separate channels may also be assigned to a variety of different zones and/or note groups on the instrument, known in the art. This may be used to allow a user to hear different sounds for each zone and/or note group. This may also apply to trigger output, original performance, and harmony note output as well.

It may be useful to make the chord progression section and the first octave of the melody section function together and independently of the rest of the melody section. Functions such as octave shifting, full range chords, etc. may be applied to the chord progression section and first melody octave, independently of the functioning of the rest of the melody section. It may also be useful to make various modes and octaves available by switching between them on the same sets of keys. An example of this is to switch between the chord progression section and first melody octave on the same set of keys. Another example is to switch between scale and non-scale chord groups, etc. This will allow a reduction in the amount of keys needed to effectively implement the system.

It should be noted that with minor modification, ascending or descending glissandos may be automatically sounded in response to a performance of one or more input controllers. This may be done by first determining the current component note and current octave which corresponds to the input controller being pressed (i.e. chord component note, scale component note, etc.) Then, a series of note on/offs are automatically output for each note in a specific group of notes (i.e. current scale note group, current chord note group, chromatic note group, etc.), starting with the current component note and in the current octave. The automatic output may be halted when the one or more input controllers are released, or stopped automatically when a predetermined range of notes have been output. The glissando notes may be output according to the current tempo of a song, using one example (i.e. as sixteenth notes, etc.).

As previously mentioned, an embodiment of the present invention may employ multi-press or "multi-selection" operation of input controllers. Various forms of multi-press operation are known in the art, and may be used in an embodiment of the present invention for varying selected note-identifying information output. Also, an improvement over prior art multi-press methods may be used in an embodiment of the present invention to eliminate delay associated with traditional multi-press methods. This improved multi-press method may be employed using various input controllers known in the art which are capable of providing multiple switching inputs, each occurring at a different point in time in response to a user performance of an input controller (i.e. various input controllers capable of velocity detection, etc.). During a multi-selection performance of these input controllers, a first set of inputs is used for setting key on flags of the multi-selection. When an additional input is provided in response to the completed selection of an input controller in the multi-selection, the consecutive key on flags of the multi-selection are counted for determining a multi-press combination. It should be noted that these consecutive key on flags may also be counted prior to receiving the additional input, if desired. Data representing the multi-press combination is then sent to set the performance mode as described herein (i.e. fundamental note only, chord type, chord inversion, etc.), then an original performance note on message representative of the lowest key in the multi-press combination is sent for processing as an original performance note on event, and the key number of the original performance note on event is stored. All other key selection input from the multi-press is ignored. When the last remaining input controller in the multi-selection is deselected, the stored key number is then sent as a note off message for processing as an original performance note off event, and all flags are reset. All other key deselection input from the multi-press is ignored. This improved multi-press method may be used to eliminate any performance delay during a multi-press operation, and may also be easily adapted for and employed in a variety of other musical systems. Therefore, this improved multi-press method is not to be construed as limited to the embodiment described herein.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A method for sounding notes on an electronic instrument, the instrument having a plurality of input controllers, the method comprising:

providing in a given performance an indication for an input controller, wherein the indication indicates to a user where the user should engage the instrument for providing musical data containing note-identifying information identifying at least a first note, and wherein the note-identifying information is provided based on stored data;

providing the musical data in response to a selection of the input controller;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller; and sounding notes on the electronic instrument based on the musical data.

2. The method of claim 1, further comprising:

varying the number of input controllers needed to effect the given performance.

3. method of claim 2, wherein the number of input controllers needed to effect the given performance is varied according to user-selectable input.

4. The method of claim 2, wherein a selection of the input controller in the given performance provides harmony note output, and wherein the harmony note output is varied according to user-selectable input.

5. The method of claim 1, further comprising:

providing in the given performance a plurality of indications for the input controller and for an additional input controller, wherein the indication and the additional indication are included in the plurality of indications, and wherein each of the plurality of indications indicates to the user where the user should engage the instrument for providing musical data containing note-identifying information;

designating the input controller for performance of chord notes in the given performance which correspond only to chords representing a first relative position as defined by a song key corresponding to the input controller; and designating the additional input controller for performance of chord notes in the given performance which correspond only to chords representing an additional relative position, wherein the additional relative position is defined by the song key and is different than the first relative position.

6. The method of claim 1, further comprising:

forming a group of input controllers having the input controller therein, wherein the input controllers in the group are in consecutive order;

providing in the given performance a plurality of indications for the group of input controllers, wherein the indication and the additional indication are included in the plurality of indications, and wherein each of the plurality of indications indicates to the user where the user should engage the instrument for providing musical data containing note-identifying information; and designating the group of input controllers for performance, at least in response to the plurality of indications, of chord notes corresponding to chords in the given performance, wherein a plurality of the chords in the given performance each represent a different relative position as defined by a song key corresponding to the input controller.

7. The method of claim 6, wherein indicators are provided for an input controller in the group of input controllers for indicating to the user that the relative positions are different.

8. The method of claim 1, wherein at least a portion of the stored data used for providing the note-identifying information is representative of a processed performance.

9. The method of claim 1, wherein the indication is provided using stored data representative at least in part of a processed performance.

10. The method of claim 1, wherein at least a portion of the musical data is provided according to user-selectable octave shifting.

11. The method of claim 1, wherein at least one note is sounded in response to the selection of the indicated input controller, and wherein sound output is automatically muted for a subsequent selection of the input controller in the given performance.

12. The method of claim 1, wherein a shifting indication is provided in the given performance for indicating to the user that shifting is required in order to effect a portion of the given performance.

13. A method for sounding notes on an electronic instrument, the instrument having a plurality of input controllers, the method comprising:

providing in a given performance an indication for an input controller, wherein the indication indicates to a user where the user should engage the instrument for providing musical data containing note-identifying information identifying at least a first note;

providing the musical data in response to a selection of the input controller;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller;

initiating in the given performance a plurality of events each of which is representative of at least a chord change or scale change; and sounding notes on the electronic instrument based on the musical data.

14. The method of claim 13, further comprising:

varying the number of input controllers needed to effect the given performance.

15. The method of claim 14, wherein the number of input controllers needed to effect the given performance is varied according to user-selectable input.

16. The method of claim 14, wherein a selection of the input controller in the given performance provides harmony note output, and wherein the harmony note output is varied according to user-selectable input.

17. The method of claim 13, further comprising:

providing in the given performance a plurality of indications for the input controller and for an additional input controller, wherein the indication and the additional indication are included in the plurality of indications, and wherein each of the plurality of indications indicates to the user where the user should engage the instrument for providing musical data containing note-identifying information;

designating the input controller for performance of chord notes in the given performance which correspond only to chords representing a first relative position as defined by a song key corresponding to the input controller; and designating the additional input controller for performance of chord notes in the given performance which correspond only to chords representing an additional relative position, wherein the additional relative position is defined by the song key and is different than the first relative position.

18. The method of claim 13, further comprising:

forming a group of input controllers having the input controller therein, wherein the input controllers in the group are in consecutive order;

providing in the given performance a plurality of indications for the group of input controllers, wherein the indication and the additional indication are included in the plurality of indications, and wherein each of the plurality of indications indicates to the user where the user should engage the instrument for providing musical data containing note-identifying information; and designating the group of input controllers for performance, at least in response to the plurality of indications, of chord notes corresponding to chords in the given performance, wherein a plurality of the chords in the given performance each represent a different relative position as defined by a song key corresponding to the input controller.

19. The method of claim 18, wherein indicators are provided for an input controller in the group of input controllers for indicating to the user that the relative positions are different.

20. The method of claim 13, wherein at least a portion of the stored data used for providing the note-identifying information is representative of a processed performance.

21. The method of claim 13, wherein the indication is provided using stored data representative at least in part of a processed performance.

22. The method of claim 13, wherein at least a portion of the musical data is provided according to user-selectable octave shifting.

23. The method of claim 13, wherein at least one note is sounded in response to the selection of the indicated input controller, and wherein sound output is automatically muted for a subsequent selection of the input controller in the given performance.

24. The method of claim 13, wherein a shifting indication is provided in the given performance for indicating to the user that shifting is required in order to effect a portion of the given performance.

25. A method for sounding notes on an electronic instrument, the instrument having a plurality of input controllers, the method comprising:

providing in a given performance representative of an original user composition an indication for an input controller, wherein the indication indicates to a user where the user should engage the instrument for providing musical data containing note-identifying information identifying at least a first note, and wherein the note-identifying information is provided based on stored data;

providing the musical data in response to a selection of the input controller;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller; and sounding notes on the electronic instrument based on the musical data; and automatically performing an optimization function for optimizing at least a portion of the given performance, wherein the optimization function is automatically performed based on stored data.

26. A method for sounding notes on an electronic instrument, the instrument having a plurality of input controllers, the method comprising:

providing in a given performance representative of an original user composition an indication for an input controller, wherein the indication indicates to a user where the user should engage the instrument for providing musical data containing note-identifying information identifying at least a first note, and wherein the note-identifying information is provided based on stored data;

varying the number of input controllers needed to effect the given performance;

providing the musical data in response to a selection of the input controller;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller; and sounding notes on the electronic instrument based on the musical data.

27. The method of claim 26, wherein the number of input controllers needed to effect the given performance is varied according to user-selectable input.

28. The method of claim 26, wherein a selection of the input controller in the given performance provides harmony note output, and wherein the harmony note output is varied according to user-selectable input.

29. The method of claim 25, wherein the optimization function is automatically performed according to user-selectable input.

30. The method of claim 25, wherein at least a portion of the given performance is optimized based on the instrument.

31. The method of claim 25, wherein at least a portion of any data used for effecting the given performance includes data for allowing an indicated performance to be effected from a correct note group.

32. A method for sounding notes on an electronic instrument, the instrument having a plurality of input controllers, the method comprising:

providing in a given performance representative of an original user composition an indication for an input controller, wherein the indication indicates to a user where the user should engage the instrument for providing musical data containing note-identifying information identifying at least a first note;

providing the musical data in response to a selection of the input controller;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller;

initiating in the given performance a plurality of events each of which is representative of at least a chord change or scale change; and sounding notes on the electronic instrument based on the musical data.

33. The method of claim 32, further comprising:

varying the number of input controllers needed to effect the given performance.

34. The method of claim 33, wherein the number of input controllers needed to effect the given performance is varied according to user-selectable input.

35. The method of claim 33, wherein a selection of the input controller in the given performance provides harmony note output, and wherein the harmony note output is varied according to user-selectable input.

36. The method of claim 32, further comprising:

automatically performing an optimization function for optimizing at least a portion of the given performance, wherein the optimization function is automatically performed based on stored data.

37. The method of claim 36, wherein the optimization function is automatically performed according to user-selectable input.

38. The method of claim 32, wherein at least a portion of the given performance is optimized based on the instrument.

39. The method of claim 32, wherein at least a portion of any data used for effecting the given performance includes data for allowing an indicated performance to be effected from a correct note group.

40. A method for sounding notes on an electronic instrument, the instrument having a plurality of input controllers, the method comprising:

providing in a given performance an indication for an input controller, wherein the indication indicates to a user where the user should engage the instrument for providing musical data containing note-identifying information identifying at least a first note;

providing the musical data in response to a selection of the input controller, wherein at least a portion of the musical data is provided based on stored data representative of either a processed performance or an original performance;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note;

providing the additional musical data in response to an additional selection of the input controller; and sounding notes on the electronic instrument based on the musical data.

41. A method for sounding notes on an electronic instrument, the instrument having a plurality of input controllers, the method comprising:

providing in a given performance an indication for an input controller, wherein the indication indicates to a user where the user should engage the instrument for providing musical data containing note-identifying information identifying at least a first note;

providing the musical data in response to a selection of the input controller, wherein at least a portion of the musical data is provided based on stored data representative of either a processed performance or an original performance;

providing in the given performance an additional indication for the input controller, wherein the additional indication indicates to the user where the user should engage the instrument for providing additional musical data containing additional note-identifying information identifying at least one note, wherein the additional note-identifying information identifies at least one note that is different than the first note, wherein an event representative of at least a chord change or scale is initiated in the given performance;

providing the additional musical data in response to an additional selection of the input controller; and sounding notes on the electronic instrument based on the musical data.

* * * * *